US006287753B1

(12) United States Patent
Ihama et al.

(10) Patent No.: US 6,287,753 B1
(45) Date of Patent: Sep. 11, 2001

(54) SILVER HALIDE PHOTOGRAPHIC EMULSION AND SILVER HALIDE PHOTOSENSITIVE MATERIAL USING THE SAME

(75) Inventors: Mikio Ihama; Hiroshi Kawakami; Haruyasu Nakatsugawa, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/621,629

(22) Filed: Jul. 21, 2000

(30) Foreign Application Priority Data

| | | |
|---|---|---|
| Jul. 22, 1999 | (JP) | 11-208021 |
| Aug. 2, 1999 | (JP) | 11-218868 |
| Sep. 24, 1999 | (JP) | 11-271280 |
| May 17, 2000 | (JP) | 12-145051 |

(51) Int. Cl.[7] ..... G03C 1/005
(52) U.S. Cl. ..... 430/467
(58) Field of Search ..... 430/567

(56) References Cited

U.S. PATENT DOCUMENTS

| | | | |
|---|---|---|---|
| 5,612,175 | 3/1997 | Eshelman et al. | 430/567 |
| 5,612,176 | 3/1997 | Eshelman et al. | 430/567 |
| 5,612,177 | 3/1997 | Levy et al. | 430/567 |
| 5,614,359 | 3/1997 | Eshelman et al. | 430/567 |
| 5,709,988 | 1/1998 | Black et al. | 430/567 |
| 5,780,216 | 7/1998 | Ihama | 430/567 |

*Primary Examiner*—Hoa Van Le
(74) *Attorney, Agent, or Firm*—Birch, Stewart, Kolasch & Birch, LLP

(57) ABSTRACT

This invention provides a silver halide photographic emulsion having high sensitivity and small processing dependence and a photosensitive material using the emulsion. The silver halide photographic emulsion is characterized in that the variation coefficient of equivalent-circle diameters of all grains is 40% or less, and 50% or more of the total projected area are accounted for by tabular grains meeting conditions (i) to (v) below:

(i) the tabular grains are silver iodobromide or silver bromochloroiodide tabular grains having (111) faces as major surfaces, (ii) an equivalent-circle diameter is 3.5 μm or more and a thickness is 0.25 μm or less, (iii) a silver iodide content is 2 to 6 mol %, (iv) a silver chloride content is 3 mol % or less, (v) a silver iodide distribution has a quintuple or a higher-order multiple structure.

15 Claims, 1 Drawing Sheet

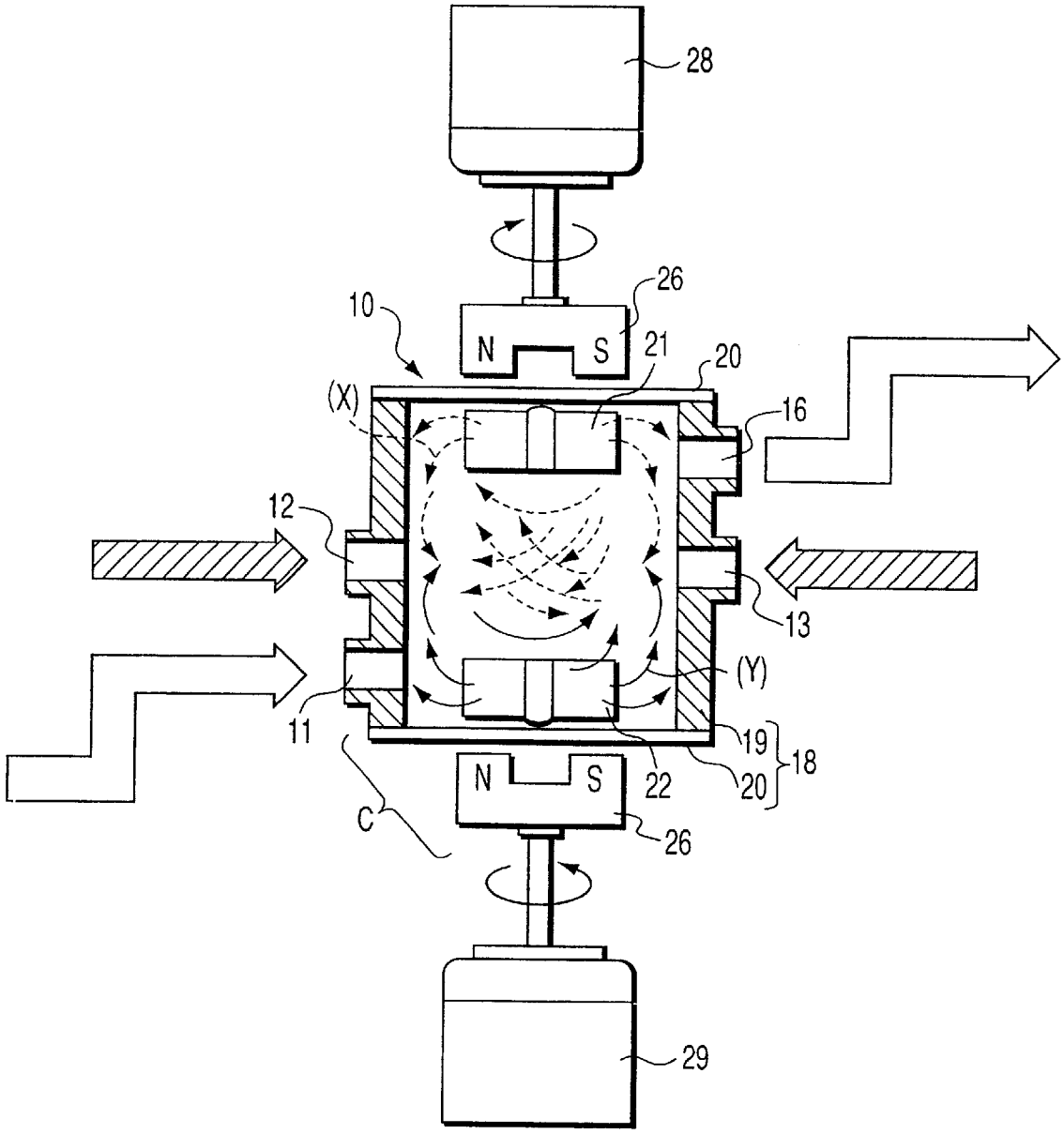
FIGURE

SILVER HALIDE PHOTOGRAPHIC EMULSION AND SILVER HALIDE PHOTOSENSITIVE MATERIAL USING THE SAME

CROSS-REFERENCE TO RELATED APPLICATIONS

This application is based upon and claims the benefit of priority from the prior Japanese Patent Applications No. 11-208021, filed Jul. 22, 1999; No. 11-218868, filed Aug. 2, 1999; No. 11-271280, filed Sep. 24, 1999; and No. 2000-145051, filed May 17, 2000, the entire contents of which are incorporated herein by reference.

BACKGROUND OF THE INVENTION

The present invention relates to a silver halide photographic emulsion used in a silver halide photosensitive material and, more particularly, to a high-speed silver halide photographic emulsion superior in development dependence.

It is well known to use tabular silver halide grains (to be referred to as "tabular grains" hereinafter) or to use large-size silver halide grains in order to obtain a high-speed silver halide photosensitive material. However, raising the sensitivity by increasing the size of tabular grains is difficult because the equivalent-circle diameter of the grains extremely increases compared to common silver halide grains. One possible reason is that photoelectrons cannot be concentrated to one location because their diffusion length extremely increases, so no latent images can be efficiently formed. To solve this problem, U.S. Pat. Nos. 5,612,175, 5,612,176, 5,612,177, and 5,614,359 have disclosed a sensitization method which uses an epitaxial junction of silver chloride to large-size tabular grains. Unfortunately, this method using a silver chloride epitaxial junction has the problem that unstable solubility of the epitaxial portion increases the KBr dependence during development. So, the method cannot be widely used for general sensitized materials.

U.S. Pat. No. 5,709,988 has disclosed a sensitization method by which dislocation lines are introduced to fringe portions of tabular grains more densely than dislocation lines introduced to major surfaces of the grains. However, this method does not show any solution to delay of development caused by the increased size of tabular grains, although the sensitivity can be raised to some extent. That is, the magnitude of the processing dependence when large-size tabular grains are used is still unsolved.

U.S. Pat. No. 5,780,216 has disclosed a technique to improve the sensitivity/graininess ratio by a tabular grain emulsion having a multilayered structure of quintuple or higher-order. Unfortunately, in this patent the shell silver iodide content is as high as 15 to 40 mol %. Hence, development delay during processing cannot be solved even when the method is applied to large-size tabular grains used in the present invention.

BRIEF SUMMARY OF THE INVENTION

It is an object of the present invention to provide a silver halide photographic emulsion capable of increasing the sensitivity of high-aspect-ratio, large-size tabular grains and at the same time solving the problem that the processing dependence such as development delay is large, and to provide a photosensitive material using the same.

The above object is achieved by means (1) to (15) below.

(1) A silver halide photographic emulsion, wherein the variation coefficient of equivalent-circle diameters of all grains is 40% or less, and 50% or more of the total projected area are accounted for by tabular grains meeting conditions (i) to (v) below:

(i) the tabular grains are silver iodobromide or silver bromochloroiodide tabular grains having (111) faces as major surfaces (ii) an equivalent-circle diameter is 3.5 μm or more and a thickness is 0.25 μm or less (iii) a silver iodide content is 2 to 6 mol %

(iv) a silver chloride content is 3 mol % or less (v) a silver iodide distribution has a multilayered structure of quintuple or higher-order.

(2) A silver halide photographic emulsion described in item (1) above, wherein the silver iodide distribution has a multilayered structure of sextuple or higher-order.

(3) A silver halide photographic emulsion described in item (1) or (2) above, wherein when irradiated with an electromagnetic beam of 325 nm at 6 K, the emulsion generates induced fluorescence of 575 nm which is at least ⅓ the intensity of maximum fluorescence emission induced in a wavelength range of 490 to 560 nm.

(4) A silver halide photographic emulsion described in any one of items (1) to (3) above, wherein the average silver iodide content on the surfaces of all grains is 5 mol % or less.

(5) A silver halide photographic emulsion described in any one of items (1) to (4) above, wherein letting It be the average silver iodide content of a whole grain and Is be the average silver iodide content on the surface of the grain, $$0.3 \cdot It \leq Is$$

holds.

(6) A silver halide photographic emulsion described in any one of items (1) to (5) above, wherein at least a portion of the silver halide grain has a positive hole capturing zone.

(7) A silver halide photographic emulsion described in any one of items (1) to (6) above, wherein the tabular grains meeting the conditions (i) to (v) recited in (1) have dislocation lines localize in the vicinities of corners of the grains.

(8) A silver halide photographic emulsion described in any one of items (1) to (7) above, wherein the variation coefficient of equivalent-circle diameters of all grains is 25% or less.

(9) A silver halide photographic emulsion described in any one of items (1) to (8) above, wherein the condition (ii) recited in (1) is that the equivalent-circle diameter is 3.5 μm or more and the thickness is 0.15 μm or less.

(10) A silver halide photographic emulsion described in any one of items (1) to (8) above, wherein the condition (ii) recited in (1) is that the equivalent-circle diameter is 4.0 μm or more and the thickness is 0.15 μm or less.

(11) A silver halide photographic emulsion described in any one of items (1) to (8) above, wherein the condition (ii) recited in (1) is that the equivalent-circle diameter is 4.0 μm or more and the thickness is 0.10 μm or less.

(12) A silver halide photographic emulsion described in any one of items (1) to (11) above, wherein the emulsion is spectrally sensitized by a spectral sensitizing dye.

(13) A silver halide photographic emulsion described in any one of items (1) to (12) above, wherein the emulsion contains 400 to 2,500 ppm of calcium ions and/or 50 to 2,500 ppm of magnesium ions.

(14) A silver halide photographic emulsion described in any one of items (1) to (13) above, wherein the emulsion is selenium-sensitized and contains at least one type of a water-soluble mercaptotetrazole compound represented by formula (I-1) below and at least one type of a water-soluble mercaptotriazole compound represented by formula (I-2) below:

Formula (I-1)

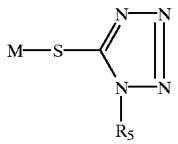

wherein $R_5$ represents an organic residue substituted by at least one member selected from the group consisting of —$SO_3M$, —COOM, —OH, and —$NHR_2$, M represents a hydrogen atom, an alkali metal atom, a quaternary ammonium group, or a quaternary phosphonium group, $R_2$ represents a hydrogen atom, $C_1$–$C_6$ alkyl, —$COR_3$, —$COOR_3$, or —$SO_2R_3$, and $R_3$ represents a hydrogen atom, alkyl, or aryl;

Formula (I-2)

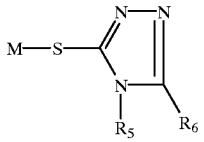

wherein $R_6$ represents a hydrogen atom, substituted or nonsubstituted alkyl, or substituted or nonsubstituted aryl, $R_5$ represents an organic residue substituted by at least one member selected from the group consisting of —$SO_3M$, —COOM, —OH, and —$NHR_2$, M represents a hydrogen atom, an alkali metal atom, a quaternary ammonium group, or a quaternary phosphonium group, $R_2$ represents a hydrogen atom, $C_1$–$C_6$ alkyl, —$COR_3$, —$COOR_3$, or —$SO_2R_3$, and $R_3$ represents a hydrogen atom, alkyl, or aryl.

(15) A silver halide photosensitive material comprising a sensitive layer containing a silver halide photographic emulsion described in any one of items (1) to (14) above on a support.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGURE is a sectional view showing an outline of the construction of a stirring device used in one embodiment of the present invention.

DETAILED DESCRIPTION OF THE INVENTION

A silver halide photographic emulsion of the present invention will be described below.

In the present invention, a tabular grain refers to a silver halide grain having two opposing, parallel (111) major surfaces. A tabular grain used in the present invention has one twin plane or two or more parallel twin planes. A twin plane denotes a (111) plane, on the two sides of which ions at all lattice points have a mirror image relationship.

This tabular grain has a triangular shape, a hexagonal shape, or a rounded triangular or hexagonal shape when viewed in a direction perpendicular to its major surfaces. Each of these shapes has outer surfaces parallel to each other.

The equivalent-circle diameter and thickness of a tabular grain are obtained by taking a transmission electron micrograph by the replica method. That is, the equivalent-circle diameter is calculated as the diameter (equivalent-circle diameter) of a circle having an area equal to the projected area of each individual grain. The thickness is calculated from the length of the shadow of a replica.

In tabular grains used in the present invention, 50% or more of the total projected area (the total of the projected areas of all individual grains) are accounted for by grains having an equivalent-circle diameter of preferably 3.5 μm or more, more preferably, 4.0 μm or more, and most preferably, 4.5 to 20 μm.

If the diameter is less than 3.5 μm, no high sensitivity can be achieved, and the problem of processing dependence to be solved by the present invention is not so serious. If the diameter exceeds 20 μm, enhancement of the sensitivity by increasing the size reaches and keeps the uppermost limit so that no more enhancement cannot be achieved.

In tabular grains used in the present invention, 50% or more of the total projected area are accounted for by grains having a thickness of preferably 0.25 μm or less, more preferably, 0.15 μm or less, and most preferably, 0.1 to 0.03 μm.

If the thickness exceeds 0.25 μm, it is difficult to achieve the merit of increasing the sensitivity by tabular grains. If the thickness is less than 0.03 μm, no shape stability can be ensured any longer, so the problem of processing dependence cannot be solved.

In an emulsion of the present invention, 50% or more of the total projected area are accounted for by tabular grains having an aspect ratio of preferably 14 or more, more preferably, 23 or more, and most preferably, 40 or more. An aspect ratio is the value obtained by dividing the equivalent-circle diameter by the thickness.

In an emulsion of the present invention, the variation coefficient of the equivalent-circle diameters of all grains is 40% or less. An emulsion of the present invention is preferably monodisperse. In an emulsion used in the present invention, the variation coefficient of the equivalent-circle diameters of all silver halide grains is preferably 30% or less, more preferably, 25% or less, and most preferably, 20% or less. If the variation coefficient exceeds 40%, the homogeneity of grains degrades, and this increases the processing dependence. The variation coefficient of equivalent-circle diameters means the value obtained by dividing the standard deviation of the distribution of the equivalent-circle diameters of individual silver halide grains by the average equivalent-circle diameter.

In an emulsion of the present invention, hexagonal tabular grains in which the ratio of the length of the longest side to the length of the shortest side is 2 to 1 account for preferably 50% or more, more preferably, 70%, and most preferably, 90% of the total projected area of all grains in the emulsion. If tabular grains other than the hexagonal grains above are mixed, the homogeneity of grains degrades and the processing dependence increases.

A tabular grain used in the present invention is a silver halide containing silver iodide, i.e., silver iodobromide or silver bromochloroiodide. The distribution of silver iodide has a multilayered structure of quintuple or a higher-order as will be described in detail later. This multilayered structure of the silver iodide distribution means that the silver iodide content varies preferably 1 mol % or more, more preferably, 2 mol % or more from one layer of the structure to another.

This silver iodide distribution structure can be obtained by calculations basically from prescribed values in the grain preparation process. The silver iodide content at the interface between layers of the structure changes either abruptly or gently. To verify this, analytical measurement accuracy must be taken into consideration, and the EPMA method (Electron Probe Micro Analyzer method) is usually effective. A sample in which emulsion grains are dispersed so as not to contact each other is formed and irradiated with an electron beam. By analyzing the emitted X-rays, elements in the microregion irradiated with the electron beam can be analyzed. This measurement is preferably performed by cooling the sample to a low temperature in order to prevent damage to the sample by the electron beam. By the same method, the distribution of the silver iodide content in a tabular grain when the grain is viewed in a direction perpendicular to its major surfaces can be analyzed. It is also possible to analyze the distribution of the silver iodide content in a section of a tabular grain by hardening the same sample and cutting the sample into very thin sections by a microtome.

The range of the silver iodide content of a tabular grain used in the present invention is preferably 2 to 6 mol %, and more preferably, 3 to 5 mol %. If the silver iodide content exceeds this range, the effect of improving the processing dependence is small even with the use of multilayered structure, large-size tabular grains of the present invention.

The range of the silver chloride content of a tabular grain used in the present invention is preferably 3 mol % or less, more preferably, 2 mol % or less, and most preferably, 1 mol % or less. The silver iodide content is preferably as small as possible because the KBr amount dependence of a processing solution decreases.

To decrease the KBr amount dependence of a processing solution when silver chloride is contained, a portion containing silver chloride is preferably as inside a grain as possible. More specifically, it is preferable that the fourth and subsequent shell (to be described later) do not contain silver chloride, and it is more preferable that specific shells (to be described later) do not contain silver chloride.

A multilayered structure tabular grain used in the present invention will be described below.

The characteristic features of a large-size tabular grain used in the present invention are that the silver iodide content ranges between 2 to 6 mol % and the grain has a quintuple or higher-order structure in which layers differ in silver iodide content by 1 mol % or more. A tabular grain of the present invention has at least a quintuple structure consisting of a core, a first shell, a second shell, a third shell, and a fourth shell in this order from a central portion. This tabular grain can also take a sextuple or higher-order structure provided that the silver iodide contents of the core and each shell, and the ratios of silver iodide contents in the core and each shell to the total silver amount basically satisfy relationships to be described later. If these values do not satisfy the relationships, the effect of the present invention cannot be obtained even with a multilayered structure. In the present invention, the core, the first shell, the second shell, the third shell, and the fourth shell correspond to the time sequence of the preparation of silver halide grains. The individual preparation steps can be continuously performed in this order, or washing and dispersion steps can be inserted between these steps. That is, after the core is prepared, it is possible to perform washing and dispersion and form the first, second, third, and fourth shells by using the prepared core grain emulsion as a seed emulsion. Likewise, an emulsion having the core grain covered with the first shell can be used as a seed emulsion.

In a tabular grain of the present invention, mol % of a silver amount contained in each of the core, the first shell, the second shell, the third shell, and the fourth shell preferably satisfies the relationship to be described later.

In the present invention, the ratio of the core of a tabular grain is 1 to 40 mol % of the total silver amount, and the average silver iodide content of the core is 0 to 5 mol %. The "ratio of the core" means the ratio of a silver amount used to prepare the core to a silver amount used to obtain a final grain. The "average silver iodide content" means mol % of a silver iodide amount used to prepare the core to a silver amount used to prepare the core. The distribution of the silver iodide can be either uniform or nonuniform. More preferably, the ratio of the core is preferably 3 to 30 mol % of the total silver amount, and the average silver iodide content of the core is preferably 0 to 3 mol %. The core can be prepared by various methods.

For example, the core can be prepared by methods described in Cleve, "Photography Theory and Practice (1930)", p. 131; Gutoff, "Photographic Science and Engineering", Vol. 14, pp. 248–257 (1970); and U.S. Pat. Nos. 4,434,226, 4,414,310, 4,433,048, and 4,439,520, and British Patent 2,112,157.

The preparation of the core basically includes three steps: nucleation, ripening, and growth. The methods described in U.S. Pat. No. 4,797,354 and Jpn. Pat. Appln. KOKAI Publication No. (hereinafter referred to as JP-A-)2-838 are very effective in the preparation of the core of a grain used in the present invention.

In the nucleation step of the core of a grain used in the present invention, it is extremely effective to use gelatin with a small methionine content described in U.S. Pat. Nos. 4,713,320 and 4,942,120, perform nucleation with a high pBr as described in U.S. Pat. No. 4,914,014, and perform nucleation within a short time period as described in JP-A-2-222940. In the ripening step of a core tabular grain emulsion of the present invention, it is sometimes effective to perform ripening in the presence of a low-concentration base as described in U.S. Pat. No. 5,254,453 or at a high pH as described in U.S. Pat. No. 5,013,641.

Tabular grain formation methods using polyalkyleneoxide compounds described in U.S. Pat. Nos. 5,147,771, 5,147,772, 5,147,773, 5,171,659, 5,210,013, and 5,252,453 are preferably used in the preparation of core grains used in the present invention.

To obtain high-aspect-ratio monodisperse tabular grains, gelatin is sometimes added during grain formation. The gelatin used for the purpose is preferably chemically modified gelatin described in JP-A-10-148897 and JP-A-11-143002 or gelatin having a small methionine content described in U.S. Pat. No. 4,713,320 and U.S. Pat. No. 4,942,120. The former chemically modified gelatin is characterized in that at least two carboxyl groups are newly introduced when an amino group in gelatin is chemically modified. It is preferable to use succinated gelatin or trimellitated gelatin. This chemically modified gelatin is added preferably before the growth step, and more preferably, immediately after the nucleation. The addition amount is 50% or more, preferably 70% or more of the weight of a total dispersing medium during grain formation.

The first shell is formed on the core tabular grain described above. The ratio of the first shell is 10 to 50 mol % of the total silver amount, and the average silver iodide content of the first shell is 1 to 15 mol %. More preferably, the ratio of the first shell is 20 to 40 mol % of the total silver amount, and the average silver iodide content of the first shell is 2 to 10 mol %. The growth of the first shell on the core tabular grain can be done either in a direction to increase the aspect ratio of the core tabular grain or in a direction to decrease it. The growth of the first shell is basically done by adding an aqueous silver nitrate solution and an aqueous halogen solution containing iodide and bromide by using the double-jet method. Preferably, the aqueous halogen solution containing iodide and bromide is diluted more than the aqueous silver nitrate solution. The temperature and pH of the system, the type and concentration of a protective colloid agent such as gelatin, and the presence/absence, type, and concentration of a silver halide solvent can vary over a broad range.

The pBr during the growth of the first shell is preferably 2.5 or less, and more preferably, 2 or less. Assuming iodine ions react with silver ions 100% and the remaining silver ions react with bromine ions, the pBr means the logarithm of the reciprocal of a bromine ion concentration in the unreacted system. Instead of adding the aqueous silver nitrate solution and the aqueous halogen solution containing iodide and bromide by using the double-jet method, it is also effective to simultaneously add an aqueous silver nitrate solution, an aqueous halogen solution containing bromide, and a silver iodide fine grain emulsion, as described in U.S. Pat. Nos. 4,672,027 and 4,693,964. The first shell can also be formed by adding and ripening a silver iodobromide fine grain emulsion. If this is the case, the use of a silver halide solvent is particularly preferable.

Examples of the silver halide solvent usable in the present invention are (a) organic thioethers described in, e.g., U.S. Pat. Nos. 3,271,157, 3,531,286, and 3,574,628, and JP-A-54-1019 and JP-A-54-158917, (b) thiourea derivatives described in, e.g., JP-A-53-82408, JP-A-55-77737, and JP-A-55-2982, (c) a silver halide solvent having a thiocarbonyl group sandwiched between an oxygen or sulfur atom and a nitrogen atom described in JP-A-53-144319, (d) imidazoles described in JP-A-54-100717, (e) sulfite, (f) ammonia, and (g) thiocyanate.

Particularly preferable silver halide solvents are thiocyanate, ammonia, and tetramethylthiourea. Although the amount of a silver halide solvent used changes in accordance with the type of the solvent, a preferable use amount of, e.g., thiocyanate is $1\times10^{-4}$ to $1\times10^{-2}$ mol per mol of a silver halide.

When any of these solvents is used, it is basically possible to remove the solvent by performing a washing step after the first shell formation step as described previously.

The second shell is formed on a tabular grain having the core and the first shell described above. The ratio of the second shell is 5 to 30 mol % of the total silver amount, and the average silver iodide content of the second shell is 0 to 5 mol %. More preferably, the ratio of the second shell is 10 to 20 mol % of the total silver amount, and the average silver iodide content of the second shell is preferably 0 to 3 mol %. The growth of the second shell on a tabular grain having the core and the first shell can be done either in a direction to increase the aspect ratio of the tabular grain or in a direction to decrease it. The growth of the second shell is basically done by adding an aqueous silver nitrate solution and an aqueous halogen solution containing bromide by using the double-jet method. Alternatively, after an aqueous halogen solution containing bromide is added, an aqueous silver nitrate solution can be added by the single-jet method. The temperature and pH of the system, the type and concentration of a protective colloid agent such as gelatin, and the presence/absence, type, and concentration of a silver halide solvent can vary over a broad range. In the present invention, it is particularly preferable that after the formation of the second shell, 75% or less of all side faces connecting the opposing (111) major faces of the tabular grain be constituted by (111) faces.

"75% or less of all side faces are constituted by (111) faces" means that crystallographic faces other than (111) faces exist at a ratio higher than 25% of all side faces. It is generally understood that this face other than (111) is a (100) face, but some other face such as a (110) face or a higher-index face can also exist. The effect of the present invention is significant when 70% or less of all side faces are constituted by (111) faces.

Whether 70% or less of all side faces of a tabular grain are constituted by (111) faces can be readily determined from a shadowed electron micrograph of the grain obtained by the carbon replica method. When 75% or more of side faces are constituted by (111) faces in a hexagonal tabular grain, six side faces directly connecting to the (111) major faces alternately connect at acute and obtuse angles to the (111) major faces. On the other hand, when 70% or less of all side faces are constituted by (111) faces in a hexagonal tabular grain, all six side faces directly connecting to the (111) major faces connect at obtuse angles to the (111) major faces. By performing shadowing at an angle of 50° or less, it is possible to distinguish between obtuse and acute angles of side faces with respect to the major faces. Shadowing at an angle of preferably 10° to 30° facilitates distinguishing between obtuse and acute angles.

As a method of knowing the ratio of (111) faces to (100) faces, a method which uses adsorption of sensitizing dyes is also effective. The ratio of (111) faces to (100) faces can be quantitatively obtained by using a method described in Journal of Japan Chemical Society, 1984, Vol. 6, pp. 942–947. That is, by using this ratio described in the literature and the equivalent-circle diameter and thickness of a tabular grain, it is possible to calculate the ratio of (111) faces in all side faces. In this case it is assumed that a tabular grain is a circular cylinder by using the equivalent-circle diameter and the thickness. On the basis of this assumption, the ratio of side faces to the total surface area can be obtained. The value obtained by dividing the ratio of (100) faces, which is obtained by adsorption of sensitizing dyes as described above, by the ratio of side faces and multiplying the quotient by 100 is the ratio of (100) faces in all side faces. Subtracting this value from 100 yields the ratio of (111) faces in all side faces. In the present invention, the ratio of (111) faces in all side faces is more preferably 65% or less.

A method by which 75% or less of all side faces of a tabular grain emulsion of the present invention are constituted by (111) faces will be described next. Most generally, the ratio of (111) faces in side faces of a silver iodobromide tabular grain emulsion can be determined by the pBr during the preparation of the second shell of the tabular grain emulsion. Preferably, 30% or more of a silver amount necessary to form the second shell are added at a pBr which render the ratio of (111) faces in side faces decreased, i.e., which render the ratio of (100) faces in side faces increased. More preferably, 50% or more of the silver amount necessary to form the second shell are added at a pBr which render the ratio of (111) faces in side faces decreases.

As another method, it is also possible to increase the ratio of (100) faces in side faces by performing ripening under a pBr condition which render the ratio of (100) faces in side faces increased, after a total silver amount is added.

The value of the pBr which render the ratio of (100) faces in side faces increased can vary over a broad range in accordance with, e.g., the temperature and pH of the system, the type and concentration of a protective colloid agent such as gelatin, and the presence/absence, type, and concentration of a silver halide solvent. Usually, the pBr is preferably 2.0 to 5, and more preferably, 2.5 to 4.5. As described above, however, the value of the pBr can easily change owing to the presence of, e.g., a silver halide solvent.

EP515894A1 can be referred to as a method of changing the face index of a side face of a tabular grain emulsion. Also, polyalkyleneoxide compounds described in, e.g., U.S. Pat. No. 5,252,453 can be used. It is effective to use face index modifiers described in, e.g., U.S. Pat. Nos. 4,680,254, 4,680,255, 4,680,256, and 4,684,607. Common photographic spectral sensitizing dyes can also be used as face index modifiers.

The third shell is formed on a tabular grain having the core, the first shell, and the second shell described above. Preferably, the ratio of the third shell is 1 to 10 mol % of the total silver amount, and the average silver iodide content of the third shell is 20 to 100 mol %. More preferably, the ratio of the third shell is 1 to 5 mol % of the total silver amount, and the average silver iodide content of the third shell is 25 to 100 mol %. The growth of the third shell on a tabular grain having the core and the first and second shells is basically done by adding an aqueous silver nitrate solution and an aqueous halogen solution containing iodide and bromide by using the double-jet method. Alternatively, an aqueous silver nitrate solution and an aqueous halogen solution containing iodide are added by the double-jet method, or an aqueous halogen solution containing iodide is added by the single-jet method. In the last case, the ratio of the third shell to the total silver amount is obtained by subtracting from the ratio of the second shell to the total silver amount, assuming that halogen conversion of the second shell takes place 100%. Assume that the silver iodide content of the composition is 100 mol %.

It is possible to use the above methods singly or by combining them. As can be seen from the average iodide content of the third shell, silver iodide can also precipitate in addition to a silver iodobromide mixed crystal during the formation of the third shell. In either case, the silver iodide vanishes and entirely changes into a silver iodobromide mixed crystal during the formation of the fourth shell.

The third shell is preferably formed by a method of adding a silver iodobromide or silver iodide fine grain emulsion. As these grains, fine grains prepared in advance can be used. More preferably, grains immediately after preparation can be used.

When fine grains prepared beforehand are to be used, a method of adding, ripening, and dissolving these fine grains is usable. A more preferable method is to add a silver iodide fine grain emulsion and then add an aqueous silver nitrate solution or add both an aqueous silver nitrate solution and an aqueous halogen solution. In this method, the dissolution of the silver iodide fine grain emulsion is accelerated by the addition of the aqueous silver nitrate solution. The silver amount of the added silver iodide fine grain emulsion is used to obtain the ratio of the third shell, and the silver iodide content thereof is assumed to be 100 mol %. The added aqueous silver nitrate solution is used to calculate the ratio of the fourth shell. The silver iodide fine grain emulsion is preferably abruptly added.

"Abruptly adding the silver iodide fine grain emulsion" is to add the silver iodide fine grain emulsion within preferably 10 min, and more preferably, 7 min. This condition can vary in accordance with, e.g., the temperature, pBr, and pH of the system to which the emulsion is added, the type and concentration of a protective colloid agent such as gelatin, and the presence/absence, type, and concentration of a silver halide solvent. However, a shorter addition time is more preferable as described above. During the addition, it is preferable that an aqueous solution of silver salt such as silver nitrate be not substantially added. The temperature of the system during the addition is preferably 40° C. to 90° C., and most preferably, 50° C. to 80° C.

The silver iodide fine grain emulsion may substantially be silver iodide and can contain silver bromide and/or silver chloride as long as a mixed crystal can be formed. The emulsion is preferably 100% silver iodide. The crystal structure of silver iodide can be a β type, a γ type, or, as described in U.S. Pat. No. 4,672,026, an α type or an α-analogue type. In the present invention, the crystal structure is not particularly restricted but is preferably a mixture of β and γ types, and more preferably, a β type. As the silver iodide fine grain emulsion, an emulsion subjected to a regular washing step is preferably used. The silver iodide fine grain emulsion can be readily formed by a method described in, e.g., U.S. Pat. No. 4,672,026. A double-jet addition method using an aqueous silver salt solution and an aqueous iodide salt solution in which grain formation is performed with a fixed pI value is preferable. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.07 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less. The sizes and size distribution of the silver iodide fine grain emulsion are obtained by placing silver iodide fine grains on a mesh for electron microscopic observation and directly observing the grains by the transmission method, not by the carbon replica method. This is because measurement errors increase by observation with the carbon replica method since the grain sizes are small. The grain size is defined as the diameter of a circle having an area equal to the projected surface area of the observed grain. The grain size distribution is also obtained by using the diameter of this circle having an area equal to the projected surface area. In the present invention, the most effective fine silver iodide grains have a grain size of 0.06 to 0.02 μm and a grain size distribution variation coefficient of 18% or less.

After the grain formation described above, the silver iodide fine grain emulsion is subjected to regular washing described in, e.g., U.S. Pat. No. 2,614,929, and the pH, the pI, the concentration of a protective colloid agent such as gelatin, and the concentration of the contained silver iodide are adjusted. The pH is preferably 5 to 7. The pI value is preferably set to a value at which the solubility of silver iodide is a minimum or to a value higher than that. As the protective colloid agent, a common gelatin having an average molecular weight of approximately 100,000 is preferably used. Low-molecular-weight gelatin having an average molecular weight of 20,000 or less is also preferably used. It is sometimes convenient to use a mixture of gelatins having different molecular weights. The gelatin amount is preferably 10 to 100 g, and more preferably, 20 to 80 g per kg of an emulsion. The silver amount, as the amount of silver atoms, is preferably 10 to 100 g, and more preferably, 20 to 80 g per kg of an emulsion. As the gelatin amount and/or the silver amount, it is preferable to choose values suited to abrupt addition of the silver iodide fine grain emulsion.

The silver iodide fine grain emulsion is usually dissolved before being added. During the addition it is necessary to sufficiently raise the efficiency of stirring of the system. The rotating speed of stirring is preferably set to be higher than usual. The addition of an antifoaming agent is effective to prevent the formation of foam during the stirring. More specifically, an antifoaming agent described in, e.g., an embodiment of U.S. Pat. No. 5,275,929 is used.

A more preferable method using fine grains immediately after preparation will be described next. Details of a mixer for forming fine silver halide grains are described in JP-A-10-43570.

A mixer is a stirring device including a stirring bath having a predetermined number of supply ports for supplying water-soluble silver salt and water-soluble halogen salt to be stirred and a discharge port for discharging a silver halide fine grain emulsion produced after the stirring; and a stirring means for controlling the stirring state of a liquid in the stirring bath by rotating a stirring blade in the stirring bath. Preferably, the stirring means performs stirring and mixing by using two or more stirring blades to be rotated in the stirring bath. At least two stirring blades are separated from each other in positions where they oppose each other, and are rotated in opposite directions. Preferably, these stirring blades are magnetically coupled with external magnets placed outside the nearby bath walls to form a structure having no shaft extending through the bath walls. Each stirring blade is rotated by rotating the corresponding external magnet by a motor placed outside the bath. One of the external magnets to be magnetically coupled with the stirring blades is a double-sided bipolar magnet in which N- and S-pole end faces are arranged parallel to a rotating central axis and overlap each other with this rotating central axis between them. The other external magnet is a horizontal bipolar magnet in which N- and S-pole end faces are symmetrically arranged with respect to the rotating central axis in a plane perpendicular to this rotating central axis.

FIGURE shows an embodiment of a mixer (stirring device) according to the present invention.

A stirring bath 18 is composed of a bath main body 19 having a vertical central axis, and seal plates 20 serving as bath walls closing the upper and lower open ends of the bath main body 19. Stirring blades 21 and 22 are separated from each other at the opposing upper and lower ends in the stirring bath 18 and rotated in opposite directions. These stirring blades 21 and 22 form magnetic coupling with external magnets 26 arranged outside the bath walls close to the stirring blades 21 and 22. That is, the stirring blades 21 and 22 are coupled with the respective external magnets 26 by magnetic force. When these magnets 26 are rotated by independent motors 28 and 29, the stirring blades 21 and 22 are rotated.

The stirring bath 18 has solution supply ports 11, 12, and 13 for supplying an aqueous silver salt solution and aqueous halogen salt solution to be stirred and, if necessary, supplying a colloid solution, and a discharge port 16 for discharging a stirred silver halide fine grain emulsion. The aqueous silver salt solution and the aqueous halogen salt solution are preferably added in the direction of the stirring blades, and the angle formed between the solution supply ports 11 and 12 is preferably as wide as possible. That is, 90° is more preferable than 60°, and 180° is further preferable.

A method of preparing fine silver halide grains will be described below. More specifically, (a) rotating speed of stirring, (b) staying time, (c) addition methods and protective colloid types, (d) addition solution temperature, (e) addition solution concentration, and (f) potential will be described in detail.

(a) Rotating speed of stirring

When the opposing stirring blades are driven in the mixer, the rotating speed is preferably 1,000 to 8,000 rpm, more preferably, 3,000 to 8,000 rpm, and most preferably, 4,000 to 8,000 rpm. If the rotating speed exceeds 8,000 rpm, the centrifugal force of the stirring blades becomes too strong, and this undesirably produces a counter flow to the supply ports. The rotating speeds of the stirring blades rotated in opposite directions can be the same or different.

(b) Staying time

Staying time t of an addition solution to be supplied into the mixer is represented by $$t=60\ V/(a+b+c)$$

where t: the staying time (sec)

V: the volume (mL) of a mixing space in the mixer a: the addition flow rate (mL/min) of a silver salt solution b: the addition flow rate (mL/min) of a halide salt solution c: the addition flow rate (mL/min) of a protective colloid solution The staying time t is preferably 0.1 to 5 sec, more preferably, 0.1 to 1 sec, and most preferably, 0.1 to 0.5 sec. If the staying time exceeds 5 sec, fine silver halide grains once produced in the mixer grow to result in a larger size and a wider size distribution. If the staying time t is less than 0.1 sec, addition solutions are discharged from the mixer as they are still unreacted.

(c) Addition methods and protective colloid types

An aqueous protective colloid solution is added to the mixer by the following addition methods.

a. An aqueous protective colloid solution is singly injected into the mixer. The concentration of this protective colloid is 0.5% or more, preferably 1% to 20%. The flow rate of the protective colloid is at least 20% to 30%, and preferably 50% to 200% of the sum of the flow rates of a silver salt solution and a halide solution.

b. A protective colloid is contained in a halide salt solution. The concentration of this protective colloid is 0.4% or more, preferably 1% to 20%.

c. A protective colloid is contained in a silver salt solution. The concentration of this protective colloid is 0.4% or more, preferably 1% to 20%. When gelatin is used, silver ions and the gelatin form gelatin silver, and this gelatin silver optically and thermally decomposes to produce a silver colloid.

Therefore, an aqueous silver salt solution and a gelatin solution are preferably added immediately before being used.

The methods a to c above can be used singly, or two or three thereof can be simultaneously used.

In the mixer used in the present invention, gelatin is often used as a protective colloid, and alkali-processed gelatin is commonly used. It is particularly preferable to use alkali-processed gelatin subjected to a deionization process and/or an ultrafiltration process by which impurity ions and impurities are removed. In addition to alkali-processed gelatin, it is possible to use derivatized gelatin such as acid-processed gelatin, phthalated gelatin, trimellitated gelatin, succinated gelatin, maleated gelatin, and esterified gelatin; low-molecular-weight gelatin (molecular weight=1,000 to 80,000, including enzyme-decomposed gelatin, gelatin hydrolyzed by an acid and/or an alkali, and thermally decomposed gelatin); high-molecular-weight gelatin (molecular weight=110,000 to 300,000); gelatin containing 40 μmol/g or less of methionine; gelatin containing 20 μmol/g or less of tyrosine; oxidized gelatin; and gelatin formed by deactivating methionine by alkylation. A gelatin mixture containing two or more gelatins can also be used.

To form finer silver halide grains by using the mixer, the temperature of a solution to be added to the mixer must be held as low as possible. However, gelatin easily solidifies at a temperature of 35° C. or less. Therefore, the use of low-molecular-weight gelatin which does not solidify even at low temperatures is preferable. The molecular weight of this low-molecular-weight gelatin is 50,000 or less, preferably, 30,000 or less, and more preferably, 1,000 or less. Also, a synthetic polymer which is a synthetic colloid having a fine silver halide grain protective colloid function can be used in the present invention, since this synthetic polymer does not solidify at low temperatures either. Furthermore, a natural polymer other than gelatin can be similarly used in the present invention. These polymers are described in Jpn. Pat. Appln. KOKOKU Publication No. (hereinafter referred to as JP-B-)7-111550 and Research Disclosure Vol. 176, No. 17643 (December 1978), item IX.

(d) Addition solution temperature

The addition solution temperature is preferably 10° C. to 60° C. However, to decrease the size and improve the aptitude to manufacture, the addition solution temperature is more preferably 20° C. to 40° C., and most preferably, 20° C. to 30° C. Also, to prevent generation of reaction heat in the mixer and ripening of fine silver halide grains formed, it is preferable to control the temperatures of the mixer and the piping.

(e) Addition solution concentration

In the aforementioned mixer installed outside the reaction vessel, no dilution with bulk solution is generally performed. Hence, if a concentrated addition solution is used, the size of fine silver halide grains formed increases, and the size distribution degrades. However, the mixer described above is superior in stirring and mixing capabilities to conventional stirrers. Therefore, even when concentrated addition solutions were used, ultrafine silver halide grains having a small size and a narrow size distribution were formed. More specifically, the addition solution concentration is preferably 0.4 to 1.2 mol/litter (to be also referred to as "L" hereinafter), and more preferably, 0.4 to 0.8 mol/L. An addition solution concentration of less than 0.4 mol/L is too low and impractical because the total silver amount decreases.

(f) Potential

As for the potential (excess halogen amount) in the formation of ultrafine hexagonal-system silver halide grains, the grains are preferably formed in a pAg region having small solubility in order to decrease the size of the grains. More specifically, the pAg is preferably 8.5 to 11.5, and more preferably, 9.5 to 10.5.

The present inventors extensively studied items (a) to (f) above and could prepare ultrafine hexagonal-system silver halide grains having an average equivalent-sphere diameter of 0.008 to 0.019 μm.

Ultrafine silver iodide grains thus prepared are preferably immediately supplied to the reaction vessel. Note that "immediately" is within 30 min, preferably, 10 min, and more preferably, 1 min. This time is preferably as short as possible because ultrafine silver iodide grains increase the grain size with time.

The ultrafine silver iodide grains formed in the mixer outside the reaction vessel as described above can be continuously added to the reaction vessel or added after once stored in the mixer. These two methods can also be used at the same time. When the grains are once stored in the mixer, however, the temperature is preferably 40° C. or less, and more preferably, 20° C. or less. Also, the storage time is preferably as short as possible.

As a preferable method of forming the third shell, a silver halide phase containing silver iodide can be formed while iodide ions are abruptly generated by using an iodide ion releasing agent described in U.S. Pat. No. 5,496,694, instead of the conventional iodide ion supply method (the method of adding free iodide ions).

The iodide ion releasing agent releases iodide ions by reacting with an iodide ion release control agent (a base and/or a nucleophilic reagent). Preferable examples of this nucleophilic reagent used are hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines, and sulfides.

The release rate and timing of iodide ions can be controlled by controlling the concentration and addition method of a base or a nucleophilic reagent or the temperature of the reaction solution. A preferable base is alkali hydroxide.

To abruptly generate iodide ions, the concentration of the iodide ion releasing agent and iodide ion release control agent is preferably $1\times10^{-7}$ to 20 M, more preferably, $1\times10^{-5}$ to 10 M, further preferably, $1\times10^{-4}$ to 5 M, and most preferably, $1\times10^{-3}$ to 2 M.

If the concentration exceeds 20 M, the addition amount of the iodide ion releasing agent and iodide ion release control agent having large molecular weights becomes too large compared to the volume of the grain formation vessel.

If the concentration is less than $1\times10^{-7}$ M, the iodide ion release reaction rate becomes too low, and this makes it difficult to abruptly generate the iodide ion release agent.

The temperature is preferably 30 to 80° C., more preferably, 35 to 75° C., and most preferably, 35 to 60° C.

At high temperatures exceeding 80° C., the iodide ion release reaction rate generally becomes extremely high. At low temperatures below 30° C., the iodide ion release reaction temperature generally becomes extremely low. Either case is unpreferable because the use conditions are restricted.

When a base is used to release iodide ions, a change in the solution pH can also be used. If this is the case, a pH range for controlling the release rate and timing of iodide ions is preferably 2 to 12, more preferably, 3 to 11, and particularly preferably, 5 to 10. Most preferably, the pH after adjustment is 7.5 to 10.0. Under a neutral condition of pH 7, hydroxide ions having a concentration determined by the ion product of water function as a control agent.

A nucleophilic reagent and a base can be used jointly. When this is the case, the pH can be controlled within the above range to thereby control the release rate and release timing of iodide ions.

When iodine atoms are to be released in the form of iodide ions from the iodide ion releasing agent, these iodine atoms can be entirely released or partially left behind without decomposition.

The fourth shell is formed on a tabular grain having the core, the first shell, the second shell, and the third shell described above. The ratio of the fourth shell is 10 to 40 mol % of the total silver amount, and the average silver iodide content of the fourth shell is 0 to 5 mol %. More preferably, the ratio of the fourth shell is 15 to 35 mol % of the total silver amount, and the average silver iodide content of the fourth shell is 0 to 3 mol %. The growth of the fourth shell on a tabular grain having the core and the first, second, and third shells can be done either in a direction to increase the aspect ratio of the tabular grain or in a direction to decrease it. The growth of the fourth shell is basically done by adding an aqueous silver nitrate solution and an aqueous halogen solution containing bromide by using the double-jet method. Alternatively, after an aqueous silver halogen solution containing bromide is added, an aqueous silver nitrate solution can be added by the single-jet method. The temperature and pH of the system, the type and concentration of a protective colloid agent such as gelatin, and the presence/absence, type, and concentration of a silver halide solvent can vary over a broad range. The pBr at the end of the formation of the fourth shell layer is preferably higher than that in the initial stages of the formation of that layer. Preferably, the pBr in the early stages of the formation of the layer is 2.9 or less, and the pBr at the end of the formation of the layer is 1.7 or more. More preferably, the pBr in the early stages of the formation of the layer is 2.5 or less, and the pBr at the end of the formation of the layer is 1.9 or more. Most preferably, the pBr in the early stages of the formation of the layer is 1 to 2.3, and the pBr at the end of the formation of the layer is 2.1 to 4.5.

Side faces connecting the (111) main surfaces of the final grains can be (111) faces, (100) faces, or a mixture of (111) and (100) faces, or can further contain higher-index faces. A tabular grain emulsion having a low (111) face ratio in side faces described in EP515894A1 is preferably used.

When tabular grains of an emulsion of the present invention are cooled to less than 10° K. (in the present invention, 6° K. is chosen for practical comparison) and the emulsion is induced by an electromagnetic beam (e.g., a helium-cadmium laser) having a wavelength of 325 nm, the emulsion emits light of 575 nm which is ⅓ the maximum emission intensity within the wavelength range of 490 to 560 nm, in addition to an induced emission peak within the wavelength range of 490 to 560 nm. Basically, this emission of 575 nm depends upon the structure of a layer having a high silver iodide content, which corresponds to the third shell described earlier. This emission intensity of 575 nm changes in accordance with the silver amount, silver iodide amount, and formation method of the third shell. When the preferable third shell formation method of the present invention is used, this emission of 575 nm is preferably ½ or more, and more preferably, ⅔ or more the maximum emission intensity within the wavelength range of 490 to 560 nm.

In the present invention, tabular grains preferably have dislocation lines. Dislocation lines in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to electron rays. In this case, the larger the thickness of a grain, the more difficult it becomes to transmit electron rays through it. Therefore, grains can be observed more clearly by using an electron microscope of high voltage type (200 kV or more for a grain having a thickness of 0.25 μm). From photographs of grains obtained by the above method, it is possible to obtain the positions and the number of dislocation lines in each grain viewed in a direction perpendicular to the major faces of the grain.

The average number of dislocation lines is preferably 10 or more, and more preferably, 20 or more per grain. If dislocation lines are densely present or they cross each other when observed, it is sometimes impossible to correctly count dislocation lines per grain. Even in these situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines of 100 or more grains.

The dislocation line amount distribution is desirably uniform between tabular grains of the present invention. In an emulsion of the present invention, silver halide grains containing 10 or more dislocation lines per grain account for preferably 100 to 50% (number), more preferably, 100 to 70%, and most preferably, 100 to 90%. A percentage lower than 50% is unpreferable in respect of homogeneity between grains.

Dislocation lines can be introduced to, e.g., a portion near the peripheral region of a tabular grain. In this case, dislocations are substantially perpendicular to the periphery and produced from a position which is at x % of the length between the center and the edge (periphery) of a tabular grain to the periphery thereof. The value of x is preferably 10 to less than 100, more preferably, 30 to less than 99, and most preferably, 50 to less than 98. In this case, although a shape obtained by connecting the start positions of the dislocations is almost similar to the shape of the grain, it is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain can have dislocation lines either almost uniformly across the whole peripheral region or at a particular position of the peripheral region. However, dislocation lines preferably localize in the vicinities of corners. In a tabular grain having triangular or hexagonal outer surfaces, when perpendicular lines are extended from a position which is at X % from the center of this tabular grain on a straight line between the center of the tabular grain and each corner to two edges forming this corner, the vicinity of the corner means a portion surrounded by these perpendicular lines and the two edges, i.e., the portion being a three-dimensional region across the whole thickness of the grain. The value of X is 50 to less than 100, preferably 75 to less than 100.

When a tabular grain is rounded, each corner is unclear. Even in a tabular grain like this, it is possible to obtain three or six tangents with respect to the peripheral portion and obtain, as corners, points where straight lines connecting the intersections of these tangents to the center of the tabular grain intersect the peripheral portion of the tabular grain.

"Dislocation lines localize in the vicinities of corners" means that 60% or more of all dislocation lines are present in the vicinities of corners. Preferably, 80% or more of all dislocation lines are present in the vicinities of corners. When a tabular grain has hexagonal outer surfaces, dislocation lines can localize in the vicinity of at least one of six corners or can evenly localize in the vicinities of the six corners.

Dislocation lines can be introduced to the vicinities of corners of a tabular grain by forming a specific layer having a high silver iodide content inside the vicinities of corners of the grain. This layer having a high silver iodide content includes the formation of a discontinuous region having a high silver iodide content.

In order to selectively form the layer having a high silver iodide content, which corresponds to the third shell of the present invention described in detail earlier, in the vicinities of corners of a substrate grain, i.e., a grain in which the second shell is already formed, it is necessary to control the formation conditions of the substrate grain and the formation conditions of the layer having a high silver iodide content. As the substrate grain formation conditions, the temperature and the pAg (the logarithm of the reciprocal of a silver ion concentration) during the formation of the outermost shell of the tabular grain and the presence/absence, type, amount, and temperature of a silver halide solvent are important factors. More specifically, during the formation of the outermost shell of the substrate grain, the pAg is preferably 7.8 or less, and more preferably, 7.2 or less. Alternatively, the layer having a high silver iodide content can be selectively formed in the vicinities of corners by forming the outermost shell under conditions not meeting the pAg described above and then ripening in the abovementioned pAg region. When the outermost shell formation process described above is performed in the presence of a silver halide solvent, the threshold value of the pAg shifts to higher values. As this silver halide solvent, ammonia, an amine compound, a thioether compound, or thiocyanate salt is effective.

Another method of forming the layer having a high silver iodide content is to add iodine ions to a substrate grain emulsion at high temperature or high pAg, thereby selectively causing conversion (halogen conversion) in the vicinities of corners of the substrate grain. Consequently, the layer having a high silver iodide content can be formed in the vicinities of corners of the substrate grain.

Dislocation lines can also be formed across a region containing the centers of two parallel major faces of a tabular grain. However, this is unfavorable compared to the above case in which dislocation lines localize in the vicinities of corners. When dislocation lines are formed across the entire region of the major faces, the direction of the dislocation lines is sometimes crystallographically, approximately a (211) direction with respect to a direction perpendicular to the major faces. In some cases, however, the direction is a (110) direction or random. The lengths of the individual dislocation lines are also random; the dislocation lines are sometimes observed as short lines on the major faces and sometimes observed as long lines reaching the edges (outer periphery). Although dislocation lines are sometimes straight, they are often zigzagged. In many cases, dislocation lines cross each other.

In tabular grains of a silver halide emulsion of the present invention, the positions of dislocation lines can be limited to the peripheral region, the major faces, or local positions. Although these positions can also be combined, dislocation lines preferably localize in the vicinities of corners described above.

In the present invention, the ratio of grains containing dislocation lines and the number of dislocation lines are obtained by directly observing dislocation lines of preferably at least 100 grains, more preferably, 200 grains or more, and most preferably, 300 grains or more.

The variation coefficient of the silver iodide content distribution between silver halide grains of the present invention is preferably 20% or less, more preferably 15% or less, and most preferably, 10% or less. If the variation coefficient is larger than 20%, no hard gradation results, and a reduction in sensitivity upon application of a pressure increases. The silver iodide content of each individual grain can be measured by analyzing the composition of the grain by using an X-ray microanalyzer. The variation coefficient of the silver iodide content distribution between grains is the value defined by a relation (standard deviation/average silver iodide content)×100=variation coefficient, by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., EP147,868. A correlation exists, or does not exist, between a silver iodide content Yi (mol %) and an equivalent-sphere diameter Xi ($\mu$m) of each grain. This correlation preferably does not exist.

The present inventors made extensive studies and have found that in a tabular grain emulsion of the present invention, it is very preferable that the average silver iodide content on the grain surface be 5 mol % or less in respect of the sensitivity of the emulsion and the storage stability of a silver halide photosensitive material containing the emulsion. The average silver iodide content on the grain surface of the present invention is measured using XPS (X-ray Photoelectron Spectroscopy). The principle of XPS used in an analysis of the silver iodide content near the surface of a silver halide grain is described in Junnich Aihara et al., "Spectra of Electrons" (Kyoritsu Library 16, Kyoritsu Shuppan, 1978). A standard measurement method of XPS is to irradiate a silver halide in appropriate sample form with mg-K$\alpha$ as excitation X-rays and measure the intensities of photoelectrons (usually I-3d5/2 and Ag-3d5/2) of iodine (I) and silver (Ag) emitted from the silver halide. The content of iodine can be calculated from a calibration curve of the photoelectron intensity ratio (intensity (I)/intensity (Ag)) of iodine (I) to silver (Ag) formed by using several types of standard samples having known iodine contents. XPS measurement for a silver halide emulsion must be performed after gelatin adsorbed by the surface of a silver halide grain is decomposed and removed by, e.g., protease. A tabular grain emulsion of the present invention in which the silver iodide content on the grain surface is 5 mol % or less is an emulsion whose silver iodide content is 5 mol % or less when emulsion grains contained in a single emulsion solution are analyzed by XPS. If obviously two or more types of emulsions are mixed, appropriate preprocessing such as centrifugal separation or filtration must be performed before one type of emulsion is analyzed.

Furthermore, according to the extensive studies by the present inventors, it is advantageous for the sensitivity that an average silver iodide content Is on the grain surfaces of a tabular grain emulsion of the present invention be 5 mol % or less as described above, and that this average silver iodide content Is have a relationship, represented by the following expression, with an average silver iodide content It of the whole grains.

$$0.3 \cdot It \leq Is$$

In a silver halide emulsion of the present invention, a positive hole capturing zone is preferably formed in at least a portion inside a silver halide grain. This greatly eliminates inefficiency which is produced when the grain size described previously is increased. A positive hole capturing zone in the present invention refers to a region having a function of capturing so-called positive holes, e.g., positive holes generated in pairs with photoelectrons produced by photoexcitation. In the present invention, this positive hole capturing zone is defined as a zone formed by intentional reduction sensitization.

"Intentional reduction sensitization" in the present invention means an operation of introducing positive hole capturing silver nuclei to a part or the whole of the interior of a silver halide grain by adding a reduction sensitizer. A positive hole capturing silver nucleus is a silver nucleus having small development activity. This silver nucleus can prevent recombination loss during the sensitizing process and raise the sensitivity.

Known examples of the reduction sensitizer are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although the addition amount of the reduction sensitizers must be so selected as to meet the emulsion manufacturing conditions, a preferable amount is $10^{-7}$ to $10^{-3}$ mol per mol of a silver halide.

The reduction sensitizers are dissolved in water or a solvent, such as alcohols, glycols, ketones, esters, or amides, and the resultant solution is added during grain growth.

In the present invention, positive hole capturing silver nuclei are preferably formed by adding reduction sensitizers after nucleation and physical ripening and immediately before the start of grain growth. However, it is also possible to introduce positive hole capturing silver nuclei to the grain surface by adding reduction sensitizers after grain formation is completed.

When reduction sensitizers are added during grain formation, some silver nuclei formed can stay inside a grain, but some ooze out to form silver nuclei on the grain surface. It is preferable to use these oozing silver nuclei also as positive hole capturing silver nuclei.

In the present invention, intentional reduction sensitization for forming positive hole capturing silver nuclei inside silver halide grains in steps during the course of grain formation is preferably performed in the presence of a compound represented by formula (II-1) or (II-2). A compound represented by formula (II-1) or (II-2) presumably prevents oxidation of silver nuclei by oxidizing radicals, thereby stably forming only positive hole capturing silver nuclei. A clear experimental fact is that when intentional reduction sensitization is performed in steps during the course of grain formation in the absence of a compound represented by formula (II-1) or (II-2), the effects of the present invention are difficult to achieve.

The steps during the course of grain formation do not include steps after final desalting is have been performed. For example, a step such as a chemical sensitization step, in which silver halide grains grow as a result of addition of, e.g., an aqueous silver salt solution or a fine-grain silver halide, is excluded.

Formula (II-1)

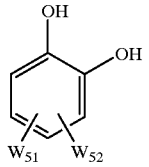

Formula (II-2)

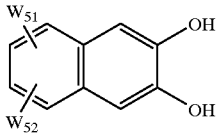

In formulas (II-1) and (II-2), each of $W_{51}$ and $W_{52}$ represents a sulfo group or a hydrogen atom. However, at least one of $W_{51}$ and $W_{52}$ represents a sulfo group. The sulfo group is generally an alkali metal salt such as sodium or potassium salt or a water-soluble salt such as ammonium salt. Favorable practical examples are 3,5-disulfocatechol disodium salt, 4-sulfocatechol ammonium salt, 2,3-dihydroxy-7-sulfonaphthalene sodium salt, and 2,3-dihydroxy-6,7-disulfonaphthalene potassium salt. A preferable addition amount can vary in accordance with, e.g., the temperature, pBr, and pH of the system to which the compound is added, the type and concentration of a protective colloid agent such as gelatin, and the presence/absence, type, and concentration of a silver halide solvent. Generally, the addition amount is preferably 0.0005 to 0.5 mol, and more preferably, 0.003 to 0.02 mol per mol of a silver halide.

It is preferable to use an oxidizer for silver during the process of manufacturing a silver halide emulsion of the present invention. The use of an oxidizer for silver is particularly essential when positive hole capturing silver nuclei are to be formed by intentional reduction sensitization only in a region which finally locates in the vicinity of the surface of a silver halide grain. Presumably, the selective formation of positive hole capturing silver nuclei is difficult without employing an oxidizer for silver, when intentional reduction sensitization is performed only in a region which is in the vicinity of the surface of a silver halide grain. An oxidizer for silver means a compound having an effect of converting metal silver into silver ion. In particular, a compound that converts very fine silver grains by-produced in the processes of formation and chemical sensitization of silver halide grains into silver ion is effective. The silver ion produced can form a silver salt hard to dissolve in water, such as a silver halide, silver sulfide, or silver selenide, or a silver salt easy to dissolve in water, such as silver nitrate. The oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O)$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

In the present invention, preferable inorganic oxidizers are ozone, hydrogen peroxide and its adduct, a halogen element, and thiosulfonate, and preferable organic oxidizers are quinones. A particularly preferable oxidizer is thiosulfonate as described in JP-A-2-191938.

The oxidizer for silver described above can be added before the start of intentional reduction sensitization, during the reduction sensitization, or immediately before or after the completion of the reduction sensitization. The oxidizer can also be separately added several times. Although the addition amount depends on the type of oxidizer, an addition amount of $1\times10^{-7}$ to $1\times10^{-3}$ per mol of a silver halide is preferable.

It is advantageous to use gelatin as a protective colloid for use in the preparation of an emulsion of the present invention or as a binder for other hydrophilic colloid layers. However, another hydrophilic colloid can also be used in place of gelatin.

Examples of the hydrophilic colloid are a gelatin derivative and a graft polymer of gelatin and another polymer; protein such as albumin and casein; cellulose derivatives such as hydroxyethylcellulose, carboxymethylcellulose, and cellulose sulfates; a sugar derivative such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin which is described in Bull. Soc. Sci. Photo. Japan. No. 16, page 30 (1966). In addition, a hydrolyzed product or an enzyme-decomposed product of gelatin can also be used.

It is preferable to wash an emulsion of the present invention for a desalting purpose and form a protective colloid fluid dispersion by using newly prepared protective colloid dispersion. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, although it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is preferable to make salt of metal ion exist during the preparation (e.g., during grain formation, desalting, or chemical sensitization, or before coating) of an emulsion of the present invention in accordance with the intended use. The metal ion salt is preferably added during grain formation when it is doped into grains, or after grain formation and before the completion of chemical sensitization when it is used to modify the grain surface or used as a chemical sensitizer. In addition to a method of doping into an overall grain, it is possible to select a method of doping only into the core, or the shell, of a grain. Examples of the dopant are mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a complex salt can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in water or in an appropriate organic solvent, such as methanol or acetone, and added in the form of a solution. To stabilize the solution, an aqueous halogenated hydrogen solution (e.g., HCl and HBr) or an alkali halide (e.g., KCl, NaCl, Kbr, and NaBr) can be added. It is also possible to add acid or alkali if necessary. The metal compounds can be added to a reactor vessel either before or during grain formation. Alternatively, the metal compounds can be added to an aqueous solution of a water-soluble silver salt (e.g., $AgNO_3$) or an alkali halide (e.g., NaCl, KBr, and KI), and continuously added in the form of a solution during the formation of silver halide grains. Furthermore, a solution of the metal compounds can be prepared independently of a water-soluble salt or an alkali halide and continuously added at a proper timing during grain formation. It is also possible to combine several different addition methods.

It is sometimes useful to perform a method of adding a chalcogen compound during the preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains of the present invention, at least one of sulfur sensitization, selenium sensitization, gold sensitization, palladium sensitization or noble metal sensitization, and reduction sensitization can be performed in any step during the process of manufacturing a silver halide photographic emulsion. The use of two or more different sensitizing methods is preferable.

Several different types of emulsions can be prepared in accordance with the step in which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization speck in the vicinity of the surface.

One chemical sensitization which can be preferably performed in the present invention is one or a combination of chalcogen sensitization and noble metal sensitization. This sensitization can be performed by using an active gelatin as described in T. H. James, The Theory of the Photographic Process, 4th ed., Macmillan, 1977, pp. 67–76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In noble metal sensitization, salts of noble metals, such as gold, platinum, palladium, and iridium, can be used. In particular, gold sensitization, palladium sensitization, or a combination of the two is preferable. In gold sensitization, it is possible to use known compounds, such as chloroauric acid, potassium chloroaurate, potassium auric thiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, a palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that a gold compound and a palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pp. 138–143.

It is preferable to also perform gold sensitization for emulsions of the present invention. The amount of a gold sensitizer is preferably $1\times10^{-4}$ to $1\times10^{-7}$ mol, and more preferably, $1\times10^{-5}$ to $5\times10^{-7}$ mol. A preferable amount of a palladium compound is $1\times10^{-3}$ to $5\times10^{-7}$. A preferable amount of a thiocyan compound or a selenocyan compound is $5\times10^{-2}$ to $1\times10^{-6}$.

The amount of a sulfur sensitizer used in the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitization method for an emulsion of the present invention. Selenium compounds disclosed in conventional known patents can be used as selenium sensitizers for use in the present invention. Labile selenium compounds and/or non-labile selenium compounds are normally used by adding them to an emulsion and stirring the emulsion at a high temperature (preferably 40° C. or more) for a predetermined time. Preferable examples of labile selenium compounds are described in JP-B-44-15748, JP-B-43-13489, JP-A-4-25832, and JP-A-4-109240.

Practical examples of labile selenium sensitizers are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferable examples of labile selenium compounds are described above, the present invention is not limited to these examples. It is generally agreed by those skilled in the art that the structure of a labile selenium compound used as a sensitizer for a photographic emulsion is not so important as long as selenium is labile, and that the organic part of a molecule of the selenium sensitizer has no important role except the role of carrying selenium and keeping it in a labile state in an emulsion. In the present invention, therefore, labile selenium compounds in this extensive concept are advantageously used.

Examples of non-labile selenium compounds used in the present invention are those described in JP-B-46-4553, JP-B-52-34492, and JP-B-52-34491. Specific examples of non-labile selenium compounds are selenious acid, potassium selenocyanide, selenazoles, quaternary salts of selenazoles, diarylselenide, diaryldiselenide, dialkylselenide, dialkyldiselenide, 2-selenazolidinedione, 2-selenoxazolidinethione, and derivatives of these compounds.

These selenium sensitizers are dissolved in water or in one or a mixture of organic solvents such as methanol and ethanol and added during chemical sensitization, preferably before the start of chemical sensitization. It is possible to use not only one type of a selenium sensitizer but two or more types of selenium sensitizers described above. A combination of a labile selenium compound and a non-labile selenium compound is preferable.

The addition amount of a selenium sensitizer used in the present invention changes in accordance with the activity of the selenium sensitizer used, the type and size of a silver halide, and the temperature and time of ripening. The addition amount is preferably $1\times10^{-8}$ mol or more, and more preferably, $1\times10^{-7}$ to $5\times10^{-5}$ mol per mol of a silver halide. When a selenium sensitizer is used, the temperature of chemical ripening is preferably 40° C. to 80° C., and the pAg and the pH can take arbitrary values. For example, the effects of the present invention can be obtained over a broad pH range of 4 to 9.

Selenium sensitization is preferably combined with one or both of sulfur sensitization and noble metal sensitization. Also, in the present invention, thiocyanate is preferably added to a silver halide emulsion during chemical sensitization. Examples of the thiocyanate are potassium thiocyanate, sodium thiocyanate, and ammonium thiocyanate. This thiocyanate is usually dissolved in an aqueous solution or a water-soluble solvent before being added. The addition amount is preferably $1\times10^{-5}$ to $1\times10^{-2}$ mol, and more preferably, $5\times10^{-5}$ to $5\times10^{-3}$ mol per mol of a silver halide.

A silver halide emulsion of the present invention preferably contains a proper amount of calcium ions and/or magnesium ions. This improves the graininess and hence the image quality, and the storage stability also improves. The proper amount is preferably 400 to 2,500 ppm for calcium and/or 50 to 2,500 ppm for magnesium, and more preferably, 500 to 2,000 ppm for calcium and 200 to 2,000 ppm for magnesium. When the amount of calcium is 400 to 2,500 ppm and/or the amount of magnesium is 50 to 2,500 ppm, the concentration of at least one of calcium and magnesium is within the prescribed range. If the calcium or magnesium content is higher than these values, calcium salt, magnesium salt, or an inorganic salt previously held by gelatin or the like precipitates to cause a trouble during the manufacture of a sensitized material. The content of calcium or magnesium is represented by the weight of calcium atoms or magnesium atoms for all compounds containing calcium or magnesium, e.g., calcium ions, magnesium ions, calcium salt, and magnesium salt, and is represented by the concentration per unit weight of an emulsion.

The calcium content of a silver halide tabular emulsion of the present invention is preferably adjusted by adding calcium salt during chemical sensitization. Gelatin generally used in the manufacture of an emulsion already contains 100 to 4,000 ppm of calcium in the case of solid gelatin. Therefore, the calcium content can be adjusted by adding calcium salt to this calcium already contained. The calcium content can also be adjusted by calcium salt after gelatin is desalted (decalcified), where necessary, by a known method such as washing or ion exchange. As calcium salt, calcium nitrate and calcium chloride are preferred, and calcium nitrate is most preferred. Similarly, the magnesium content can be adjusted by adding magnesium salt during the manufacture of an emulsion. As this magnesium salt, magnesium nitrate, magnesium sulfate, and magnesium chloride are preferred, and magnesium nitrate is most preferred. Calcium or magnesium can be determined by ICP emission spectrochemical analysis. Calcium and magnesium can be used singly or in the form of a mixture. The addition of calcium is more preferable. Although calcium or magnesium can be added at any arbitrary point during the manufacture of a silver halide emulsion, it is added preferably after grain formation and immediately after the completion of spectral sensitization and chemical sensitization, and more preferably, after the addition of sensitizing dyes and before chemical sensitization.

A mercaptotetrazole compound having a water-soluble group described in JP-A-16838 is particularly useful to reduce fog of a silver halide emulsion and suppress an increase in fog during storage. This JP-A-16838 has disclosed that the storage stability improves when a combination of a mercaptotetrazole compound and a mercaptothiadiazole compound is used. The present inventors attempted to apply the techniques disclosed in JP-A-16838 and various compounds known as water-soluble mercapto compounds to emulsions prepared by performing selenium sensitization for tabular silver halide emulsions having a positive hole capturing zone according to the present invention. However, in most cases the sensitivity lowered. The present inventors made extensive studies and have found that the storage stability can improve without lowering the sensitivity by a specific combination, i.e., a combination of a water-soluble mercaptotetrazole compound represented by formula (I-1) and a water-soluble mercaptotriazole compound represented by formula (I-2).

First, a water-soluble mercaptotetrazole compound represented by formula (I-1) will be described below.

In formula (I-1), $R_5$ represents an organic moiety substituted by at least one type of a member selected from the group consisting of —$SO_3M$, —COOM, —OH, and —$NHR_2$. More specifically, $R_5$ represents a 1- to 10-carbon alkyl group (e.g., methyl, ethyl, propyl, hexyl, and cyclohexyl) or a 6- to 14-carbon aryl group (e.g., phenyl and naphthyl).

Each group represented by $R_5$ of formula (I-1) can be further substituted. Examples of the substituent are a halogen atom (fluorine, chlorine, bromine, and iodine), cyano, nitro, ammonio (e.g., trimethylammonio), phosphonio, sulfo (including salt), sulfino (including salt), carboxy (including salt), phosphono (including salt), hydroxy, mercapto, hydrazino, alkyl (e.g., methyl, ethyl, n-propyl, isopropyl, t-butyl, n-octyl, cyclopentyl, and cyclohexyl), alkenyl (e.g., allyl, 2-butenyl, and 3-pentenyl), alkynyl (e.g., propargyl and 3-pentinyl), aralkyl (e.g., benzyl and phenethyl), aryl (e.g., phenyl, naphthyl, and 4-methylphenyl), a heterocyclic ring (e.g., pyridyl, furyl, imidazolyl, piperidyl, and morpholino), alkoxy (e.g., methoxy, ethoxy, and butyloxy), aryloxy (e.g., phenoxy and 2-naphthyloxy), alkylthio (e.g., methylthio and ethylthio), arylthio (e.g., phenylthio), amino (e.g., nonsubstituted amino, methylamino, dimethylamino, ethylamino, and anilino), acyl (e.g., acetyl, benzoyl, formyl, and pivaloyl), alkoxycarbonyl (e.g., methoxycarbonyl and ethoxycarbonyl), aryloxycarbonyl (e.g., phenoxycarbonyl), carbamoyl (e.g., nonsubstituted carbamoyl, N,N-dimethylcarbamoyl, N-ethylcarbamoyl, and N-phenylcarbamoyl), acyloxy (e.g., acetoxy and benzoyloxy), acylamino (e.g., acetylamino and benzoylamino), alkoxycarbonylamino (e.g., methoxycarbonylamino), aryloxycarbonylamino (e.g., phenoxycarbonylamino), ureido (e.g., nonsubstituted ureido, N-methylureido, and N-phenylureido), alkylsulfonylamino (e.g., methylsulfonylamino), arylsulfonylamino (e.g., phenylsulfonylamino), alkylsulfonyloxy (e.g., methylsulfonyloxy), arylsulfonyloxy (e.g., phenylsulfonyloxy), alkylsulfonyl (e.g., mesyl), arylsulfonyl (e.g., tosyl), alkoxysulfonyl (e.g., methoxysulfonyl), aryloxysulfonyl (e.g., phenoxysulfonyl), sulfamoyl (e.g., nonsubstituted sulfamoyl, N-methylsulfamoyl, N,N-dimethylsulfamoyl, and N-phenylsulfamoyl), alkylsulfinyl (e.g., methylsulfinyl), arylsulfinyl (e.g., phenylsulfinyl), alkoxysulfinyl (e.g., methoxysulfinyl), aryloxysulfinyl (e.g., phenoxysulfinyl), and amide phosphate (e.g., N,N-diethyl amide phosphate). These groups can be further substituted. If two or more substituents are present, they can be the same or different.

If two or more substituents —$SO_3M$, —COOM, —OH, and —$NHR_2$ of $R_5$ exist, they can be the same or different.

In formula (I-1), $R_2$ represents a hydrogen atom, a 1- to 6-carbon alkyl group, —$COR_3$, —$CO_2R_3$, or —$SO_2R_3$, and $R_3$ represents a hydrogen atom, a 1- to 20-carbon alkyl group (e.g., methyl, ethyl, propyl, hexyl, cyclohexyl, dodecyl, or octadecyl), or aryl (e.g., phenyl or naphthyl). These groups can be substituted by the substituents enumerated as substituents of $R_5$.

In formula (I-1), M represents a hydrogen atom, an alkali metal atom (e.g., lithium, sodium, or potassium), quaternary ammonium (e.g., ammonio, tetramethylammonio, benzyltrimethylammonio, or tetrabutylammonio), or quaternary phosphonium (e.g., tetramethylphosphonio).

In formula (I-1), $R_5$ is preferably phenyl substituted by —$SO_3M$, phenyl substituted by —COOM, phenyl substituted by —$NHR_2$, 1- to 4-carbon alkyl substituted by —$SO_3M$, or 1- to 4-carbon alkyl substituted by —COOM, $R_2$ is preferably a hydrogen atom, I- to 4-carbon alkyl, or —$COR_3$, $R_3$ is preferably a hydrogen atom or a 1- to 4-carbon alkyl group substituted by a hydrophilic group (e.g., carboxyl, sulfo, or hydroxy), and M is preferably a hydrogen atom or a sodium atom. More preferably, $R_5$ is phenyl substituted by —$SO_3M$ or phenyl substituted by —COOM. Practical examples of a compound represented by formula (I-1) will be presented below, but the present invention is not limited to these examples.

I-1-1

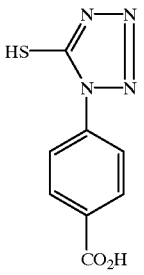

-continued

I-1-2

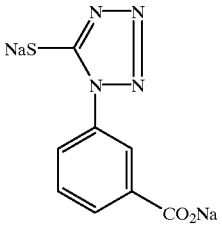

I-1-3

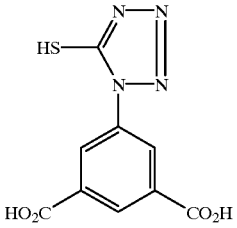

I-1-4

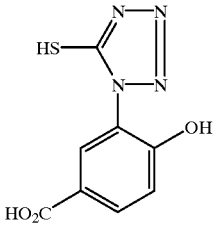

I-1-5

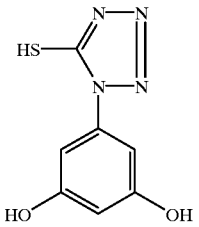

I-1-6

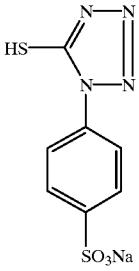

I-1-7

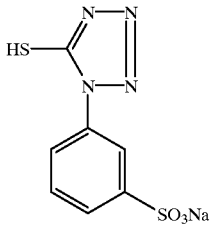

-continued

I-1-8

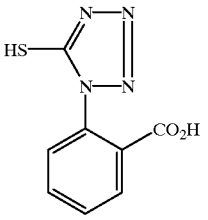

I-1-9

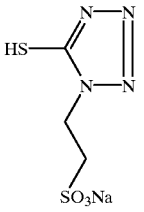

I-1-10

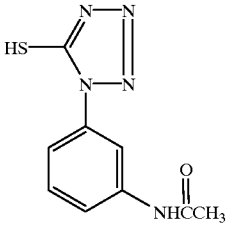

I-1-11

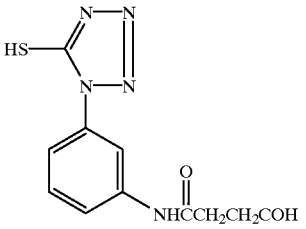

Next, a mercaptotriazole compound represented by formula (I-2) will be described below.

M and $R_5$ in formula (I-2) have the same meanings as M and $R_5$, respectively, in formula (I-1).

In formula (I-2), $R_6$ represents a hydrogen atom, 1- to 10-carbon alkyl (e.g., methyl, ethyl, propyl, hexyl, or cyclohexyl), or 6- to 15-carbon aryl (e.g., phenyl or naphthyl). Alkyl or aryl can be substituted by the substituents enumerated as substituents of $R_5$ in formula (I-1).

In formula (I-2), $R_6$ is preferably a hydrogen atom, 1- to 4-carbon alkyl, or phenyl, $R_5$ is preferably phenyl substituted by —$SO_3M$, phenyl substituted by —COOM, phenyl substituted by —$NHR_2$, 1- to 4-carbon alkyl substituted by —$SO_3M$, or 1- to 4-carbon alkyl substituted by —COOM, $R_2$ is preferably a hydrogen atom, 1- to 4-carbon alkyl, or —$COR_3$, $R_3$ is preferably a hydrogen atom or 1- to 4-carbon alkyl substituted by a hydrophilic group (e.g., carboxyl, sulfo, or hydroxy), and M is preferably a hydrogen atom or a sodium atom. More preferably, $R_6$ is a hydrogen atom, and $R_5$ is phenyl substituted by —$SO_3M$ or phenyl substituted by —COOM.

Practical examples of a compound represented by formula (I-2) will be presented below, but the present invention is not limited to these examples.

I-2-1
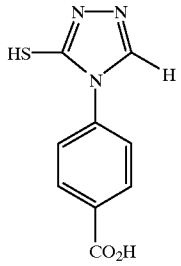
I-2-2
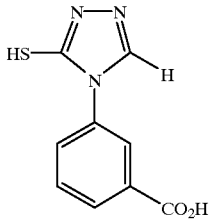
I-2-3
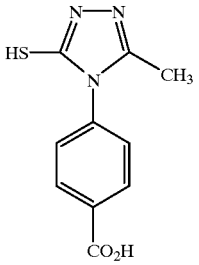
I-2-4
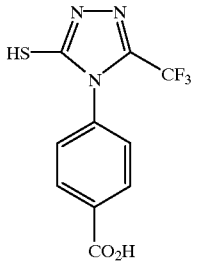
I-2-5
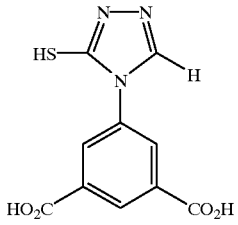
I-2-6
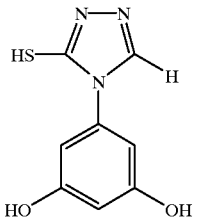
-continued
I-2-7
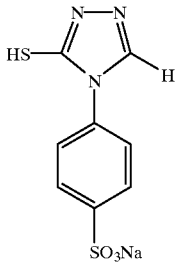
I-2-8
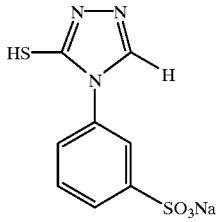
I-2-9
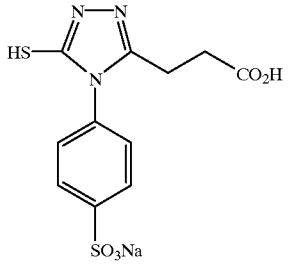
I-2-10
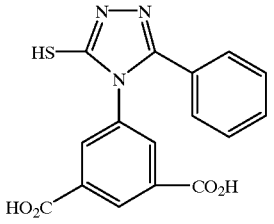
I-2-11
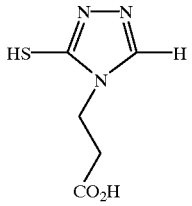
I-2-12
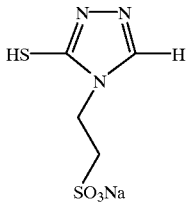

-continued

I-2-13

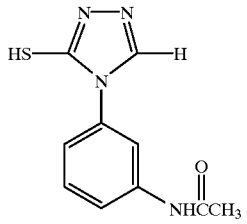

I-2-14

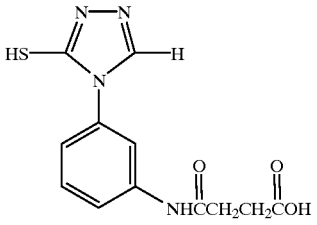

A compound represented by formula (I-1) or (I-2) is known to those skilled in the art and can be synthesized by methods described in the following references: John A. Montogomery ed., "The Chemistry of Heterocyclic Chemistry", 1,2,4-triazole), JOHN WILEY & SONS (1981), pp. 404–442; S. R. Sandler, W. Karo, "Organic Functional Group Preparation") Academic Press (1968), pp. 312–315; Kevin T. Pott ed., "COMPREHENSIVE HETEROCYCLIC COMPOUNDS", PERGAMON PRESS, Vol. 5, pp. 761–784 and 825–834; Robert C. Elderfield ed., "HETEROCYCLIC COMPOUNDS", JOHN WILEY & SONS (1961), pp. 425–445; and Frederic R. Benson ed., "THE HIGH NITROGEN COMPOUNDS", JOHN WILEY & SONS (1984), PP. 640–653.

A compound represented by formula (I-1) or (I-2) is contained in a silver halide emulsion layer or a hydrophilic colloid layer (e.g., an interlayer, a surface protective layer, a yellow filter layer, or an antihalation layer). A compound is preferably contained in a silver halide emulsion layer or its adjacent layer.

A method of adding this compound to an emulsion can be a common addition method for photographic emulsion additives. For example, a compound can be dissolved in methyl alcohol, ethyl alcohol, methyl cellosolve, acetone, water, or a solvent mixture of these solvents, and added as a solution.

A compound represented by formula (I-1) or (I-2) can be added in any one of the photographic emulsion manufacturing steps. A compound can also be added after the manufacture of an emulsion and immediately before coating. As a preferable addition step in the present invention, it is effective to add a compound immediately after the completion of silver halide grain formation and immediately after the completion of chemical ripening.

The addition amount of a compound represented by formula (I-1) or (I-2) is, as a total amount, generally $1\times10^{-6}$ to $1\times10^{-1}$ mol, and preferably, $5\times10^{-6}$ to $5\times10^{-3}$ mol per mol of a selenium-sensitized silver halide. Although the molar ratio when compounds represented by formulas (I-1) and (I-2) are used jointly can take any arbitrary value, this molar ratio is preferably 99.5:0.5 to 50:50. It is particularly preferable to use a small amount of a compound represented by formula (I-2) such that the molar ratio is 99:1 to 70:30.

When compounds represented by formulas (I-1) and (I-2) are used jointly in the present invention, these compounds can be added at the same timing or at different timings. For example, a compound represented by formula (I-2) is added immediately after the completion of silver halide grain formation and immediately before the completion of chemical ripening, while a compound represented by formula (I-1) is added immediately after the completion of chemical ripening. Although this addition order can be reversed, the former order is pre ferred.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles (e.g., benzothiazolium salt); nitroimidazoles; nitrobenzimidazoles; chlorobenzimidazoles; bromobenzimidazoles; mercaptothiazoles; mercaptobenzothiazoles; mecaptobenzimidazoles; mercaptothiadiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during the preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsions can contain, in addition to the sensitizing dyes, dyes having no spectral sensitizing effect or substances not essentially absorbing visible light and presenting supersensitization.

The sensitizing dyes can be added to an emulsion at any point in the preparation of an emulsion, which is conventionally known to be useful. Most ordinarily, the addition is performed after the completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before the completion of formation of a silver halide grain precipitation to start spectral sensitization. Alternatively, as disclosed in U.S. Pat. No. 4,225,666, these compounds can be added separately; a portion of the compounds is added prior to chemical sensitization, while the remaining portion is added after that. That is, the compounds can be added at any timing during the formation of silver halide grains, including the method disclosed in U.S. Pat. No. 4,183,756.

The addition amount can be $4\times10^{-6}$ to $8\times10^{-3}$ mol per mol of a silver halide.

In a photosensitive material manufactured using silver halide emulsions obtained by the present invention, at least one silver halide emulsion layer, i.e., a blue-, green-, or red-sensitive layer need only be formed on a support. The number of these silver halide emulsion layers, the number of non-sensitive layers, and the order of these layers are not particularly restricted. A typical example is a silver halide photosensitive material having, on its support, at least one color-sensitive layer constituted by a plurality of silver halide emulsion layers which are sensitive to essentially the same color but have different sensitivities. This sensitive layer is a unit sensitive layer which is sensitive to one of blue light, green light, and red light. In a multilayered silver halide color photosensitive material, such unit sensitive layers are generally arranged in the order of red-, green-, and blue-sensitive layers from a support. However, according to the intended use, this arrangement order can be reversed, or color-sensitive layers sensitive to the same color can sandwich another sensitive layer sensitive to a different color.

Non-sensitive layers such as interlayers can be formed between the silver halide sensitive layers and as the uppermost layer and the lowermost layer.

These interlayers can contain couplers and DIR compounds, such as described in JP-A-61-43748, JP-A-59-113438, JP-A-59-113440, JP-A-61-20037, and JP-A-61-20038, or can contain color amalgamation inhibitors as commonly used.

As described in West German Patent 1,121,470 or British Patent 923,045, a plurality of silver halide emulsion layers constituting each unit sensitive layer are preferably two layers, i.e., high- and low-speed emulsion layers. These layers are preferably arranged such that the sensitivity is sequentially decreased toward a support. Also, non-sensitive layers can be formed between the silver halide emulsion layers. In addition, as described in JP-A-57-112751, JP-A-62-200350, JP-A-62-206541, and JP-A-62-206543, layers can be arranged such that a low-speed emulsion layer is formed remotely from a support and a high-speed layer is formed close to the support.

More specifically, layers can be arranged from the farthest side from a support in the order of a low-speed blue-sensitive layer (BL)/a high-speed blue-sensitive layer (BH)/a high-speed green-sensitive layer (GH)/a low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

Alternatively, as described in JP-B-55-34932, layers can be arranged from the farthest side from a support in the order of a blue-sensitive layer/GH/RH/GL/RL. Also, as described in JP-A-56-25738 and JP-A-62-63936, layers can be arranged from the farthest side from a support in the order of a blue-sensitive layer/GL/RL/GH/RH.

Furthermore, as described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. When a layer structure is constituted by three layers having different sensitivities, these layers can be arranged in the order of a medium-speed emulsion layer/a high-speed emulsion layer/a low-speed emulsion layer from the farthest side from a support in a layer sensitive to one color as described in JP-A-59-202464.

Additionally, layers can be arranged in the order of a high-speed emulsion layer/a low-speed emulsion layer/a medium-speed emulsion layer or low-speed emulsion layer/a medium-speed emulsion layer/a high-speed emulsion layer.

Layers in which emulsions of the present invention are used are preferably high- and medium-speed emulsion layers, and more preferably, high-speed emulsion layers. The silver amount (the weight in units of silver atoms) of an emulsion used in each emulsion layer is preferably 0.3 to 3 $g/m^2$, and more preferably, 0.5 to 2 $g/m^2$.

Furthermore, the arrangement can be changed as described above even when four or more layers are formed.

As described above, diverse layer constitutions and arrangements can be selected in accordance with the purpose of each sensitized material.

Although the several different additives described above can be used in the silver halide emulsions according to the present invention, a variety of other additives can also be used in accordance with the intended use.

The details of these additives are described in Research Disclosures Item 17643 (December, 1978), Item 18716 (November, 1979), and Item 308119 (December, 1989), and these portions are summarized in a table below.

| | Additives | RD17643 | RD18716 |
|---|---|---|---|
| 1. | Chemical sensitizers | page 23 | page 648, right column |

-continued

| | Additives | RD17643 | RD18716 |
|---|---|---|---|
| 2. | Sensitivity increasing agents | | do |
| 3 | Spectral sensitizers, super sensitizers | pages 23–24 | page 648, right column to page 649, right column |
| 4. | Brighteners | page 24 | page 647, right column |
| 5. | Antifoggants and stabilizers | pages 24–25 | page 649, right column |
| 6. | Light absorbents, filter dyes, ultraviolet absorbents | pages 25–26 | page 649, right column to page 650, left column |
| 7. | Stain preventing agents | page 25, right column | page 650, left to right columns |
| 8. | Dye image stabilizers | page 25 | |
| 9. | Hardening agents | page 26 | page 651, left column |
| 10. | Binders | page 26 | do |
| 11. | Plasticizers, lubricants | page 27 | page 650, right column |
| 12. | Coating aids, surface active agents | pages 26–27 | do |
| 13. | Antistatic agents | page 27 | do |
| 14. | Matting agents | | |

| | Additives | RD308119 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbents, filter dyes, ultraviolet absorbents | page 1,000, left column to page 1,003, right column |
| 7. | Stain preventing agents | page 1,002, right column |
| 8. | Dye image stabilizers | page 1,002, right column |
| 9. | Hardening agents | page 1,004, right column to page 1,005, left column |
| 10. | Binders | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |
| 14. | Matting agents | page 1,008, left column to page 1,009, left column |

In order to prevent deterioration in photographic properties caused by formaldehyde gas, a compound described in U.S. Pat. Nos. 4,411,987 or 4,435,503, which can react with and fix formaldehyde, is preferably added to a sensitized material.

Various color couplers can be used in the present invention, and specific examples of these couplers are described in patents described in abovementioned Research Disclosure No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP249,473A.

Examples of a magenta coupler are preferably 5-pyrazolone and pyrazoloazole compounds, and more preferably, compounds described in, e.g., U.S. Pat. Nos. 4,310,619 and 4,351,897, EP73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO88/04795.

Examples of a cyan coupler are phenol and naphthol couplers, preferably those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, EP121,365A, EP249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,211, 4,367,282, 4,409,320, and 4,576,910, British Patent 2,102,137, and EP341,188A.

Preferable examples of a coupler capable of forming colored dyes having proper diffusibility are those described in U.S. Pat. No. 4,366,237, British Patent 2,125,570, EP96,570, and West German Patent (Publication) No. 3,234,533.

Preferable examples of a colored coupler for correcting additional, undesirable absorption of a colored dye are those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 can be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator are described in British Patents 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with the oxidation product of a developing agent.

Examples of other couplers which can be used in a sensitized material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP173,302A and EP313,308A; bleaching accelerator releasing couplers described in, e.g., RD. Nos. 11449 and 24241 and JP-A-61-201247; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

Couplers for use in the present invention can be added to a sensitized material by various known dispersion methods.

Examples of a high-boiling organic solvent to be used in an oil-in-water dispersion method are described in, e.g., U.S. Pat. No. 2,322,027.

Examples of a high-boiling organic solvent having a boiling point of 175° C. or more at atmospheric pressure to be used in the oil-in-water dispersion method are phthalic esters (e.g., dibutylphthalate, dicyclohexylphthalate, di-2-ethylhexylphthalate, decylphthalate, bis(2,4-di-tert-amylphenyl)phthalate, bis(2,4-di-tert-amylphenyl) isophthalate, and bis(1,1-diethylpropyl)phthalate); phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoates (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols or phenols (e.g., isostearylalcohol and 2,4-di-tert-amylphenol); aliphatic carboxylates (e.g., bis(2-ethylhexyl)sebacate, dioctylazelate, glyceroltributylate, isostearyllactate, and trioctylcitrate); an aniline derivative (e.g., N,N-dibutyl-2-butoxy-5-tert-octylaniline); and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

The steps and effects of a latex dispersion method and examples of an impregnating latex are described in, e.g., U.S. Pat. No. 4,199,363 and West German Patent Application (OLS) Nos. 2,541,274 and 2,541,230.

Phenethyl alcohol and various types of an antiseptic agent or a mildewproofing agent are preferably added to a color sensitized material of the present invention. Examples of the antiseptic agent and the mildewproofing agent are 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The present invention can be applied to various photosensitive material, in particular, various color photosensitive materials. Examples of the material are a color negative film for a general purpose or a movie, a color reversal film for a slide or television, color paper, a color positive film, and color reversal paper. The present invention is also particularly preferably usable as a color dupe film.

A support which can be suitably used in the present invention is described in, e.g., RD. No. 17643, page 28, RD. No. 18716, from page 647, right column to page 648, left column, and RD. No. 307105, page 897.

In a photosensitive material of the present invention, the sum total of film thicknesses of all hydrophilic colloidal layers on the side having emulsion layers is preferably 28 μm or less, more preferably, 23 μm or less, further preferably, 18 μm or less, and most preferably, 16 μm or less. A film swell speed $T_{1/2}$ is preferably 30 sec or less, and more preferably, 20 sec or less. The film thickness means a film thickness measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124–129. When 90% of a maximum swell film thickness reached by performing processing by using a color developing agent at 30° C. for 3 min and 15 sec is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In a photosensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

A color photosensitive material according to the present invention can be developed by conventional methods described in RD. No. 17643, pp. 28–29, RD. No. 18716, p. 615, the left to right column, and RD No. 307105, pp. 880–881.

A color developer used in the development of a photosensitive material of the present invention is preferably an aqueous alkaline solution mainly consisting of an aromatic primary amine-based color developing agent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylani line, 3-methyl-4-amino-N-ethyl-N-β-methoxyethylaniline, and sulfates, hydrochlorides, and p-toluenesulfonates thereof. Of these compounds, 3-methyl-4-amino-N-ethyl-N-β-hydroxyethylaniline sulfate is most preferred. Two or more types of these compounds can be used jointly in accordance with the application.

In general, the color developer contains a pH buffering agent such as a carbonate, a borate, or a phosphate of an alkali metal, and a development restrainer or an antifoggant such as a bromide, an iodide, benzimidazoles, benzothiazoles, or a mercapto compound. If necessary, the color developer can also contain a preservative such as hydroxylamine, diethylhydroxylamine, a sulfite, hydrazines such as N,N-biscarboxymethylhydrazine, phenylsemicarbazides, triethanolamine, or catechol sulfonic acids; an organic solvent such as ethyleneglycol or diethyleneglycol; a development accelerator such as benzylalcohol, polyethyleneglycol, a quaternary ammonium salt, or amines; a dye forming coupler, a competing coupler, and an auxiliary developing agent such as 1-phenyl-3-pyrazolidone; a viscosity imparting agent; and various chelating agents represented by aminopolycarboxylic acid, aminopolyphosphonic acid, alkylphosphonic acid, and phosphonocarboxylic acid. Representative examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts of these acids.

In order to perform reversal development, black-and-white development is performed and then color development is performed. As a black-and-white developer, well-known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in a combination of two or more thereof. The pH of the color and black-and-white developers is generally 9 to 12. Although the replenishment rate of these developers depends on a color photosensitive material to be processed, it is generally 3 liters (liters will be also referred to as "L" hereinafter) or less per $m^2$ of a sensitized material. The replenishment rate can be decreased to 500 milliliters (milliliters will be also referred to as "mL" hereinafter) or less by decreasing a bromide ion concentration in the replenisher. In order to decrease the replenishment rate, the contact area of a processing solution with air is preferably decreased to prevent evaporation and air oxidation of the solution.

The contact area of a photographic processing solution with air in a processing tank can be represented by an aperture ratio defined below:

$$\text{Aperture ratio}=[\text{contact area } (cm^2) \text{ of processing solution to air}]\div[\text{volume } (cm^3) \text{ of processing solution}]$$

The above aperture ratio is preferably 0.1 or less, and more preferably, 0.001 to 0.05. In order to reduce the aperture ratio, a shielding member such as a floating cover can be placed on the liquid surface of the photographic processing solution in the processing tank. In addition, a method of using a movable cover described in JP-A-1-82033 or a slit developing method descried in JP-A-63-216050 can be used. The aperture ratio is preferably reduced not only in color and black-and-white development steps but also in all subsequent steps, e.g., bleaching, bleach-fixing, fixing, washing, and stabilizing steps. In addition, the replenishment rate can be reduced by using a means of suppressing storage of bromide ions in the developing solution.

The color development time is normally two to five minutes. The processing time, however, can be shortened by setting a high temperature and a high pH and using the color developing agent at a high concentration.

A photographic emulsion layer is generally subjected to bleaching after color development. Bleaching can be performed either simultaneously with fixing (bleach-fixing) or independently thereof. In addition, in order to increase the processing speed, bleach-fixing can be performed after bleaching. Also, the processing can be performed in a bleach-fixing bath having two continuous tanks, fixing can be performed before bleach-fixing, or bleaching can be performed after bleach-fixing, in accordance with the application. Examples of the bleaching agent are a compound of a multivalent metal such as iron(III), peroxides (in particular, soda persulfate is suited to color negative motion picture films), quinones, and a nitro compound. Typical examples of the bleaching agent are organic complex salts of iron(III), e.g., complex salts of aminopolycarboxylic acids such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, and complex salts of citric acid, tartaric acid, and malic acid. Of these compounds, iron(III) complex salts of aminopolycarboxylic acid such as iron(III) complex salts of ethylenediaminetetraacetic acid and 1,3-diaminopropanetetraacetic acid are preferred because they can increase the processing speed and prevent environmental contamination. The iron(III) complex salt of aminopolycarboxylic acid is particularly useful in both the bleaching and bleach-fixing solutions. The pH of the bleaching or bleach-fixing solution using the iron(III) complex salt of aminopolycarboxylic acid is normally 4.0 to 8. In order to increase the processing speed, however, the processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-18426, and Research Disclosure No. 17129 (July, 1978); a thiazolidine derivative described in JP-A-51-140129; thiourea derivatives described in JP-B-45-8506, JP-A-52-20832, JP-A-53-32735, and U.S. Pat. No. 3,706,561, and iodide salts described in West German Patent 1,127,715 and JP-A-58-16235; polyoxyethylene compounds descried in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. Compounds described in U.S. Pat. No. 4,552,884 are also preferable. These bleaching accelerators can be added to a sensitized material. These bleaching accelerators are useful especially in bleach-fixing of a photographic color sensitized material.

The bleaching solution or the bleach-fixing solution preferably contains, in addition to the above compounds, an organic acid in order to prevent bleaching stains. The most preferable organic acid is a compound having an acid dissociation constant (pKa) of 2 to 5, e.g., acetic acid, propionic acid, or hydroxy acetic acid.

Examples of the fixing agent and the bleach-fixing agent are thiosulfate, thiocyanate, a thioether-based compound, thioureas, and a large amount of iodide salt. Of these compounds, the use of thiosulfate is common, and especially ammonium thiosulfate can be used in the widest range of applications. In addition, a combination of thiosulfate and, e.g., thiocyanate, a thioether-based compound, or thiourea is preferably used. As a preservative of the fixing solution or the bleach-fixing solution, sulfite, bisulfite, a carbonyl bisulfite adduct, or a sulfinic acid compound described in EP294,769A is preferred. Furthermore, in order to stabilize the fixing solution or the bleach-fixing solution, various types of aminopolycarboxylic acids or organic phosphonic acids are preferably added to the solution.

In the present invention, 0.1 to 10 mol/L of a compound having a pKa of 6.0 to 9.0 are preferably added to the fixing solution or the bleach-fixing solution in order to adjust the pH. It is preferable to add 0.1 to 10 mols/L of imidazoles such as imidazole, 1-methylimidazole, 1-ethylimidazole, and 2-methylimidazole.

The total time of a desilvering step is preferably as short as possible provided that no desilvering defect occurs. The time is preferably one to three minutes, and more preferably, one to two minutes. A processing temperature is 25° C. to 50° C., preferably 35° C. to 45° C. Within the preferable temperature range, the desilvering speed is increased, and the generation of stains after the processing can be effectively prevented.

In the desilvering step, stirring is preferably as strong as possible. Examples of a method of strengthening the stirring are a method of colliding a jet stream of the processing solution against the emulsion surface of a sensitized material described in JP-A-62-183460, and a method of increasing the stirring effect using rotating means described in JP-A-62-183461. Other examples are a method of moving a sensitized material while the emulsion surface is brought into contact with a wiper blade placed in a solution to cause disturbance on the emulsion surface, thereby improving the stirring effect, and a method of increasing the circulating flow amount in an overall processing solution. Such a stirring improving means is effective in any of the bleaching solution, the bleach-fixing solution, and the fixing solution. Improving the stirring presumably accelerates the supply of the bleaching agent and the fixing agent into an emulsion film to thereby increase the desilvering rate. The above stirring improving means is more effective when the bleaching accelerator is used, i.e., this means can significantly increase the accelerating speed or eliminate fixing interference caused by the bleaching accelerator.

An automatic processor for processing a sensitized material of the present invention preferably has a sensitized material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially the processing time of each processing step and reduces the replenishment rate of a processing solution.

A silver halide photosensitive material of the present invention is normally subjected to a washing step and/or a stabilizing step after desilvering. The amount of water used in the washing step can be arbitrarily determined over a broad range in accordance with the properties (e.g., a property determined by a material used such as a coupler) of the sensitized material, the application of the material, the temperature of the water, the number of water tanks (the number of stages), a replenishing method such as a counter or forward current, and other diverse conditions. The relationship between the amount of water and the number of water tanks in a multi-stage counter-current method can be obtained by a method described in "Journal of the Society of Motion Picture and Television Engineering", Vol. 64, pp. 248–253 (May, 1955).

According to the above-described multi-stage counter-current method, the amount of water used for washing can be greatly decreased. Since washing water stays in the tanks for a long period of time, however, bacteria multiply and floating substances stick to a sensitized material. In order to solve this problem in the processing of a color sensitized material of the present invention, a method of decreasing calcium and magnesium ions described in JP-A-62-288838 can be very effectively used. It is also possible to use an isothiazolone compound, cyabendazoles, and a chlorine-based germicide such as chlorinated sodium isocyanurate described in JP-A-57-8542, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing a sensitized material of the present invention is 4 to 9, preferably 5 to 8. The water temperature and the washing time can vary in accordance with the properties and applications of a sensitized material. Normally, the washing time is 20 sec to 10 min at a temperature of 15° C. to 45° C., preferably 30 sec to 5 min at 25° C. to 40° C. A sensitized material of the present invention can be processed directly by a stabilizing agent in place of washing. All known methods described in JP-A-57-8543, JP-A-58-14834, and JP-A-60-220345 can be used in such a stabilizing process.

Stabilizing is sometimes performed subsequently to washing. An example is a stabilizing bath containing a dye stabilizing agent and a surface-active agent to be used as a final bath of a color sensitized material for photography. Examples of the dye stabilizing agent are aldehydes such as formalin and glutaraldehyde, an N-methylol compound, hexamethylenetetramine, and an aldehyde sulfurous acid adduct. Various chelating agents or antifungal agents can be added to the stabilizing bath.

An overflow solution produced upon washing and/or replenishment of the stabilizing solution can be reused in another step such as a desilvering step.

In processing using an automatic processor or the like, if each processing solution described above is condensed by evaporation, water is preferably added to correct the condensation.

A silver halide color photosensitive material of the present invention can contain a color developing agent in order to simplify the processing and increase the processing speed. For this purpose, various types of precursors of the color developing agent can be preferably used. Examples of the precursor are indoaniline-based compounds described in U.S. Pat. No. 3,342,597, e.g., Schiff base compounds described in U.S. Pat. No. 3,342,599 and Research Disclosure (RD) Nos. 14,850 and 15,159, aldol compounds described in RD No. 13,924, metal salt complexes described in U.S. Pat. No. 3,719,492, and urethane-based compounds described in JP-A-53-135628.

A silver halide color photosensitive material of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing can be accelerated at higher temperatures to shorten the processing time, or the image quality or the stability of a processing solution can be improved at lower temperatures.

A silver halide photosensitive material of the present invention can be applied to thermal development photosensitive materials described in, e.g., U.S. Pat. No. 4,500,626, JP-A-60-133449, JP-A-59-218443, JP-A-61-238056, and EP210,660A2.

When a silver halide color photosensitive material of the present invention is applied to a film unit with lens, such as described in JP-B-2-32615 or Jpn. UM Appln. KOKOKU Publication No. 3-39784, the effects of the present invention can be achieved more easily.

The present invention will be described in detail below by way of its examples. However, the present invention is not limited to these examples.

EXAMPLE 1

The silver iodide content and the silver iodide distribution structure which are the characteristic features of high-aspect-ratio, large-size tabular grains used in the present invention will be described below.

(Preparation of seed emulsion a)

1,164 mL of an aqueous solution containing 0.017 g of KBr and 0.4 g of oxidized gelatin with an average molecular weight of 20,000 were held at 35° C. and stirred. An aqueous solution of $AgNO_3$ (1.6 g), an aqueous KBr solution, and an aqueous solution of oxidized gelatin (2.1 g) with an average molecular weight of 20,000 were added by the triple-jet method over 48 sec. During the addition, the silver potential was held at 13 mV with respect to a saturated calomel electrode. An aqueous KBr solution was added to set the silver potential to −66 mV, and the temperature was raised to 60° C. After 21 g of succinated gelatin with an average molecular weight of 100,000 were added, an aqueous solution of NaCl (5.1 g) was added. An aqueous solution of $AgNO_3$ (206.3 g) and an aqueous KBr solution were added by the double-jet method over 61 min while the flow rates were accelerated. During the addition, the silver potential was held at −44 mV with respect to the saturated calomel electrode. After the resultant material was desalted, succinated gelatin with an average molecular weight of 100,000 was added, and the pH and the pAg of were adjusted to 5.8 and 8.8, respectively, at 40° C., thereby preparing a seed emulsion. This seed emulsion contained 1 mol of Ag and 80 g of gelatin per kg of the emulsion. The emulsion consisted of tabular grains with an average equivalent-circle diameter of 0.81 μm, an equivalent-circle diameter variation coefficient of 28%, an average thickness of 0.046 μm, and an average aspect ratio of 39.

(Formation of core)

1,200 mL of an aqueous solution containing 134 g of the seed emulsion a, 1.9 g of KBr, and 22 g of succinated gelatin with an average molecular weight of 100,000 were held at 75° C. and stirred. An aqueous solution of $AgNO_3$ (43.9 g), an aqueous KBr solution, and an aqueous solution of gelatin with a molecular weight of 20,000 were mixed in another chamber having a magnetic coupling induction type stirrer described in JP-A-10-43570 immediately before addition, and added over 25 min. During the addition, the silver potential was held at −40 mV with respect to the saturated calomel electrode.

(Formation of first shell)

After the core grains above were formed, an aqueous solution of $AgNO_3$ (43.9 g), an aqueous KBr solution, and an aqueous solution of gelatin with a molecular weight of 20,000 were mixed in the other chamber described above immediately before addition, and added over 20 min. During the addition, the silver potential was held at −40 mV with respect to the saturated calomel electrode.

(Formation of second shell)

After the first shell above was formed, an aqueous solution of $AgNO_3$ (42.6 g), an aqueous KBr solution, and an aqueous solution of gelatin with a molecular weight of 20,000 were mixed in the other chamber described above immediately before addition, and added over 17 min. During the addition, the silver potential was held at −20 mV with respect to the saturated calomel electron. After that, the temperature was lowered to 55° C.

(Formation of third shell)

After the second shell above was formed, the silver potential was adjusted to −55 mV, and aqueous solutions of $AgNO_3$ (7.1 g) and KI (6.9 g) and an aqueous solution of gelatin with a molecular weight of 20,000 were mixed in the other chamber described above immediately before addition, and added over 5 min.

(Formation of fourth shell)

After the third shell above was formed, an aqueous solution of $AgNO_3$ (66.4 g) and an aqueous KBr solution were added by the double-jet method over 30 min at fixed flow rates. In the middle of the addition, potassium iridium hexachloride and yellow prussiate of potash were added. During the addition, the silver potential was held at 30 mV with respect to the saturated calomel electrode. Regular washing was performed, gelatin was added, and the pH and the pAg were adjusted to 5.8 and 8.8, respectively, at 40° C., thereby preparing an emulsion b. This emulsion b consisted of tabular grains with an average equivalent-circle diameter of 4.1 μm, an equivalent-circle diameter variation coefficient of 21%, an average thickness of 0.090 μm, and an average aspect ratio of 46. Also, 70% or more of the total projected area were accounted for by tabular grains having an equivalent-circle diameter of 4.1 μm or more and a thickness of 0.090 μm or less.

Emulsions c, d, e, f, g, h, and i were prepared by changing the silver iodide contents in the first and second shells by using an aqueous KBr solution containing KI, instead of the aqueous KBr solution used in the first and second shells. The characteristic features of the individual emulsions are summarized in Table 1 below.

TABLE 1

| | Silver iodide content (I mol %) and silver amount (Ag%): I mol %/Aq % | | | | | Silver iodide | | |
|---|---|---|---|---|---|---|---|---|
| Emulsion | Core | 1st shell | 2nd shell | 3rd shell | 4th shell | content (mol %) | Structure | Remarks |
| b | 0 | 0 | 0 | 100 | 0 | 3.1 | Triple | Comparative example |
| | 29.4 | 19.4 | 18.8 | 3.1 | 29.3 | | | |
| c | 0 | 0 | 10 | 100 | 0 | 5.0 | Quadruple | Comparative example |
| | 29.4 | 19.4 | 18.8 | 3.1 | 29.3 | | | |
| d | 0 | 20 | 0 | 100 | 0 | 7.0 | Quintuple | Comparative example |
| | 29.4 | 19.4 | 18.8 | 3.1 | 29.3 | | | |
| e | 0 | 2.0 | 10 | 100 | 0 | 8.9 | Quintuple | Comparative example |

TABLE 1-continued

| Emulsion | Silver iodide content (I mol %) and silver amount (Ag%): I mol %/Ag % Core | 1st shell | 2nd shell | 3rd shell | 4th shell | Silver iodide content (mol %) | Structure | Remarks |
|---|---|---|---|---|---|---|---|---|
| | 29.4 | 19.4 | 18.8 | 3.1 | 29.3 | | | |
| f | 0 | 5.0 | 15 | 100 | 0 | 6.9 | Quintuple | Comparative example |
| | 29.4 | 19.4 | 18.8 | 3.1 | 29.3 | | | |
| g | 0 | 3.0 | 3.0 | 100 | 0 | 4.3 | Quadruple | Comparative example |
| | 29.4 | 19.4 | 18.8 | 3.1 | 29.3 | | | |
| h | 0 | 3.0 | 1.5 | 100 | 0 | 4.3 | Quintuple | Present invention |
| | 29.4 | 19.4 | 18.8 | 3.1 | 29.3 | | | |
| i | 0 | 0 | 0 | 100 | 0 | 3.7 | Quintuple | Present invention |
| | 29.4 | 19.4 | 18.8 | 3.1 | 29.3 | | | |

Although the thickness of each of the emulsions c to i slightly changed from that of the emulsion b, in each emulsion 70% or more of the total projected area were accounted for by tabular grains having an equivalent-circle diameter of 4.1 μm or more and a thickness of 0.090 μm or less. Also, each emulsion met the conditions described in U.S. Pat. No. 5,709,988 by which dislocation lines were introduced to the fringe portion of a tabular grain.

The emulsions b to i were heated to 56° C. and optimally, chemically sensitized by adding sensitizing dyes I, II, and III and a compound I presented below, potassium thiocyanate, chloroauric acid, sodium thiosulfate, and N,N-dimethylselenourea. Note that the sensitizing dyes were used in the form of fine solid dispersions formed by a method described in JP-A-11-52507. That is, 0.8 parts by weight of sodium nitrate and 3.2 parts by weight of sodium sulfate were dissolved in 43 parts by weight of ion exchange water. 13 parts by weight of a sensitizing dye were added, and the resultant material was dispersed at 60° C. for 20 min by using a dissolver blade at 2,000 rpm, thereby obtaining a solid dispersion of the sensitizing dye.

Sensitizing dye I

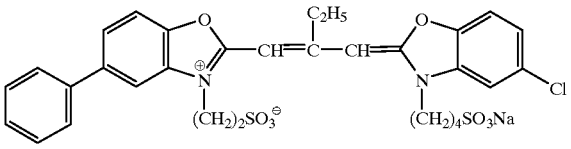

Sensitizing dye II

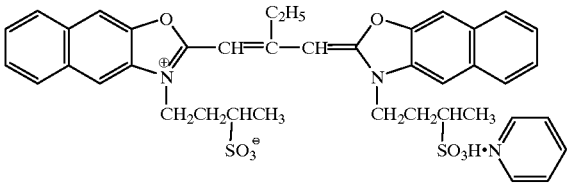

Sensitizing dye III

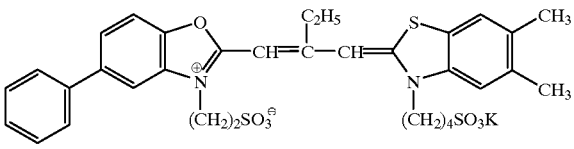

-continued

Compound I

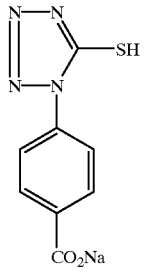

A cellulose triacetate film support having an undercoat layer was coated with the emulsions b to i subjected to the above chemical sensitization under coating conditions shown in Table 2 below, and a protective layer was formed. In this manner sample Nos. 1 to 8 were formed.

TABLE 2

Emulsion coating conditions (1) Emulsion layer

Emulsion — various emulsions (silver $2.1 \times 10^{-2}$ mol/m$^2$) ($1.5 \times 10^{-3}$ mol/m$^2$)

Coupler

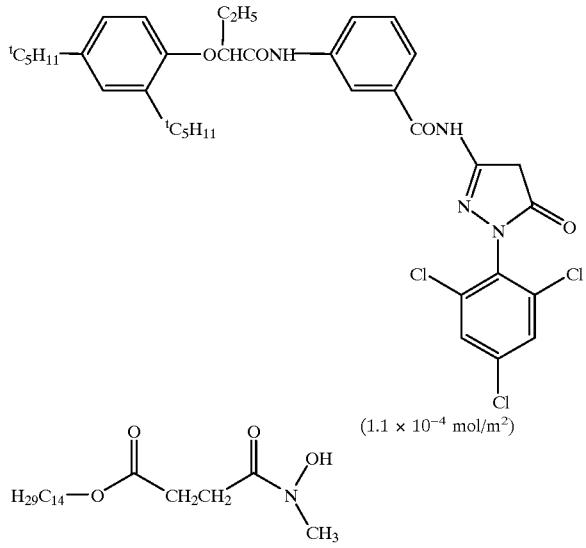

($1.1 \times 10^{-4}$ mol/m$^2$)

TABLE 2-continued

| Emulsion coating conditions | |
|---|---|
| Tricresylphosphate | (1.10 g/m$^2$) |
| Gelatin | (2.30 g/m$^2$) |
| (2) Protective layer | |
| 2,4-dichloro-6-hydroxy-s-triazine sodium slat | (0.08 g/m$^2$) |
| Gelatin | (1.80 g/m$^2$) |

These samples were left to stand at 40° C. and a relative humidity of 70% for 14 hr. The resultant samples were exposed for 1/100 sec through the SC-50 gelatin filter manufactured by Fuji Photo Film Co., Ltd. and a continuous wedge.

By using the FP-350 negative processor manufactured by Fuji Photo Film Co., Ltd., the exposed samples were processed by the following method (until the accumulated replenisher amount of each solution was three times the mother solution tank volume).

(Processing Method)

| Step | Time | Temperature. | Replenishment rate* |
|---|---|---|---|
| Color development | 3 min. 15 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one 24 Ex. film).

The compositions of the processing solutions are presented below.

| | Tank solution (g) | Replenisher (g) |
|---|---|---|
| (Color developer) | | |
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl)-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

-continued

| | Tank solution (g) | Replenisher (g) |
|---|---|---|
| | | common to tank solution and replenisher (g) |
| (Bleaching solution) | | |
| Ferric ammonium ethylenediamine tetraacetate dihydrate | | 120.0 |
| Disodium ethylenediamine tetraacetate | | 10.0 |
| Ammonium bromide | | 100.0 |
| Ammonium nitrate | | 10.0 |
| Bleaching accelerator $(CH_3)_2N\text{-}CH_2\text{-}CH_2\text{-}S\text{-}S\text{-}CH_2\text{-}CH_2\text{-}N(CH_3)_2.2HCl$ | | 0.005 mol |
| Ammonia water (27%) | | 15.0 mL |
| Water to make | | 1.0 L |
| pH (adjusted by ammonia water and sulfuric acid) | | 6.3 |
| (Bleach-fix bath) | | |
| Ferric ammonium ethylene diaminetetraacetate dihydrate | 50.0 | — |
| Disodium ethylenediamine tetraacetate | 5.0 | 2.0 |
| Ammonium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |
| (Washing water) common to tank solution and replenisher | | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium dichloroisocyanurate and 0.15 g/L of sodium sulfate were added. The pH of the solution ranged from 6.5 to 7.5.

| | common to tank solution and replenisher (g) |
|---|---|
| (Stabilizer) | |
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The development dependence was evaluated by changing the processing time of the color developer. The density of each processed sample was measured through a green filter.

Table 3 below shows the sensitivity values at a density of fog plus 0.2, the fog values, and the gamma values (the slopes of characteristic curves at densities of fog plus 0.2 and fog plus 0.7).

TABLE 3

| Sample No. | Emulsion | Remarks | Fog 2'45" | Fog 3'15" | Fog 3'45" | Sensitivity 2'45" | Sensitivity 3'15" | Sensitivity 3'45" | Gamma 2'45" | Gamma 3'15" | Gamma 3'45" |
|---|---|---|---|---|---|---|---|---|---|---|---|
| 1 | b | Comparative example | 0.18 | 0.22 | 0.30 | 61 | 100 | 106 | 0.53 | 0.88 | 0.92 |
| 2 | c | Comparative example | 0.18 | 0.22 | 0.30 | 48 | 88 | 94 | 0.44 | 0.70 | 0.78 |
| 3 | d | Comparative example | 0.16 | 0.20 | 0.26 | 78 | 121 | 130 | 0.48 | 0.84 | 0.90 |
| 4 | e | Comparative example | 0.18 | 0.21 | 0.33 | 40 | 83 | 94 | 0.40 | 0.66 | 0.73 |
| 5 | f | Comparative example | 0.17 | 0.23 | 0.33 | 38 | 80 | 88 | 0.36 | 0.60 | 0.69 |
| 6 | g | Comparative example | 0.17 | 0.22 | 0.29 | 66 | 105 | 113 | 0.50 | 0.79 | 0.84 |
| 7 | h | Present invention | 0.18 | 0.22 | 0.29 | 92 | 134 | 141 | 0.60 | 0.86 | 0.90 |
| 8 | i | Present invention | 0.17 | 0.21 | 0.28 | 101 | 141 | 150 | 0.66 | 0.90 | 0.92 |

As shown in Table 3, the emulsions h and i as quintuple-structure grains of the present invention had higher sensitivity values than those of the triple-structure grain emulsion b and the quadruple-structure emulsions c and g as comparative emulsions at close fog values. Furthermore, the processing time dependence of sensitivity and gamma shows that the progress of development was very fast. Although the quintuple-structure grain emulsion d corresponding to U.S. Pat. No. 5,780,216 had high sensitivity, the processing time dependence of sensitivity and gamma was large, so no such effects as the emulsions h and i of the present invention were obtained. Similarly, no effects of the present invention were obtained by the quintuple-structure grain emulsions e and f not meeting the silver iodide content as a necessary condition of the present invention. From the foregoing, the effects of the present invention can be obtained only when the silver iodide content and the silver iodide distribution structure prescribed in the present invention are met.

EXAMPLE 2

The effects concerning the equivalent-circle diameter, thickness, and equivalent-circle diameter variation coefficient of a tabular grain emulsion according to the present invention will be described below.

Emulsions i, k, l, m, n, o, p, and q were prepared by changing the gelatin, temperatures, flow rates, silver potentials, and silver iodide contents in the preparation of the seed emulsion a and the temperatures, flow rates, silver potentials, the presence/absence of the use of a mixing chamber immediately before addition, and silver iodide contents in the formation of the core and first, second, third, and fourth shells. Table 4 below shows the characteristic features of these emulsions. Each emulsion met the conditions described in U.S. Pat. No. 5,709,988 by which dislocation lines were introduced to the fringe portion of a tabular grain.

TABLE 4

| Emulsion | I mol%/Ag% Core | 1st shell | 2nd shell | 3rd shell | 4th shell | Silver iodide content (mol %) |
|---|---|---|---|---|---|---|
| j | 0 | 3.0 | 3.0 | 100 | 0 | 4.2 |

TABLE 4-continued

| | | | | | | |
|---|---|---|---|---|---|---|
| | 29.4 | 19.4 | 18.8 | 3.1 | 29.3 | |
| k | 0 | 19 | 0 | 100 | 0 | 6.8 |
| | 29.4 | 19.4 | 18.8 | 3.1 | 29.3 | |
| l | 0 | 4.5 | 0 | 100 | 0 | 4.0 |
| | 29.4 | 19.4 | 18.8 | 3.1 | 29.3 | |
| m | 0 | 3.0 | 3.0 | 100 | 0 | 4.2 |
| | 29.4 | 19.4 | 18.8 | 3.1 | 29.3 | |
| n | 0 | 4.5 | 0 | 100 | 0 | 4.0 |
| | 29.4 | 19.4 | 18.8 | 3.1 | 29.3 | |
| o | 0 | 1.5 | 1.5 | 100 | 0 | 3.7 |
| | 29.4 | 19.4 | 18.8 | 3.1 | 29.3 | |
| p | 1 | 2.5 | 0 | 100 | 0 | 3.9 |
| | 29.4 | 19.4 | 18.8 | 3.1 | 29.3 | |
| q | 0 | 2.5 | 0 | 100 | 0 | 3.6 |
| | 29.4 | 19.4 | 18.8 | 3.1 | 29.3 | |

| Emulsion | Structure | Equivalent-circuit diameter (μ) | Variation coefficient (%) of equivalent-circle diameter | Thickness (μ) | Remarks |
|---|---|---|---|---|---|
| j | Quadruple | 3.1 | 24 | 0.26 | Comparative example |
| k | Quintuple | 3.1 | 24 | 0.26 | Comparative example |
| l | Quintuple | 3.1 | 24 | 0.26 | Comparative example |
| m | Quadruple | 3.72 | 18 | 0.19 | Comparative example |
| n | Quintuple | 3.72 | 18 | 0.19 | Present invention |
| o | Quadruple | 4.80 | 27 | 0.090 | Comparative example |
| p | Quintuple | 4.80 | 27 | 0.090 | Present invention |
| q | Quintuple | 4.79 | 23 | 0.091 | Present invention |

Chemical sensitization and coating were performed following the same procedures as in Example 1 to form sample Nos. 101 to 108. The sensitivity and the fog were similarly evaluated by changing the processing time of color development in Example 1 to 3 min and 15 sec. Also, the processing time of color development was changed to 3 min and 15 sec, and the potassium bromide content in the color developer was tripled to reduce the pH by 0.3. The gamma difference between this processing and the original processing was evaluated. The results are shown in Table 5.

TABLE 5

| Sample No. | Emul-sion | Remarks | Fog | Sensitivity | Gamma difference |
|---|---|---|---|---|---|
| 101 | j | Comparative example | 0.23 | 100 | 0.08 |
| 102 | k | Comparative example | 0.20 | 126 | 0.07 |
| 103 | l | Comparative example | 0.21 | 110 | 0.07 |
| 104 | m | Comparative example | 0.25 | 122 | 0.16 |
| 105 | n | Present invention | 0.23 | 160 | 0.10 |
| 106 | o | Comparative example | 0.24 | 139 | 0.23 |
| 107 | p | Present invention | 0.22 | 181 | 0.11 |
| 108 | q | Present invention | 0.21 | 181 | 0.09 |

As is apparent from Table 5, no effect of improving the gamma difference caused by changes in development could be obtained by the tabular grain emulsions j, k, and l not meeting the equivalent-circle diameter and thickness prescribed in the present invention, even though each emulsion had a quintuple structure and had a silver iodide content of 2 to 6 mol %, both of which are necessary conditions of the present invention. In contrast, the comparison of the tabular grain emulsions m and n meeting the equivalent-circle diameter and thickness prescribed in the present invention shows that the quintuple structure as a necessary condition of the present invention significantly improves the gamma difference caused by changes in development. This effect is more conspicuous in the comparison of the emulsions o, p, and q. Also, the effect of an equivalent-circle diameter variation coefficient is clearly shown.

EXAMPLE 3

The effects of sextuple-structure grains of the present invention will be further described below.

A sextuple-structure grain emulsion r was prepared by adding 0.13 mol %, as a silver amount, of fine silver iodide grains before chemical sensitization of the emulsion q in Example 2. When evaluations were performed following the same procedures as in Example 2, the fog, sensitivity, and gamma difference were 0.22, 188, and 0.07, respectively, i.e., good results were obtained.

EXAMPLE 4

The effects of emulsions of the present invention in a multilayered color photosensitive material will be described below.

Silver halide emulsions Em-A to Em-O were prepared by the following methods.

(Manufacturing method of emulsion Em-A)

42.2 L of an aqueous solution containing 31.7 g of low-molecular-weight gelatin with a molecular weight of 15,000, which was phthalated at a phthalation ratio of 97%, and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of low-molecular-weight gelatin with a molecular weight of 15,000 were added over 1 min by the double jet method. 52.8 g of KBr were added immediately after the addition, and 2,485 mL of an aqueous solution containing 398.2 g of $AgNO_3$ and 2,581 mL of an aqueous solution containing 291.1 g of KBr were added over 2 min by the double jet method. 44.8 g of KBr were added immediately after the addition. After that, the temperature was raised to 40° C. to ripen the material. After the ripening, 923 g of gelatin with a molecular weight of 100,000, which was phthalated at a phthalation ratio of 97%, and 79.2 g of KBr were added. Also, 15,947 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the silver potential was held at −60 mV with respect to a saturated calomel electrode. After washing with water, gelatin was added, the pH and the pAg were adjusted to 5.7 and 8.8, respectively, and the silver amount and the gelatin amount were adjusted to 131.8 g and 64.1 g, respectively, per kg of an emulsion, thereby preparing a seed emulsion. 1,211 ml of an aqueous solution containing 46 g of phthalated gelatin with a phthalation ratio of 97% and 1.7 g of KBr were vigorously stirred at 75° C. After 9.9 g of the seed emulsion were added, 0.3 g of modified silicone oil (the L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was held at −20 mV with respect to the saturated calomel electrode. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. Also, the silver potential was held at −50 mV with respect to the saturated calomel electrode. 121.3 mL of an aqueous solution containing 45.6 g of $AgNO_3$ and an aqueous KBr solution were added over 22 min by the double jet method. During the addition, the silver potential was held at +20 mV with respect to the saturated calomel electrode. The temperature was raised to 82° C., KBr was added to adjust the silver potential to −80 mV with respect to the saturated calomel electrode, and the abovementioned AgI fine grain emulsion was added in an amount of 6.33 g as a KI weight. Immediately after the addition, 206.2 mL of an aqueous solution containing 66.4 g of $AgNO_3$ were added over 16 min. For the first 5 min of the addition, the silver potential was held at −80 mV by using an aqueous KBr solution. After washing with water, gelatin was added, and the pH and the pAg were adjusted to 5.8 and 8.7, respectively, at 40° C. Compounds 11 and 12 were added, and the temperature was raised to 60° C. After sensitizing dyes 11 and 12 were added, the emulsion was optimally, chemically sensitized by adding potassium thiocyanate, chloroauric acid, sodium thiosulfate, and N,N-dimethylselenourea. At the end of this chemical sensitization, compounds 13 and 14 were added. "Optimal chemical sensitization" means that the addition amount of each of the sensitizing dyes and the compounds was selected to be $10^{-1}$ to $10^{-8}$ mol per mol of a silver halide.

Compound 11

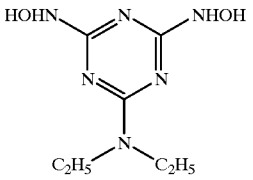

-continued

Compound 12

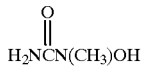

Sensitizing dye 11

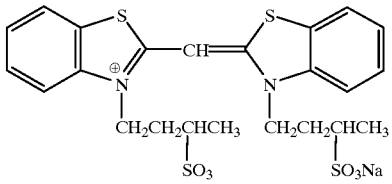

Sensitizing dye 12

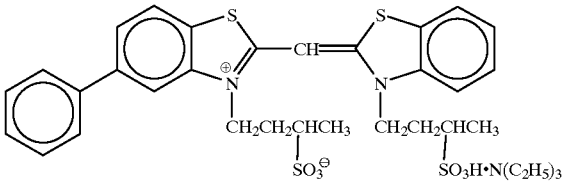

Compound 13

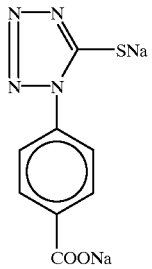

Compound 14

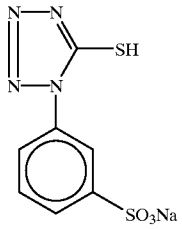

(Manufacturing method of emulsion Em-B)

1,192 mL of an aqueous solution containing 0.96 g of low-molecular-weight gelatin and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of trimellitated gelatin with a molecular weight of 100,000, formed by chemically modifying an amino group thereof with trimellitic acid, were added, and the pH was adjusted to 7.6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the silver potential was held at −20 mV with respect to a saturated calomel electrode. 440.6 mL of an aqueous solution containing 110.2 g of $AgNO_3$ and an aqueous RBr solution were added over 30 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 15.8 mol %. Also, the silver potential was held at 0 mV with respect to the saturated calomel electrode. 96.5 mL of an aqueous solution containing 24.1 g of $AgNO_3$ and an aqueous KBr solution were added over 3 min by the double jet method. During the addition, the silver potential was held at 0 mV. After 26 mg of sodium ethylthiosulfonate were added, the temperature was lowered to 55° C., and an aqueous KBr solution was added to adjust the silver potential to −90 mV. The aforementioned AgI fine grain emulsion was added in an amount of 8.5 g as a KI weight. Immediately after the addition, 228 mL of an aqueous solution containing 57 g of $AgNO_3$ were added over 5 min. During the addition, an aqueous KBr solution was used to adjust the potential at the end of the addition to +20 mV. The resultant emulsion was washed with water and chemically sensitized in substantially the same manner as for Em-A.

(Manufacturing method of Em-C)

1,192 mL of an aqueous solution containing 1.02 g of phthalated gelatin containing 35 μmol of methionine per g and having a molecular weight of 100,000 and a phthalation ratio of 97% and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of trimellitated gelatin with a molecular weight of 100,000, which was used in the preparation of Em-B, and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the silver potential was held at −30 mV with respect to a saturated calomel electrode. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of Em-A was simultaneously added at an accelerated flow rate so that the silver iodide content was 2.3 mol %. Also, the silver potential was held at −20 mV with respect to the saturated calomel electrode. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the silver potential was held at 10 mV. An aqueous KBr solution was added to adjust the silver potential to −70 mV. The aforementioned AgI fine grain emulsion was added in an amount of 6.4 g as a KI weight. Immediately after the addition, 404 mL of an aqueous solution containing 57 g of $AgNO_3$ were added over 45 min. During the addition, an aqueous KBr solution was used to adjust the silver potential at the end of the addition to −30 mV. The resultant emulsion was washed with water and chemically sensitized in substantially the same manner as for Em-A.

(Manufacturing method of Em-D)

In the preparation of Em-C, the $AgNO_3$ addition amount during nucleation was increased by 2.3 times. Also, in the final addition of 404 mL of an aqueous solution containing 57 g of $AgNO_3$, the silver potential at the end of the addition was adjusted to +90 mV by using an aqueous KBr solution.

Em-D was prepared following substantially the same procedures as for Em-C except the foregoing.

(Manufacturing method of emulsion Em-E)

1,200 mL of an aqueous solution containing 0.75 g of low-molecular-weight gelatin with a molecular weight of 15,000, 0.9 g of KBr, and 0.2 g of the modified silicone oil used in the preparation of Em-A were held at 39° C. and stirred with violence at pH 1.8. An aqueous solution containing 0.45 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of phthalated gelatin containing 35 $\mu$mol of methionine per g and having a molecular weight of 100,000 and a phthalation ratio of 97% were added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, the AgI fine grain emulsion used in the preparation of Em-A was simultaneously added such that the silver iodide content was 4.1 mol %. Also, the silver potential was held at −60 mV with respect to a saturated calomel electrode. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, the abovementioned AgI fine grain emulsion was simultaneously added at an accelerated flow rate such that the silver iodide content was 10.5 mol %. Also, the silver potential was held at −70 mV. After 1 mg of thiourea dioxide was added, 132 mL of an aqueous solution containing 41.8 g of $AgNO_3$ and an aqueous KBr solution were added over 25 min by the double jet method. The addition of the aqueous KBr solution was so adjusted that the silver potential at the end of the addition was +20 mV. After 2 mg of sodium benzenethiosulfonate were added, the pH was adjusted to 7.3, and KBr was added to adjust the silver potential to −70 mV. After that, the aforementioned AgI fine grain emulsion was added in an amount of 5.73 g as a KI weight. Immediately after the addition, 609 mL of an aqueous solution containing 66.4 g of $AgNO_3$ were added over 10 min. For the first 6 min of the addition, the silver potential was held at −70 mV by an aqueous KBr solution. After washing with water, gelatin was added, and the pH and the pAg were adjusted to 6.5 and 8.2, respectively, at 40° C. Compounds 1 and 2 were added, and the temperature was raised to 56° C. After 0.0004 mol of the aforementioned AgI fine grain emulsion was added per mol of silver, sensitizing dyes 13 and 14 were added. The emulsion was optimally, chemically sensitized by adding potassium thiocyanate, chloroauric acid, sodium thiosulfate, and N,N-dimethylselenourea. At the end of the chemical sensitization, the compounds 13 and 14 were added.

Sensitizing dye 13

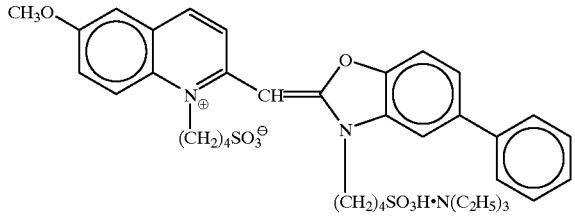

Sensitizing dye 14

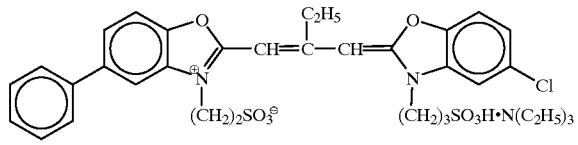

(Manufacturing method of emulsion Em-F)

Em-F was prepared following substantially the same procedures as for Em-E except that the $AgNO_3$ addition amount during the nucleation was increased 4.12 times. Note that the sensitizing dyes in Em-E were changed to sensitizing dyes 12, 15, 16, and 17.

Sensitizing dye 15

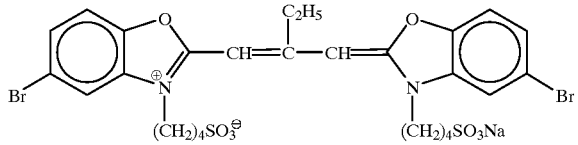

Sensitizing dye 16

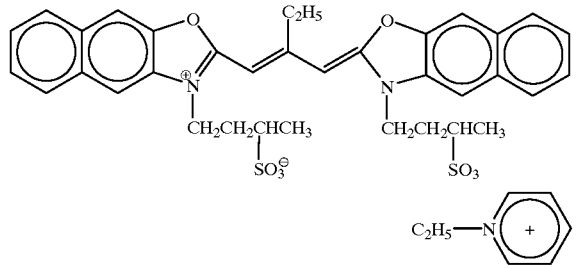

Sensitizing dye 17

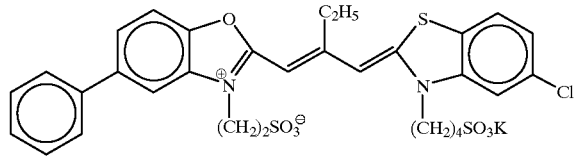

(Manufacturing method of emulsion Em-G)

1,200 mL of an aqueous solution containing 0.70 g of low-molecular-weight gelatin with a molecular weight of 15,000, 0.9 g of KBr, 0.175 g of KI, and 0.2 g of the modified silicone oil used in the preparation of Em-A were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of trimellitated gelatin containing 35 μmol of methionine per g and having a molecular weight of 100,000, which was formed by chemically modifying an amino group thereof with trimellitic acid, were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 μm was simultaneously added such that the silver iodide content was 4.1 mol %. This Agi fine grain emulsion was prepared, immediately before the addition, by mixing an aqueous solution of low-molecular-weight gelatin with a molecular weight of 15,000, an aqueous $AgNO_3$ solution, and an aqueous KI solution in another chamber having a magnetic coupling induction type stirrer described in JP-A-10-43570. Also, the silver potential was held at −60 mV with respect to a saturated calomel electrode. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. Also, the silver potential was held at −70 mV. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the potential at the end of the addition was +20 mV. After the temperature was raised to 78° C. and the pH was adjusted to 9.1, KBr was added to adjust the potential to −60 mV. The AgI fine grain emulsion used in the preparation of Em-A was added in an amount of 5.73 g as a KI weight. Immediately after the addition, 321 mL of an aqueous solution containing 66.4 g of $AgNO_3$ were added over 4 min. For the first 2 min of the addition, the silver potential was held at −60 mV by an aqueous KBr solution. The resultant emulsion was washed with water and chemically sensitized in substantially the same manner as for Em-F.

(Manufacturing method of emulsion Em-H)

An aqueous solution containing 17.8 g of ion-exchanged gelatin with a molecular weight of 100,000, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of ion-exchanged gelatin with a molecular weight of 100,000 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the silver potential was held at +40 mV with respect to a saturated calomel electrode. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the silver potential was held at +90 mV with respect to the saturated calomel electrode. Also, over 6 min from the start of the addition, 100 mL of an aqueous solution containing 29 mg of yellow prussiate of potash were added. After 14.4 g of KBr were added, the AgI fine grain emulsion used in the preparation of Em-A was added in an amount of 6.3 g as a KI weight. Immediately after the addition, an aqueous solution containing 42.7 g of $AgNO_3$ and an aqueous KBr solution were added over 11 min by the double jet method. During the addition, the silver potential was held at +90 mV. The resultant emulsion was washed with water and chemically sensitized in substantially the same manner as for Em-F.

(Manufacturing method of emulsion Em-I)

Em-I was prepared following substantially the same procedures as for Em-H except that the nucleation temperature was changed to 35° C.

(Manufacturing method of emulsion Em-J)

1,200 mL of an aqueous solution containing 0.38 g of phthalated gelatin with a phthalation ratio of 97% and a molecular weight of 100,000 and 0.9 g of KBr were held at 60° C. and stirred with violence at pH 2. An aqueous solution containing 1.96 g of $AgNO_3$ and an aqueous solution containing 1.67 g of KBr and 0.172 g of KI were added over 30 sec by the double jet method. After ripening, 12.8 g of trimellitated gelatin containing 35 μmol of methionine per g and having a molecular weight of 100,000, which was formed by chemically modifying an amino group with trimellitic acid, were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 31 min by the double jet method. During the addition, the silver potential was held at −50 mV with respect to a saturated calomel electrode. An aqueous solution containing 65.6 g of $AgNO_3$ and an aqueous KBr solution were added over 37 min by the double jet method while the flow rate was accelerated so that the final flow rate was 2.1 times the initial flow rate. During the addition, the AgI fine grain emulsion used in the preparation of Em-A was simultaneously added at an accelerated flow rate such that the silver iodide content was 6.5 mol %. Also, the silver potential was held at −50 mV. After 1.5 mg of thiourea dioxide were added, 132 mL of an aqueous solution containing 41.8 g of $AgNO_3$ and an aqueous KBr solution were added over 13 min by the double jet method. The addition of the aqueous KBr solution was so adjusted that the silver potential at the end of the addition was +40 mV. After 2 mg of sodium benzenethiosulfonate were added, KBr was added to adjust the silver potential to −100 mV. The abovementioned AgI fine grain emulsion was added in an amount of 6.2 g as a KI weight. Immediately after the addition, 300 mL of an aqueous solution containing 88.5 g of $AgNO_3$ were added over 8 min. An aqueous KBr solution was added to adjust the potential at the end of the addition to −60 mV. After washing with water, gelatin was added, and the pH and the pAg were adjusted at 40° C. to 6.5 and 8.2, respectively. After the compounds 11 and 12 were added, the temperature was raised to 61° C. Sensitizing dyes 18, 19, 20, and 21 were added. After that, the emulsion was optimally, chemically sensitized by adding $K_2IrCl_6$, potassium thiocyanate, chloroauric acid, sodium thiosulfate, and N,N-dimethylselenourea. At the end of the chemical sensitization, the compounds 13 and 14 were added.

Sensitizing dye 18

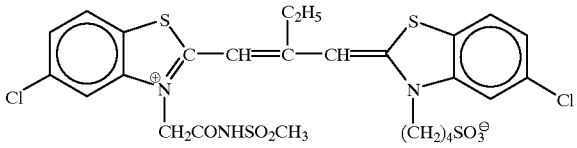

Sensitizing dye 19

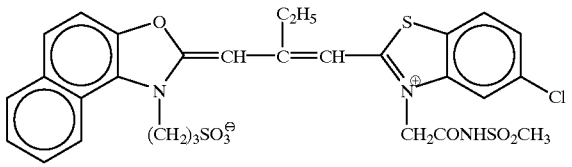

Sensitizing dye 20

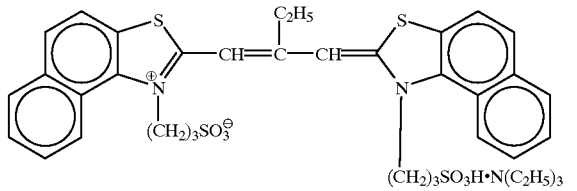

Sensitizing dye 21

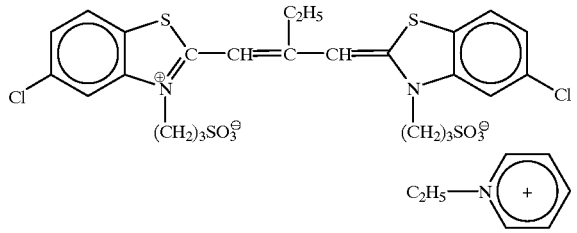

(Manufacturing method of Em-K)

1,200 mL of an aqueous solution containing 4.9 g of low-molecular-weight gelatin with a molecular weight of 15,000 and 5.3 g of KBr were vigorously stirred at 60° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., and 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for Em-J.

(Manufacturing method of Em-L)

Em-L was prepared following substantially the same procedures as for Em-K except that the nucleation temperature was changed to 40° C.

(Manufacturing methods of Em-M, Em-N, and Em-O)

Em-M, Em-N, and Em-O were prepared following substantially the same procedures as for Em-H or Em-I except that chemical sensitization was performed in substantially the same manner as for Em-J.

The characteristic values of the silver halide emulsions Em-A to Em-O are summarized in Table 6.

TABLE 6

| Emulsion No. | Equivalent-circle diameter (μm) variation coefficient (%) | Thickness (μm) variation coefficient (%) | Aspect ratio variation coefficient (%) | Flatness |
|---|---|---|---|---|
| Em-A | 1.98<br>23 | 0.198<br>28 | 10<br>35 | 51 |
| Em-B | 1.30<br>25 | 0.108<br>27 | 12<br>38 | 111 |
| Em-C | 1.00<br>31 | 0.083<br>26 | 12<br>37 | 145 |
| Em-D | 0.75<br>31 | 0.075<br>18 | 10<br>29 | 133 |
| Em-E | 2.02<br>31 | 0.101<br>19 | 20<br>42 | 198 |
| Em-F | 1.54<br>26 | 0.077<br>18 | 20<br>33 | 260 |
| Em-G | 1.08<br>18 | 0.072<br>15 | 15<br>19 | 208 |
| Em-H | 0.44<br>16 | 0.22<br>13 | 2<br>9 | 9 |

| Emulsion No. | Twin plane spacing (μm) variation coefficient (%) | Ratio (%) accounted for by tabular grains in total projected area | Ratio (%) of (100) faces to side faces | I content (mol %) variation coefficient (%) | Cl content (mol %) | Surface I content (mol %) |
|---|---|---|---|---|---|---|
| Em-A | 0.014<br>32 | 92 | 23 | 15<br>17 | 0 | 4.3 |

TABLE 6-continued

| | | | | | | |
|---|---|---|---|---|---|---|
| Em-B | 0.013<br>30 | 93 | 22 | 11<br>16 | 0 | 3.6 |
| Em-C | 0.012<br>30 | 93 | 18 | 4<br>8 | 1 | 1.8 |
| Em-D | 0.010<br>27 | 91 | 33 | 7<br>7 | 2 | 1.9 |
| Em-E | 0.013<br>33 | 99 | 20 | 7<br>7 | 0 | 2.4 |
| Em-F | 0.013<br>26 | 99 | 23 | 6<br>5 | 0 | 2.5 |
| Em-G | 0.008<br>22 | 97 | 23 | 3<br>6 | 0 | 2.0 |
| Em-H | 0.013<br>18 | 90 | 38 | 3<br>6 | 2 | 1 |

| Emulsion No. | Equivalent-circle diameter (μm) variation coefficient (%) | Thickness (μm) variation coefficient (%) | Aspect ratio variation coefficient (%) | Flatness |
|---|---|---|---|---|
| Em-I | 0.33<br>17 | 0.165<br>13 | 2<br>12 | 12 |
| Em-J | 1.83<br>18 | 0.122<br>20 | 15<br>22 | 123 |
| Em-K | 1.09<br>16 | 0.156<br>18 | 7<br>19 | 45 |
| Em-L | 0.84<br>17 | 0.12<br>18 | 7<br>19 | 58 |
| Em-M | 0.55<br>16 | 0.275<br>13 | 2<br>9 | 7 |
| Em-N | 0.44<br>17 | 0.22<br>13 | 2<br>12 | 9 |
| Em-O | 0.33<br>17 | 0.165<br>13 | 2<br>12 | 12 |

| Emulsion No. | Twin plane spacing (μm) variation coefficient (%) | Ratio (%) accounted for by tabular grains in total projected area | Ratio (%) of (100) faces to side faces | I content (mol %) variation coefficient (%) | Cl content (mol %) | Surface I content (mol %) |
|---|---|---|---|---|---|---|
| Em-I | 0.013<br>18 | 88 | 42 | 3<br>6 | 2 | 1 |
| Em-J | 0.012<br>19 | 98 | 23 | 5<br>6 | 1 | 1.8 |
| Em-K | 0.013<br>16 | 99 | 22 | 3<br>7 | 0 | 2.7 |
| Em-L | 0.013<br>16 | 99 | 25 | 3<br>7 | 0 | 2.7 |
| Em-M | 0.013<br>18 | 90 | 38 | 2<br>6 | 2 | 1 |
| Em-N | 0.013<br>18 | 88 | 42 | 2<br>6 | 2 | 1 |
| Em-O | 0.013<br>18 | 88 | 46 | 1<br>6 | 2 | 0.5 |

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally stretched by 3.3 times at 140° C., laterally stretched by 3.3 times at 130° C., and thermally fixed at 250° C. for 6 sec, thereby obtaining a 90-μm thick PEN (PolyEthyleneNaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the support were subjected to corona discharge, UV discharge, and glow discharge. After that, each surface of the support was coated with an undercoat solution (10 cc/m$^2$, by using a bar coater) consisting of 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon stretching. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder (specific resistance=5 Ω•cm), of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and 0.22 g/m$^2$ of resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide of aluminum silicon oxide) coated with 3-polyoxyethylene-propyloxytrimethoxysilane (polymerization degree is 15) (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-polyoxyethylene-propyloxytrimethoxysilane (polymerization degree is 15) (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-polyoxyethylene-propyloxytrimethoxysiliane (polymerization degree is 15) (15 wt %) were added as a polishing agent. Drying was performed at 115° C. for 6 min (all rollers and conveyors in the drying zone were at 115° C). The resultant slip layer was found to have excellent characteristics; the coefficient of kinetic friction was 0.06 (5 mmϕ stainless steel hard sphere, load 100 g, speed 6 cm/min), and the coefficient of static friction was 0.07 (clip method). The coefficient of kinetic friction (to be described later) between an emulsion surface and the slip layer also was excellent, 0.12.

4) Coating of Photosensitive Layers

The surface of the support on the side away from the back layers formed as above was coated with a plurality of layers having the following compositions to form a sample 201 as a color negative photosensitive material.

(Compositions of sensitive layers)

The main materials used in the individual layers are classified as follows.

ExC: Cyan coupler

UV: Ultraviolet absorbent

ExM: Magenta coupler

HBS: High-boiling organic solvent

ExY: Yellow coupler

H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

1st Layer (1st antihalation layer)

| | | |
|---|---|---|
| Black colloidal silver | silver | 0.155 |
| 0.07-μm, surface fogged AgBrI(2) | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

2nd Layer (2nd antihalation layer)

| | | |
|---|---|---|
| Black colloidal silver | silver | 0.066 |
| Gelatin | | 0.407 |
| ExM-1 | | 0.050 |
| ExF-1 | | 2.0 × 10$^{-3}$ |
| HBS-1 | | 0.074 |
| Solid disperse dye ExF-2 | | 0.015 |
| Solid disperse dye ExF-3 | | 0.020 |

3rd Layer (Interlayer)

| | |
|---|---|
| 0.07-μm AgBrI(2) | 0.020 |
| ExC-2 | 0.022 |
| Polyethylacrylate latex | 0.085 |
| Gelatin | 0.294 |

4th Layer (Low-speed red-sensitive emulsion layer)

| | | |
|---|---|---|
| Silver iodobromide emulsion M | silver | 0.065 |
| Silver iodobromide emulsion N | silver | 0.100 |
| Silver iodobromide emulsion O | silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |

5th Layer (Medium-speed red-sensitive emulsion layer)

| | | |
|---|---|---|
| Silver iodobromide emulsion K | silver | 0.21 |
| Silver iodobromide emulsion L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |

-continued

| | | |
|---|---|---|
| Cpd-4 | | 0.028 |
| HBS-1 | | 0.16 |
| Gelatin | | 1.18 |

6th Layer (High-speed red-sensitive emulsion layer)

| | | |
|---|---|---|
| Silver iodobromide emulsion J | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-4 | | 0.077 |
| HBS-1 | | 0.25 |
| HBS-2 | | 0.12 |
| Gelatin | | 2.12 |

7th Layer (Interlayer)

| | |
|---|---|
| Cpd-1 | 0.089 |
| Solid disperse dye ExF-4 | 0.030 |
| HBS-1 | 0.050 |
| Polyethylacrylate latex | 0.83 |
| Gelatin | 0.84 |

8th Layer (layer for donating interimage effect to red-sensitive layer)

| | | |
|---|---|---|
| Silver iodobromide emulsion E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |

9th Layer (Low-speed green-sensitive emulsion layer)

| | | |
|---|---|---|
| Silver iodobromide emulsion g | silver | 0.39 |
| Silver iodobromide emulsion H | silver | 0.28 |
| Silver iodobromide emulsion I | silver | 0.35 |
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |

10th Layer (Medium-speed green-sensitive emulsion layer)

| | | |
|---|---|---|
| Silver iodobromide emulsion F | silver | 0.20 |
| Silver iodobromide emulsion g | silver | 0.25 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |

-continued

| | | |
|---|---|---|
| HBS-1 | | 0.064 |
| HBS-3 | | $2.1 \times 10^{-3}$ |
| Gelatin | | 0.44 |

11th Layer (High-speed green-sensitive emulsion layer)

| | | |
|---|---|---|
| Emulsion o in Example 2 | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |
| Polyethylacrylate latex | | 0.099 |
| Gelatin | | 1.11 |

12th Layer (Yellow filter layer)

| | | |
|---|---|---|
| Yellow colloidal silver | silver | 0.047 |
| Cpd-1 | | 0.16 |
| Solid disperse dye ExF-5 | | 0.010 |
| Solid disperse dye ExF-6 | | 0.010 |
| HBS-1 | | 0.082 |
| Gelatin | | 1.057 |

13th Layer (Low-speed blue-sensitive emulsion layer)

| | | |
|---|---|---|
| Silver iodobromide emulsion B | silver | 0.18 |
| Silver iodobromide emulsion C | silver | 0.20 |
| Silver iodobromide emulsion D | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |

14th Layer (High-speed blue-sensitive emulsion layer)

| | | |
|---|---|---|
| Silver iodobromide emulsion A | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |

15th Layer (1st protective layer)

| | | |
|---|---|---|
| 0.07-μm AgBrI (2) | silver | 0.30 |
| UV-1 | | 0.21 |

-continued

| | |
|---|---|
| UV-2 | 0.13 |
| UV-3 | 0.20 |
| UV-4 | 0.025 |
| F-18 | 0.009 |
| F-19 | 0.005 |
| F-20 | 0.005 |
| HBS-1 | 0.12 |
| HBS-4 | $5.0 \times 10^{-2}$ |
| Gelatin | 2.3 |

16th Layer (2nd protective layer)

| | |
|---|---|
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

A sample 202 was formed by replacing the emulsion o prepared in Example 2 in the 11th layer with the emulsion r prepared in Example 3.

(Preparation of dispersions of organic solid disperse dyes)

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, a solid dispersion of ExF-4 was obtained. The average grain sizes of the fine dye grains was 0.45 μm. ExF-2 was dispersed by a micro-precipitation dispersion method described in Example 1 of EP 549,489A. The average grain size was found to be 0.06 μm.

A solid dispersion of ExF-6 was dispersed by the following method.

4,000 g of water and 376 g of a 3% solution of W-2 were added to 2,800 g of a wet cake of ExF-6 containing 18% of water, and the resultant material was stirred to form a slurry of ExF-6 having a concentration of 32%. Subsequently, ULTRA VISCO MILL (UVM-2) manufactured by Imex K.K. was filled with 1,700 mL of zirconia beads having an average grain size of 0.5 mm. The slurry was milled by passing it through the mill for 8 hr at a peripheral speed of about 10 m/sec and a discharge amount of 0.5 L/min. The average grain size was 0.52 μm.

Compounds used in the formation of each layer were as follows.

ExC-1

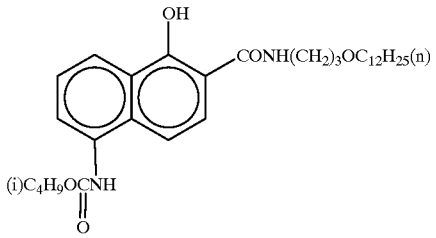

ExC-2

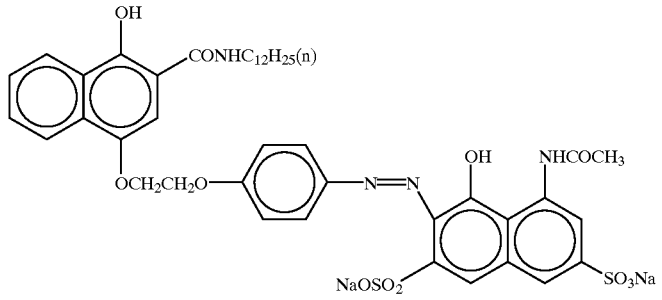

-continued
ExC-3
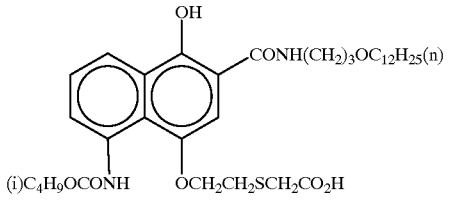
ExC-4
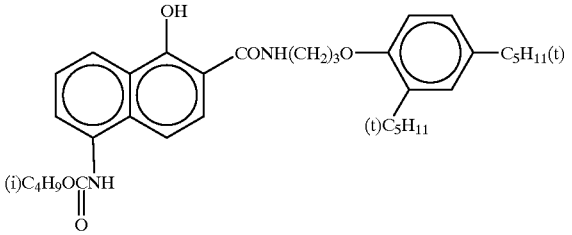
ExC-5
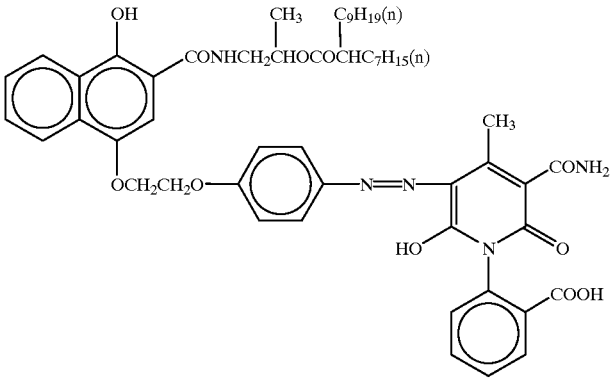
ExC-6
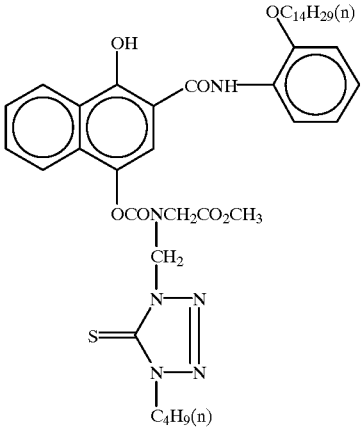

-continued
ExC-7
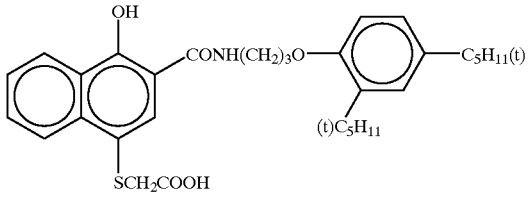
ExC-8
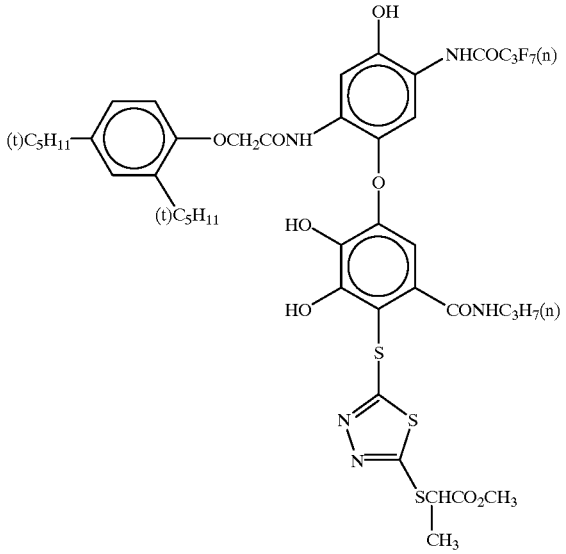
ExM-1
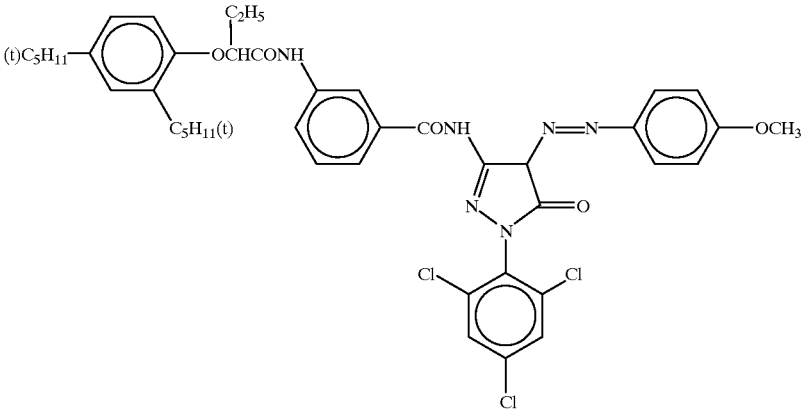
ExM-2
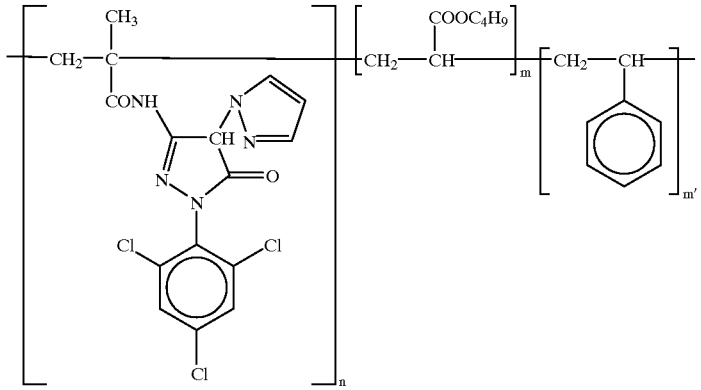
n = 50
m = 25
m' = 25
mol. wt. about 20,000

-continued
ExM-3
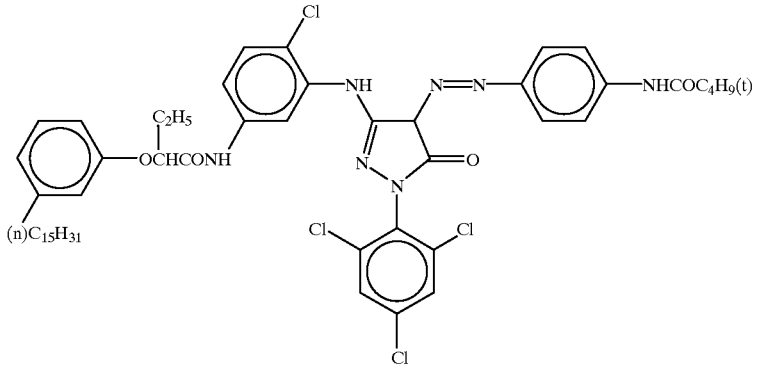
ExM-4
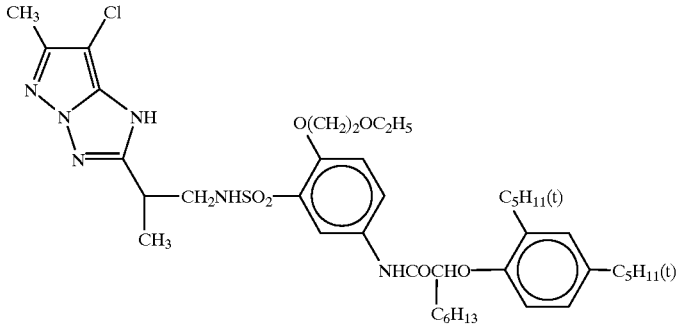
ExM-5
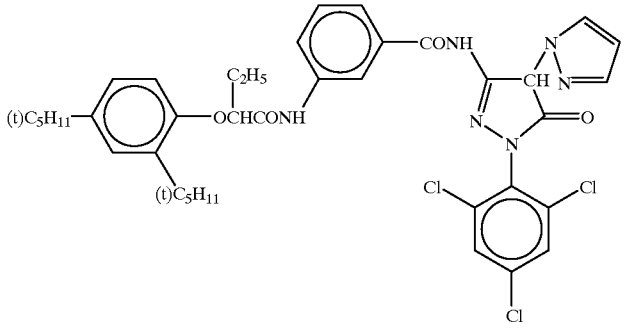
ExY-1
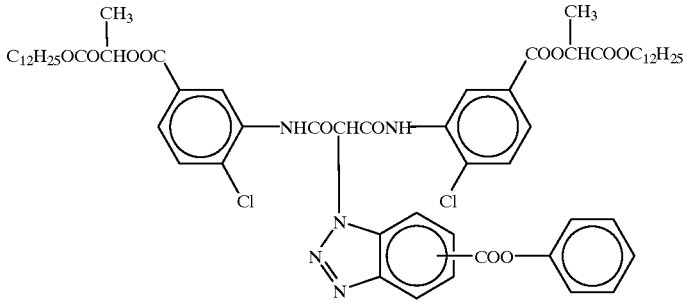

-continued
ExY-2
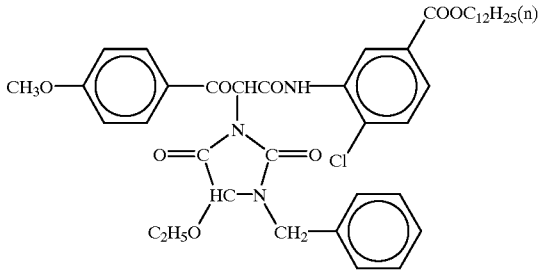
ExY-3
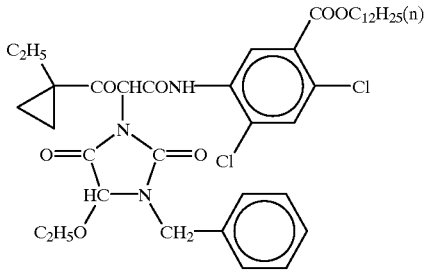
ExY-4
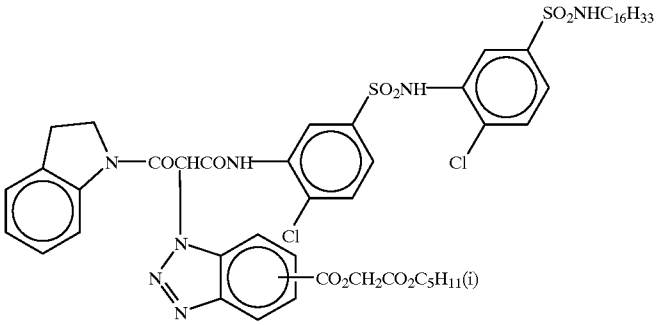
ExY-5
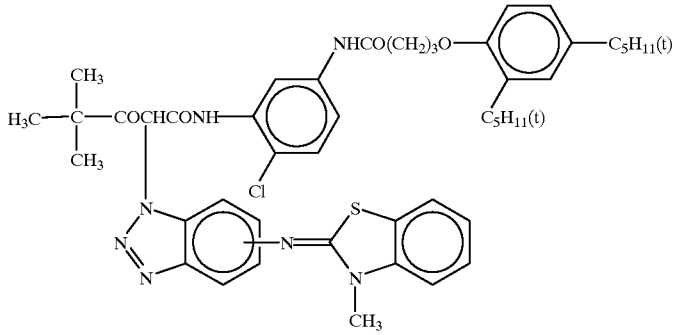
ExG-1
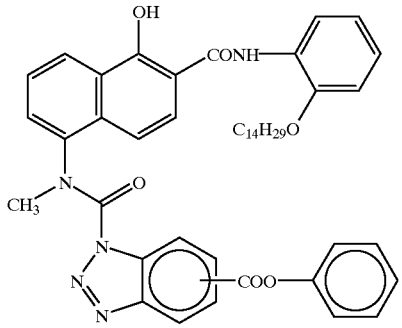

-continued
ExY-6
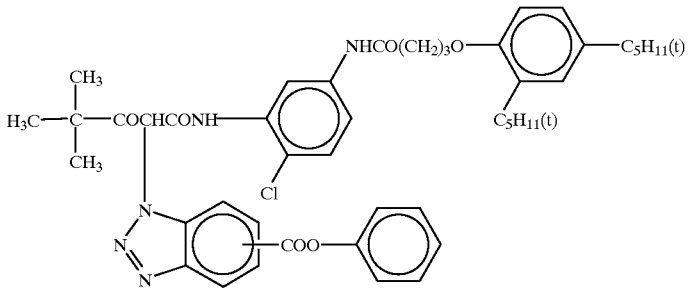
ExF-1
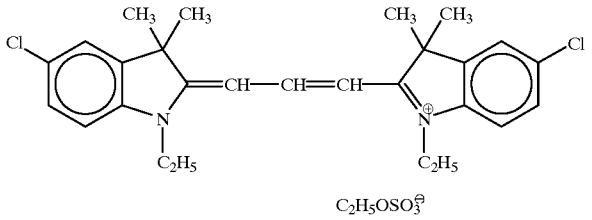
ExF-2
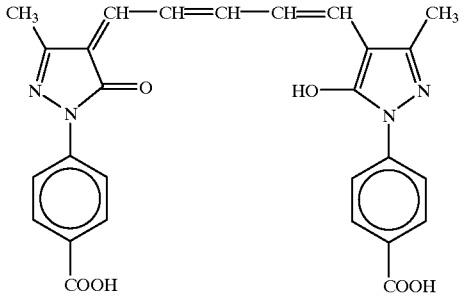
ExF-3
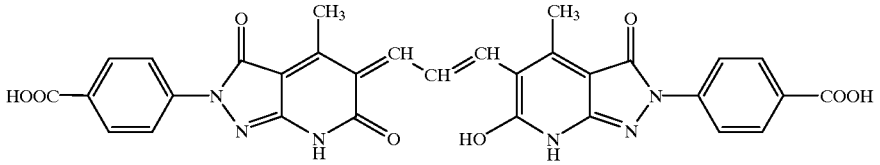
ExF-4
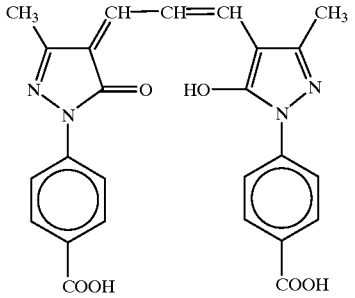
ExF-5
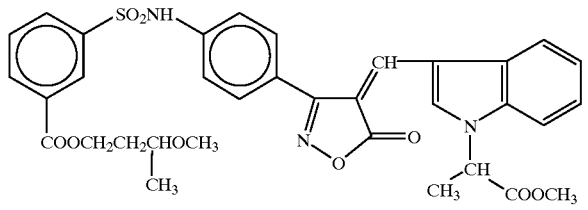

-continued
ExF-6
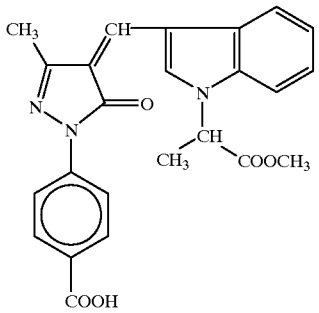
Cpd-1
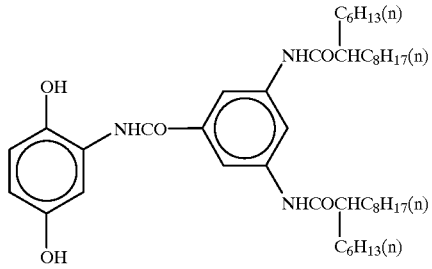
Cpd-2
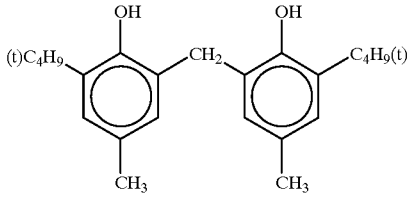
Cpd-3
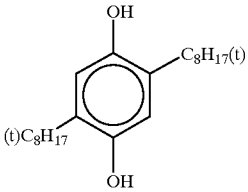
Cpd-4
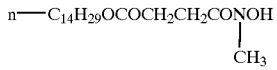
UV-1
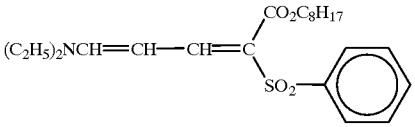
UV-2
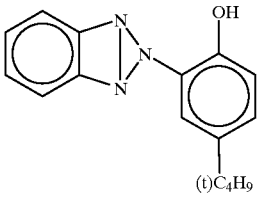
UV-3
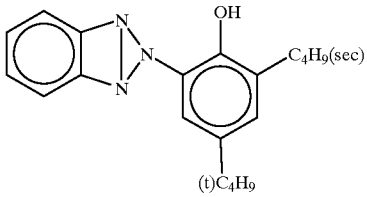
UV-4
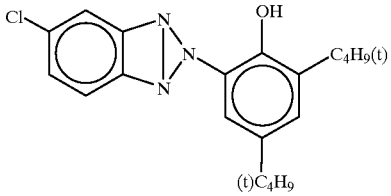
HBS-1
Tricresylphosphate
HBS-2
Di-n-butylphthalate
HBS-3
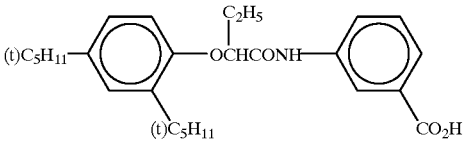
HBS-4
Tri(2-ethylhexyl)phosphate
H-1
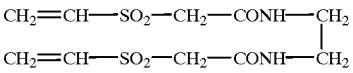
S-1
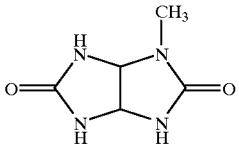
B-1
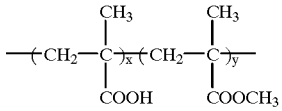
x/y = 10/90 (weight ratio)
average molecular weight:
about 35,000

-continued
B-2
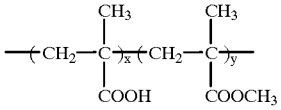
x/y = 40/60 (weight ratio)
average molecular weight:
about 20,000
B-3
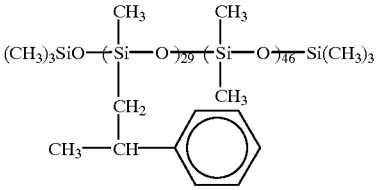
(molar ratio)
average molecular weight:
about 8,000
B-4
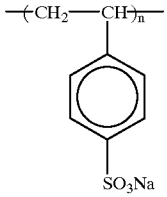
average molecular weight:
about 750,000
B-5
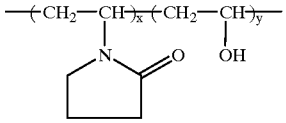
x/y = 70/30
(weight ratio)
average molecular weight:
about 17,000
B-6
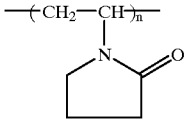
average molecular weight:
about 10,000
W-1
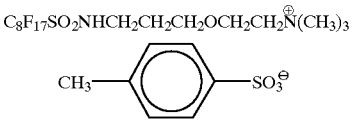
W-2
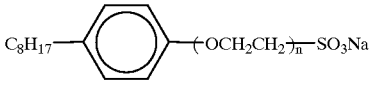
n = 2 to 4
W-3
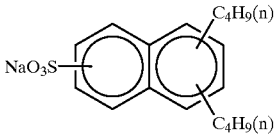
W-4
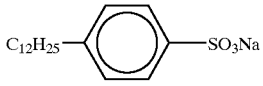
W-5
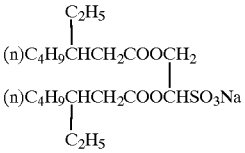
F-1
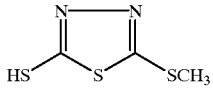
F-2
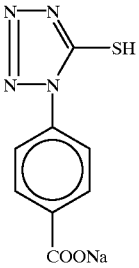
F-3
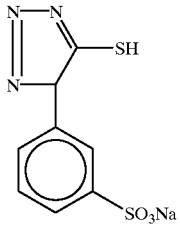
F-4
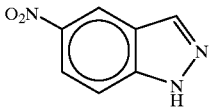

-continued

F-5

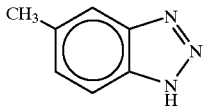

F-6

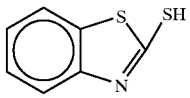

F-7

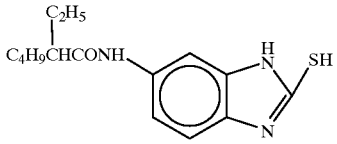

F-8

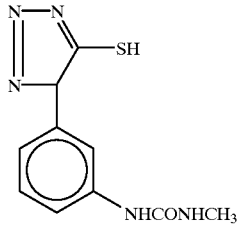

F-9

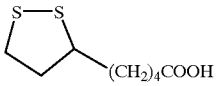

F-10

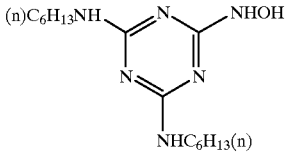

F-11

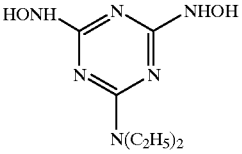

F-12

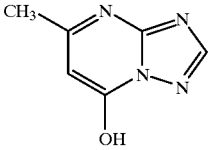

F-13

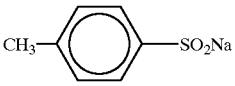

F-15

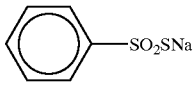

F-15

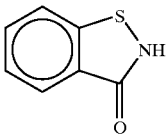

F-16

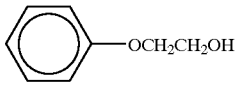

F-17

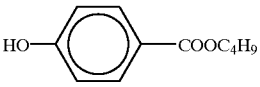

F-18

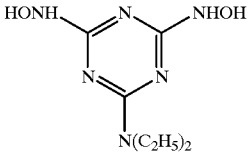

F-19

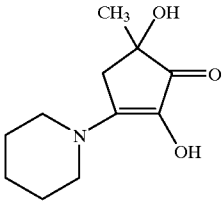

F-20

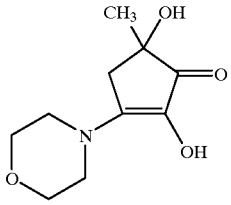

These samples were subjected to film hardening for 14 hr at 40° C. and a relative humidity of 70%. After that, the samples were exposed for 1/100 sec through the SC-39 gelatin filter (a long-wavelength light transmitting filter having a cutoff wavelength of 390 nm) manufactured by Fuji Photo Film Co., Ltd. and through a continuous wedge. Development was performed as follows by using the FP-360B automatic processor manufactured by Fuji Photo Film Co., Ltd. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. film)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank Solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl 1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixing (1) tank solution) | | |

A 5:95 (volume ratio) mixture of the above bleaching tank solution and the following fixing tank solution (pH 6.8).

| | Tank solution (g) | Replenisher (g) |
|---|---|---|
| (Fixing (2)) | | |
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| | |
|---|---|
| Sodium p-toluenesulfinate | 0.03 |
| Polyoxyethylene-p-monononylphenylether (average polymerization degree 10) | 0.2 |
| 1,2-benzoisothiazoline-3-one sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

The same processing was performed by halving the replenishment rate of the color developer. The results are shown in Table 7.

TABLE 7

| Sample | | | Standard development | | Half replenishment rate | |
|---|---|---|---|---|---|---|
| No. | Remarks | Emulsion | Fog | Sensitivity | Fog | Sensitivity |
| 201 | Comparative example | o | 0.14 | 100 | 0.11 | 72 |
| 202 | Present invention | r | 0.13 | 131 | 0.11 | 118 |

As shown in Table 7, a sensitized material having high sensitivity and improved development dependence can be obtained by using emulsions of the present invention.

EXAMPLE 5

Induced fluorescence favorable in the present invention will be described below.

Gelatin-1 to gelatin-4 used as dispersion media in the preparation of emulsions described below have the following attributes.

Gelatin-1:

Common alkali-processed ossein gelatin made from beef bones. No —$NH_2$ groups in the gelatin were chemically modified.

Gelatin-2:

Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3:

Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4:

Gelatin formed by decreasing the molecular weight of gelatin-1 by allowing enzyme to act on it such that the average molecular weight was 15,000, deactivating the enzyme, and drying the resultant material. No —$NH_2$ groups in the gelatin were chemically modified.

All of gelatin-1 to gelatin-4 described above were deionized and so adjusted that the pH of an aqueous 5% solution at 35° C. was 6.0.

(Preparation of emulsion A-1)

1,300 mL of an aqueous solution containing 1.0 g of KBr and 1.1 g of gelatin-4 described above was stirred at 35° C. (1st solution preparation). 16.8 mL of an aqueous solution Ag-1 (containing 4.9 g of $AgNO_3$ in 100 mL), 12.8 mL of an aqueous solution X-1 (containing 5.2 g of KBr in 100 mL), and 3.8 mL of an aqueous solution G-1 (containing 8.0 g of gelatin-4 in 100 mL) were added over 30 sec at fixed flow rates by the triple jet method (addition 1). After that, 6.5 g of KBr were added, and the temperature was raised to 75° C. After a ripening step was performed for 12 min, 300 mL of an aqueous solution G-2 (containing 12.7 g of gelatin-2 described above in 100 mL) were added. Subsequently, 2.1 g of disodium 4,5-dihydroxy-1,3-disulfonate monohydrate and 0.002 g of thiourea dioxide were sequentially added at an interval of 1 min.

157 mL of an aqueous solution Ag-2 (containing 22.1 g of $AgNO_3$ in 100 mL) and an aqueous solution X-2 (containing 15.5 g of KBr in 100 mL) were added over 35 min by the double jet method. During the addition, the flow rate of the aqueous solution Ag-2 was accelerated such that the final flow rate was 3.4 times the initial flow rate, and the aqueous solution X-2 was so added that the pAg of the bulk emulsion solution in the reaction vessel was held at 7.52 (addition 2). Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 66 min by the double jet method. During the addition, the flow rate of the aqueous solution Ag-3 was accelerated such that the final flow rate was 1.6 times the initial flow rate, and the aqueous solution X-3 was so added that the pAg of the bulk emulsion solution in the reaction vessel was held at 7.52 (addition 3).

Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-4 was so performed that the pAg of the bulk emulsion solution in the reaction vessel was held at 7.52 (addition 4).

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. 73.9 g of an AgI fine grain emulsion (containing 13.0 g of fine AgI grains having an average grain size of 0.047 μm in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4 (addition 5). After that, desalting was performed by normal flocculation. Water, NaOH, and gelatin-1 were added under stirring, and the pH and the pAg were adjusted to 6.4 and 8.6, respectively, at 56° C.

The resultant emulsion consisted of tabular silver halide grains having an equivalent-sphere diameter of 1.47 μm, an equivalent-circle diameter of 2.57 μm, a thickness of 0.32 μm, an average aspect ratio of 8.0, and an average AgI content of 3.94 mol %. Parallel major surfaces of the tabular grains were (111) faces. The AgI content on the surfaces of the silver halide grains measured by XPS was 2.1 mol %.

Subsequently, the emulsion was optimally, chemically sensitized by sequentially adding a sensitizing dye Exs-1 presented below, potassium thiocyanate, chloroauric acid, sodium thiosulfate, and N,N-dimethylselenourea. The chemical sensitization was completed by adding water-soluble mercapto compounds MER-1 and MER-2 presented below at a ratio of 4:1 such that the total amount was $1.17\times10^{-3}$ mol per mol of a silver halide. This emulsion A-1 was optimally, chemically sensitized when the addition amount of Exs-1 was $1.38\times10^{-3}$ mol per mol of a silver halide.

The sensitizing dye of the present invention was used as a fine solid dispersion formed by a method described in JP-A-11-52507.

For example, a fine solid dispersion of the sensitizing dye Exs-1 was formed as follows. 0.8 parts by weight of $NaNO_3$ and 3.2 parts by weight of $Na_2SO_4$ were dissolved in 43 parts by weight of ion-exchanged water. 3 parts by weight of the dye Exs-1 were added, and the material was dispersed at 60° C. for 20 min by using a dissolver blade at 2,000 rpm, thereby forming a fine solid dispersion of the sensitizing dye Exs-1.

Exs-1

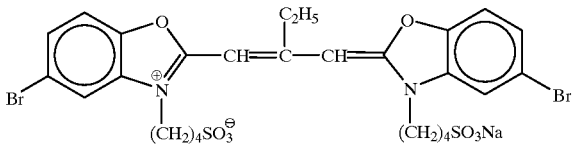

-continued

MER-1

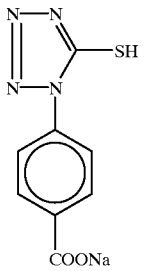

MER-2

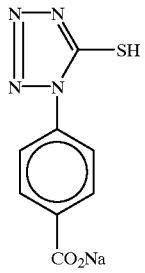

(Preparation of emulsion A-2)

An emulsion A-2 was prepared by changing the preparation conditions of the emulsion A-1 described above as follows.

① After (addition 4) was completed, the temperature was lowered to 55° C. over 10 min. Subsequently, 15.8 g of KBr were added to adjust the pAg of the bulk emulsion solution in the reaction vessel to 9.51.

② An AgI fine grain emulsion to be added two minutes before (addition 5) was prepared by the following method. An aqueous solution Ag-5 (containing 7.31 g of $AgNO_3$ in 100 mL) and an aqueous solution X-5 (containing 7.3 g of KI and 7.4 g of gelatin-4 in 100 mL) were simultaneously added to a mixer placed outside a reaction vessel prescribed by the present invention to prepare an AgI fine grain emulsion (containing 13.0 g of fine AgI grains having an average equivalent-sphere diameter of 0.025 μm and a grain size distribution of 28%).

The equivalent-sphere diameter, aspect ratio, and AgI content on the surface of a silver halide grain measured by XPS of the obtained emulsion were similar to those of the emulsion A-1.

Also, this emulsion was optimally, chemically sensitized when the addition amount of the sensitizing dye Exs-1 was equal to that of the emulsion A-1 per mol of a silver halide.

(Preparation of emulsion A-3)

An emulsion A-3 was prepared by changing the preparation conditions of the emulsion A-1 described above as follows.

① After (addition 4) was completed, the temperature was lowered to 55° C. over 10 min. Subsequently, 10.8 g of KBr were added to adjust the pAg of the bulk emulsion solution in the reaction vessel to 9.36.

② An AgI fine grain emulsion to be added two minutes before (addition 5) was prepared by the following method. The aqueous solution Ag-5 (containing 10.96 g of $AgNO_3$ in 100 mL) and the aqueous solution X-5 (containing 10.95 g of KI and 11.1 g of gelatin-4 in 100 mL) were simultaneously added to a mixer placed outside a reaction vessel prescribed by the present invention to prepare an AgI fine grain emulsion (containing 13.0 g of fine AgI grains having an average equivalent-sphere diameter of 0.010 μm and a grain size distribution of 22%).

The equivalent-sphere diameter, aspect ratio, and AgI content on the surface of a silver halide grain measured by XPS of the obtained emulsion were similar to those of the emulsion A-1.

Also, this emulsion was optimally, chemically sensitized when the addition amount of the sensitizing dye Exs-1 was equal to that of the emulsion A-1 per mol of a silver halide.

(Preparation of emulsion B-1)

An emulsion B-1 was prepared by changing the preparation conditions of the emulsion A-1 described above as follows.

① Gelatin in the aqueous solution G-2 added after the temperature was raised to 75° C. and the 12-min ripening step was performed was changed from gelatin-2 to gelatin-3.

② The addition flow rate of the aqueous solution Ag-2 in (addition 2) was changed such that the addition time was 14 min 30 sec while the addition solution amount was kept at 157 mL. The flow rate was so accelerated that the final flow rate was 3.4 times the initial flow rate. Also, the aqueous solution X-2 was added such that the pAg of the bulk emulsion solution in the reaction vessel was held at 8.30.

③ The addition flow rate of the aqueous solution Ag-3 in (addition 3) was changed such that the addition time was 34 min while the addition solution amount was kept at 329 mL. The flow rate was so accelerated that the final flow rate was 1.6 times the initial flow rate. Also, the aqueous solution X-3 was added such that the pAg of the bulk emulsion solution in the reaction vessel was held at 8.30.

The obtained emulsion consisted of tabular silver halide grains having an equivalent-sphere diameter of 1.47 μm, an equivalent-circle diameter of 3.52 μm, a thickness of 0.17 μm, an average aspect ratio of 15.0, and an average AgI content of 3.94 mol. Parallel major surfaces of the grains were (111) faces. The AgI content on the surface of the silver halide grains measured by XPS was 2.1 mol %. Approximately 60% of the total projected area were accounted for by grains having an equivalent-circle diameter of 3.5 μm or more and a thickness of 0.19 μm or less.

Subsequently, the emulsion was optimally, chemically sensitized by sequentially adding the sensitizing dye Exs-1 described above, potassium thiocyanate, chloroauric acid, sodium thiosulfate, and N,N-dimethylselenourea. The chemical sensitization was completed by adding the water-soluble mercapto compounds MER-1 and MER-2 described above at a ratio of 4:1 such that the total amount was $1.75\times10^{-3}$ mol per mol of a silver halide. This emulsion B-1 was optimally, chemically sensitized when the addition amount of Exs-1 was $2.07\times10^{-3}$ mol per mol of a silver halide.

(Preparation of emulsion B-2)

An emulsion B-2 was prepared by changing the preparation conditions of the emulsion B-1 described above as follows.

① In (addition 2), the pAg of the bulk emulsion solution in the vessel was held at 8.19 by the addition of X-2.

② After (addition 4) was completed, the temperature was lowered to 55° C. over 10 min. Subsequently, 15.8 g of KBr were added to adjust the pAg of the bulk emulsion solution in the reaction vessel to 9.51.

③ An AgI fine grain emulsion to be added two minutes before (addition 5) was prepared by the following method. The aqueous solution Ag-5 (containing 7.31 g of $AgNO_3$ in 100 mL) and the aqueous solution X-5 (containing 7.3 g of KI and 7.4 g of gelatin-4 in 100 mL) were simultaneously added to a mixer placed outside a reaction vessel prescribed by the present invention to prepare an AgI fine grain emulsion (containing 13.0 g of fine AgI grains having an average equivalent-sphere diameter of 0.025 μm).

The equivalent-sphere diameter, aspect ratio, and AgI content on the surface of a silver halide grain measured by XPS of the obtained emulsion were similar to those of the emulsion B-1.

Also, this emulsion was optimally, chemically sensitized when the addition amount of the sensitizing dye Exs-1 was equal to that of the emulsion B-1 per mol of a silver halide.

(Preparation of emulsion B-3)

An emulsion B-3 was prepared by changing the preparation conditions of the emulsion B-1 described above as follows.

① In (addition 2 and addition 3), the pAg of the bulk emulsion solution in the vessel was held at 8.19 by the addition of X-2 and X-3, respectively.

② After (addition 4) was completed, the temperature was lowered to 55° C. over 10 min. Subsequently, 10.8 g of KBr were added to adjust the pAg of the bulk emulsion solution in the reaction vessel to 9.36.

In (addition 4), the ratio of the thickness of growth in the major surface direction to that in the side face direction was 0.055.

③ An AgI fine grain emulsion to be added two minutes before (addition 5) was prepared by the following method. The aqueous solution Ag-5 (containing 10.96 g of $AgNO_3$ in 100 mL) and the aqueous solution X-5 (containing 10.95 g of KI and 11.1 g of gelatin-4 in 100 mL) were simultaneously added to a mixer placed outside a reaction vessel of the present invention to prepare an AgI fine grain emulsion (containing 13.0 g of fine AgI grains having an average equivalent-sphere diameter of 0.010 μm).

The equivalent-sphere diameter, aspect ratio, and AgI content on the surface of a silver halide grain measured by XPS of the obtained emulsion were similar to those of the emulsion B-1. When the emulsion was irradiated with a 325-nm electromagnetic beam at 6° K., 575-nm induced fluorescence was generated which was 50% of the maximum fluorescence emission intensity induced within the wavelength range of 490 to 560 nm.

Also, this emulsion was optimally, chemically sensitized when the addition amount of the sensitizing dye Exs-1 was equal to that of the emulsion B-1 per mol of a silver halide.

(Preparation of emulsion B-4)

An emulsion B-4 was prepared by changing the preparation conditions of the emulsion B-1 described above as follows.

① In (addition 3), the pAg of the bulk emulsion solution in the vessel was held at 8.19 by the addition of X-3.

② The addition flow rate of the aqueous solution Ag-2 in (addition 2) was changed such that the addition time was 16 min 30 sec while the addition solution amount was kept at 157 mL. The flow rate was so accelerated that the final flow rate was 3.4 times the initial flow rate. Also, the aqueous solution X-2 was added such that the pAg of the bulk emulsion solution in the reaction vessel was held at 8.15.

③ The addition flow rate of the aqueous solution Ag-3 in (addition 3) was changed such that the addition time was 38 min while the addition solution amount was kept at 329 mL. The flow rate was so accelerated that the final flow rate was 1.6 times the initial flow rate. Also, the aqueous solution X-3 was added such that the pAg of the bulk emulsion solution in the reaction vessel was held at 8.15.

④ The addition flow rate of the aqueous solution Ag-4 in (addition 4) was changed such that the addition time was 13 min while the addition solution amount was kept at 156 mL. The flow rate was so accelerated that the final flow rate was 1.6 times the initial flow rate. Also, the aqueous solution X-4 was added such that the pAg of the bulk emulsion solution in the reaction vessel was held at 8.15. In (addition 4), the ratio of the thickness of growth in the major surface direction to that in the side face direction was 0.03.

⑤ An AgI fine grain emulsion to be added two minutes before (addition 5) was prepared by the following method. The aqueous solution Ag-5 (containing 10.96 g of $AgNO_3$ in 100 mL) and the aqueous solution X-5 (containing 10.95 g of KI and 11.1 g of gelatin-4 in 100 mL) were simultaneously added to a mixer placed outside a reaction vessel of the present invention to prepare an AgI fine grain emulsion (containing 13.0 g of fine AgI grains having an average equivalent-sphere diameter of 0.010 μm).

The equivalent-sphere diameter, aspect ratio, and AgI content on the surface of a silver halide grain measured by XPS of the obtained emulsion were similar to those of the emulsion B-1.

Also, this emulsion was optimally, chemically sensitized when the addition amount of the sensitizing dye Exs-1 was equal to that of the emulsion B-1 per mol of a silver halide.

(Preparation of emulsion C-1)

An emulsion C-1 was prepared by changing the preparation conditions of the emulsion B-1 described above as follows.

① (Addition 2) was changed as follows.

157 mL of the aqueous solution Ag-2 (containing 22.1 g of $AgNO_3$ in 100 mL) and 157 mL of an aqueous solution X-6 (containing 15.5 g of KBr and 23.1 g of gelatin-4 in 100 mL) were simultaneously added to a mixer placed outside a reaction vessel of the present invention over 28 min. The AgBr fine grain emulsion formed (fine AgBr grains having an equivalent-sphere diameter of 0.025 μm) was continuously added to the reaction vessel. During the addition, the pAg of the bulk emulsion solution in the reaction vessel was held at 8.30.

② (Addition 3) was changed as follows.

329 mL of the aqueous solution Ag-3 (containing 32.0 g of $AgNO_3$ in 100 mL) and 329 mL of an aqueous solution X-7 (containing 21.5 g of KBr, 1.5 g of KI, and 33.1 g of gelatin-4 in 100 mL) were simultaneously added to a mixer placed outside a reaction vessel of the present invention over 53 min. The AgBr fine grain emulsion formed (fine AgBrI grains having an equivalent-sphere diameter of 0.028 μm) was continuously added to the reaction vessel. During the addition, the pAg of the bulk emulsion solution in the reaction vessel was held at 8.30.

The obtained emulsion consisted of tabular silver halide grains having an equivalent-sphere diameter of 1.47 μm, an equivalent-circle diameter of 4.35 μm, a thickness of 0.112 μm, an average aspect ratio of 38.8, and an average AgI content of 3.94 mol. Parallel major surfaces of the grains were (111) faces. The AgI content on the surfaces of the silver halide grains measured by XPS was 2.1 mol %. Approximately 60% of the total projected area were accounted for by grains having an equivalent-circle diameter of 4.0 μm or more and a thickness of 0.14 μm or less.

Subsequently, the emulsion was optimally, chemically sensitized by sequentially adding the sensitizing dye Exs-1 described above, potassium thiocyanate, chloroauric acid, sodium thiosulfate, and N,N-dimethylselenourea. The chemical sensitization was completed by adding the water-soluble mercapto compounds MER-1 and MER-2 described above at a ratio of 4:1 such that the total amount was $2.9\times10^{-3}$ mol per mol of a silver halide. This emulsion C-1 was optimally, chemically sensitized when the addition amount of Exs-1 was $3.41\times10^{-3}$ mol per mol of a silver halide.

(Preparation of emulsion C-2)

An emulsion C-2 was prepared by changing the preparation conditions of the emulsion C-1 described above as follows.

① In (addition 2 and addition 3), the pAg of the bulk emulsion solution in the vessel was held at 8.19 by the addition of X-2 and X-3, respectively.

② After (addition 4) was completed, the temperature was lowered to 55° C. over 10 min. Subsequently, 15.8 g of KBr were added to adjust the pAg of the bulk emulsion solution in the reaction vessel to 9.51.

③ An AgI fine grain emulsion to be added two minutes before (addition 5) was prepared by the following method. The aqueous solution Ag-5 (containing 7.31 g of $AgNO_3$ in 100 mL) and the aqueous solution X-5 (containing 7.3 g of KI and 7.4 g of gelatin-4 in 100 mL) were simultaneously added to a mixer placed outside a reaction vessel prescribed by the present invention to prepare an AgI fine grain emulsion (containing 13.0 g of fine AgI grains having an average equivalent-sphere diameter of 0.025 μm).

The equivalent-sphere diameter, aspect ratio, and AgI content on the surfaces of the silver halide grains measured by XPS of the obtained emulsion were similar to those of the emulsion C-1.

Also, this emulsion was optimally, chemically sensitized when the addition amount of the sensitizing dye Exs-1 was equal to that of the emulsion C-1 per mol of a silver halide.

(Preparation of emulsion C-3)

An emulsion C-3 was prepared by changing the preparation conditions of the emulsion C-1 described above as follows.

① In (addition 2 and addition 3), the pAg of the bulk emulsion solution in the vessel was held at 8.01 by the addition of X-2 and X-3, respectively.

② After (addition 4) was completed, the temperature was lowered to 55° C. over 10 min. Subsequently, 15.8 g of KBr were added to adjust the pAg of the bulk emulsion solution in the reaction vessel to 9.51.

In (addition 4), the ratio of the thickness of growth in the major surface direction to that in the side face direction was 0.055.

③ An AgI fine grain emulsion to be added two minutes before (addition 5) was prepared by the following method. The aqueous solution Ag-5 (containing 7.31 g of $AgNO_3$ in 100 mL) and the aqueous solution X-5 (containing 7.3 g of KI and 7.4 g of gelatin-4 in 100 mL) were simultaneously added to a mixer placed outside a reaction vessel prescribed by the present invention to prepare an AgI fine grain emulsion (containing 13.0 g of fine AgI grains having an average equivalent-sphere diameter of 0.010 μm).

The equivalent-sphere diameter, aspect ratio, and AgI content on the surfaces of silver halide grains measured by XPS of the obtained emulsion were similar to those of the emulsion C-1. When the emulsion was irradiated with a 325-nm electromagnetic beam at 6° K., 575-nm induced fluorescence was generated which was 45% of the maximum fluorescence emission intensity induced within the wavelength range of 490 to 560 nm.

Also, this emulsion was optimally, chemically sensitized when the addition amount of the sensitizing dye Exs-1 was equal to that of the emulsion C-1 per mol of a silver halide.

The emulsions A-1 to A-3, B-1 to B-4, and C-1 to C-3 described above were observed at a liquid nitrogen temperature by using a 400-kV transmission electron microscope. Consequently, in the emulsions A-1 to A-3, B-3, B-4, and C-3 at least 30 dislocation lines were present on side faces of a tabular grain. However, dislocation lines were also observed on major surfaces in the emulsion B-4.

Note that these emulsions A-1 to A-3, B-1 to B-4, and C-1 to C-3 were reduction-sensitized by adding disodium 4,5-dihydroxybenzene-1,3-disulfonate monohydrate and thiourea dioxide immediately before (addition 2) in the emulsion preparation process.

Furthermore, the emulsions A-1 to A-3, B-1 to B-4, and C-1 to C-3 described above were spectrally sensitized by adding the sensitizing dye Exs-1 in the chemical sensitization step during the process of emulsion preparation. This made these emulsions green-sensitive silver halide emulsions whose spectral sensitivity was a maximum at a wavelength of 550 nm.

A cellulose triacetate film support having an undercoat layer was coated with the emulsions A-1 to A-3, B-1 to B-4, and C-1 to C-3 under the coating conditions as shown in Table 2 of Example 1.

The resultant samples were subjected to film hardening for 14 hr at 40° C. and a relative humidity of 70%. After that, the samples were exposed for 1/100 sec through the SC-50 gelatin filter (a long-wavelength light transmitting filter having a cutoff wavelength of 500 nm) manufactured by Fuji Photo Film Co., Ltd. and through a continuous wedge, and developed following the same procedure as in Example 1 (except that the processing time of color development was 2 min 45 sec). The photographic performance of each processed sample was evaluated by measuring the density by a green filter. The sensitivity was indicated by the relative value of the reciprocal of an exposure amount required for a density of fog density plus 0.2.

Coated samples 101 to 110 correspond to the emulsions A-1 to A-3, B-1 to B-4, and C-1 to C-3, respectively. It is evident from the results in Table 8 that the effect of the condition of claim 3 on the sensitivity/graininess ratio is significant in high-aspect-ratio, large-size tabular grain emulsions.

TABLE 8

| | Green-sensitive silver halide tabular emulsion grains used | | | | |
|---|---|---|---|---|---|
| Sample No. | Emulsion No. | Equivalent-circle diameter (μm) | Thickness (μm) | Aspect ratio | AgI size (μm) (variation coefficient (%)) |
| 101 (Comparative example) | A-1 | 2.57 | 0.32 | 8 | 0.047(10.0) |
| 102 (Comparative example) | A-2 | 2.57 | 0.32 | 8 | 0.025(28.0) |
| 103 (Comparative example) | A-3 | 2.57 | 0.32 | 8 | 0.010(22.0) |
| 104 (Present invention) | B-1 | 3.52 | 0.17 | 20.7 | 0.047(10.0) |

TABLE 8-continued

| | | | | | |
|---|---|---|---|---|---|
| 105 (Present invention) | B-2 | 3.52 | 0.17 | 20.7 | 0.025(28.0) |
| 106 (Present invention) | B-3 | 3.52 | 0.17 | 20.7 | 0.010(22.0) |
| 107 (Present invention) | B-4 | 3.52 | 0.17 | 20.7 | 0.010(22.0) |
| 108 (Present invention) | C-1 | 4.35 | 0.112 | 38.8 | 0.047(10.0) |
| 109 (Present invention) | C-2 | 4.35 | 0.112 | 38.8 | 0.025(28.0) |
| 110 (Present invention) | C-3 | 4.35 | 0.112 | 38.8 | 0.010(22.0) |

| Sample No. | Dislocation amount in fringe | Emission (%) at 575 nm | Sensitivity | Graininess |
|---|---|---|---|---|
| 101 (Comparative example) | Large | 50 | 97 | 98 |
| 102 (Comparative example) | Large | 50 | 100 | 100 |
| 103 (Comparative example) | Large | 50 | 104 | 100 |
| 104 (Present invention) | Small | 25 | 87 | 94 |
| 105 (Present invention) | Normal | 35 | 100 | 100 |
| 106 (Present invention) | Large | 50 | 120 | 108 |
| 107 (Present invention) | Slightly large, present in planes | 45 | 109 | 104 |
| 108 (Present invention) | Very small | 15 | 70 | 85 |
| 109 (Present invention) | Small | 25 | 100 | 100 |
| 110 (Present invention) | Large | 45 | 138 | 110 |

*The sensitivity and graininess are relatively represented by assuming that for the samples 101 to 103, the sample 102 is 100, for the samples 104 to 107, the sample 105 is 100, and for the samples 108 to 110, the sample 109 is 100.
*The larger the value the higher the sensitivity, and the larger the value the higher the graininess.

EXAMPLE 6

This example shows that if the equivalent-circle diameter of tabular silver halide grains is increased in a photographic emulsion consisting of the tabular grains, inefficiency exists in a region in which this equivalent-circle diameter is 3.5 $\mu$m or more, and a sensitivity rise corresponding to the increase in the grain surface area is difficult to obtain. The example also shows that a silver halide emulsion having a positive hole capturing zone of the present invention has a higher absolute value of sensitivity and a lower inefficiency than those of a comparative silver halide emulsion having no positive hole capturing zone. (Gelatins used in the preparation of silver halide emulsions and methods of manufacturing the same)

Gelatin-1 to gelatin-3 used as protective colloid dispersion media in the preparation of emulsions have the following attributes.

Gelatin-1:

Common alkali-processed ossein gelatin made from beef bones. No —$NH_2$ groups in the gelatin were chemically modified.

Gelatin-2:

Gelatin formed by adding succinic anhydride to an aqueous solution of gelatin-1 at 50° C. and pH 9.0 to cause chemical reaction, removing the residual succinic acid, and drying the resultant material. The ratio of the number of chemically modified —$NH_2$ groups in the gelatin was 95%.

Gelatin-3:

Gelatin formed by decreasing the molecular weight of gelatin-1 by allowing enzyme to act on it such that the average molecular weight was 15,000, deactivating the enzyme, and drying the resultant material. No —$NH_2$ groups in the gelatin were chemically modified.

By All of gelatin-1 to gelatin-3 described above were deionized and so adjusted that the pH of an aqueous 5% solution at 35° C. was 6.0.

(Preparation of fine solid dispersions of sensitizing dyes used in spectral sensitization of silver halide emulsions)

In the following emulsion preparation, sensitizing dyes used in spectral sensitization were used in the form of fine solid dispersions prepared by a method described in JP-A-11-52507. For example, fine solid dispersions of sensitizing dyes Exs-11, Exs-14, and Exs-15 were prepared by dissolving 0.8 parts by weight of $NaNO_3$ and 3.2 parts by weight of $Na_2SO_4$ in 43 parts by weight of ion-exchanged water, adding a total of 3 parts by weight of the sensitizing dyes Exs-11, Exs-14, and Exs-15 at a molar ratio of 76:18:6, and dispersing the material at 60° C. for 20 min by using a dissolver blade at 2,000 rpm.

(Preparation of emulsion EM-1A)

1,300 mL of an aqueous solution containing 1.0 g of KBr and 1.1 g of gelatin-3 described above was stirred at 35° C. (1st solution preparation). 54 mL of an aqueous solution Ag-1 (containing 3.0 g of $AgNO_3$ in 100 mL), 41 mL of an aqueous solution X-1 (containing 3.2 g of KBr in 100 mL), and 12 mL of an aqueous solution G-1 (containing 4.8 g of gelatin-3 in 100 mL) were added over 30 sec at fixed flow rates by the triple jet method (addition 1). After that, 6.3 g of KBr were added, and the temperature was raised to 75° C. to ripen the material. Immediately before the completion of the ripening, 300 mL of an aqueous solution G-2 (containing 12.7 g of gelatin-2 described above in 100 mL) were added.

157 mL of an aqueous solution Ag-2 (containing 22.1 g of $AgNO_3$ in 100 mL) and an aqueous solution X-2 (containing 15.5 g of KBr in 100 mL) were added over 33 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30 (addition 2).

Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 57 min by the double jet method. During the addition, the flow rate of the aqueous solution Ag-3 was accelerated such that the final flow rate was 1.6 times the initial flow rate, and the aqueous solution X-3 was so added that the pAg of the bulk emulsion solution in the reaction vessel was held at 8.30 (addition 3).

Furthermore, 156 mL of an aqueous solution Ag-4 (containing 32.0 g of $AgNO_3$ in 100 mL) and an aqueous solution X-4 (containing 22.4 g of KBr in 100 mL) were added over 18 min by the double jet method. The addition of the aqueous solution Ag-4 was performed at a fixed flow rate. The addition of the aqueous solution X-4 was so performed that the pAg of the bulk emulsion solution in the reaction vessel was held at 8.30 for the first 9 min and at 6.70 for the remaining 9 min (including the time required to change the pAg) (addition 4).

After that, 0.0025 g of sodium benzenethiosulfonate and 125 mL of an aqueous solution G-3 (containing 12.0 g of gelatin-1 described above in 100 mL) were sequentially added at an interval of 1 min, and the temperature was lowered to 55° C. Subsequently, 11.8 g of KBr were added to adjust the pAg of the bulk emulsion solution in the reaction vessel to 9.35. After that, an AgI fine grain emulsion having an average grain size of 0.009 μm (prepared immediately before addition by mixing an aqueous $AgNO_3$ solution, an aqueous KI solution, and an aqueous solution of gelatin-3 in another chamber having a magnetic coupling induction type stirrer described in JP-A-10-43570) was added in an amount equivalent to 6.95 g of silver nitrate over 1 min 40 sec at a fixed flow rate (addition 5). When ten seconds elapsed from the start of this addition 5,249 mL of the aqueous solution Ag-4 and the aqueous solution X-4 were added by the double jet method. The addition of the aqueous solution Ag-4 was performed at a fixed flow rate over 21 min. The addition of the aqueous solution X-4 was performed only for the first 18 min such that the pAg of the bulk emulsion solution in the reaction vessel was held at 9.35. For the remaining 3 min the aqueous solution X-4 was not added so that the pAg of the bulk emulsion solution in the reaction vessel was finally 9.00 (addition 6). After that, desalting was performed by normal flocculation. Water, NaOH, and gelatin-1 described above were added under stirring, and the pH and the pAg were adjusted to 5.8 and 8.8, respectively, at 56° C.

The resultant emulsion consisted of tabular silver halide grains having an equivalent-sphere diameter of 1.04 μm, an average equivalent-circle diameter of major surfaces of 2.03 μm, an average grain thickness of 0.18 μm, an average aspect ratio of 11.3, an equivalent-circle diameter variation coefficient of 18.7%, and an average AgI content of 3.94 mol %. Parallel major surfaces of the tabular grains were (111) faces. The AgI content on the surfaces of the silver halide grains measured by XPS was 2.8 mol %.

Subsequently, the emulsion was optimally, chemically sensitized by adding sensitizing dyes Exs-11, Exs-14, and Exs-15 presented below at a molar ratio of 76:18:6, and then sequentially adding potassium thiocyanate, chloroauric acid, sodium thiosulfate, and N,N-dimethylselenourea. The chemical sensitization was completed by adding water-soluble mercapto compounds MER-1 and MER-2 presented below at a ratio of 4:1 such that the total amount was $3.6\times10^{-4}$ mol per mol of a silver halide. This emulsion EM-1A was optimally, chemically sensitized when the addition amount of the sensitizing dyes was $6.90\times10^{-4}$ mol per mol of a silver halide.

Exs-1

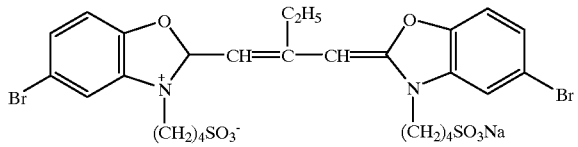

Exs-4

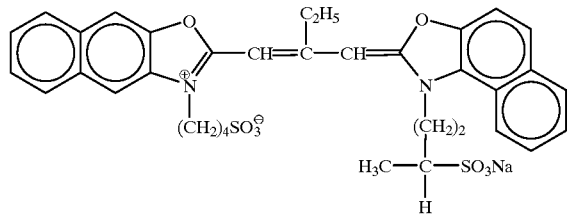

Exs-5

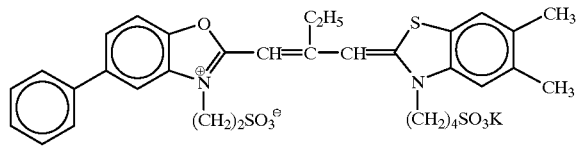

MER-1

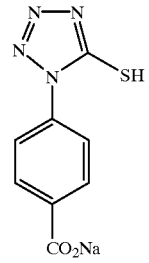

MER-2

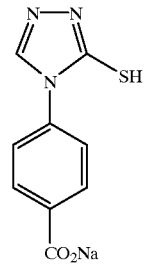

(Preparation of emulsion EM-2A)

An emulsion EM-2A was prepared by changing the preparation conditions of the emulsion EM-1A described above as follows.

① The amounts of the aqueous solutions Ag-1, X-1, and G-1 added in (addition 1) were changed to 29.4, 22.6, and 6.7 mL, respectively.

② The amount of KBr added immediately after (addition 1) was changed to 6.8 g.

③ The times of (addition 2), (addition 3), (addition 4), and (addition 6) were increased 1.22 times, and the addition flow rates were increased 0.82 times accordingly.

The resultant emulsion consisted of tabular silver halide grains having an equivalent-sphere diameter of 1.27 μm, an average equivalent-circle diameter of major surfaces of 2.55 μm, an average grain thickness of 0.21 μm, an average aspect ratio of 12.1, an equivalent-circle diameter variation coefficient of 19.5%, and an average AgI content of 3.94 mol %. Parallel major surfaces of the tabular grains were (111) faces. The AgI content on the surfaces of the silver halide grains measured by XPS was 2.5 mol %.

This emulsion EM-2A was optimally, chemically sensitized when the addition amount of the sensitizing dyes was $5.86\times10^{-4}$ mol per mol of a silver halide.

(Preparation of emulsion EM-3A)

An emulsion EM-3A was prepared by changing the preparation conditions of the emulsion EM-1A described above as follows.

① The amounts of the aqueous solutions Ag-1, X-1, and G-1 added in (addition 1) were changed to 19.2, 6.4, and 4.4 mL, respectively.

② The amount of KBr added immediately after (addition 1) was changed to 7.5 g.

③ The times of (addition 2), (addition 3), (addition 4), and (addition 6) were increased 1.42 times, and the addition flow rates were increased 0.7 times accordingly.

The resultant emulsion consisted of tabular silver halide grains having an equivalent-sphere diameter of 1.47 μm, an average equivalent-circle diameter of major surfaces of 3.02 μm, an average grain thickness of 0.23 μm, an average aspect ratio of 13.1, an equivalent-circle diameter variation coefficient of 20.0%, and an average AgI content of 3.94 mol %. Parallel major surfaces of the tabular grains were (111) faces. The AgI content on the surfaces of the silver halide grains measured by XPS was 2.3 mol %. In this emulsion, 50% or more of the total projected area were accounted for by tabular silver halide grains having an equivalent-circle diameter of major surfaces of 3.5 μm or more and a grain thickness of 0.25 μm or less.

This emulsion EM-3A was optimally, chemically sensitized when the addition amount of the sensitizing dyes was $5.30\times10^{-4}$ mol per mol of a silver halide.

(Preparation of emulsion EM-4A)

An emulsion EM-4A was prepared by changing the preparation conditions of the emulsion EM-1A described above as follows.

① The amounts of the aqueous solutions Ag-1, X-1, and G-1 added in (addition 1) were changed to 14.0, 12.3, and 3.7 mL, respectively.

② The amount of KBr added immediately after (addition 1) was changed to 8.6 g.

③ The times of (addition 2), (addition 3), (addition 4), and (addition 6) were increased 1.59 times, and the addition flow rates were increased 0.63 times accordingly.

The resultant emulsion consisted of tabular silver halide grains having an equivalent-sphere diameter of 1.62 μm, an average equivalent-circle diameter of major surfaces of 3.45 μm, an average grain thickness of 0.24 μm, an average aspect ratio of 14.4, an equivalent-circle diameter variation coefficient of 20.5%, and an average AgI content of 3.94 mol %. Parallel major surfaces of the tabular grains were (111) faces. The AgI content on the surfaces of the silver halide grains measured by XPS was 2.0 mol %. In this emulsion, 50% or more of the total projected area were accounted for by tabular silver halide grains having an equivalent-circle diameter of major surfaces of 3.5 μm or more and a grain thickness of 0.25 μm or less.

This emulsion EM-4A was optimally, chemically sensitized when the addition amount of the sensitizing dyes was $5.05\times10^{-4}$ mol per mol of a silver halide.

(Preparation of emulsion EM-5A)

An emulsion EM-5A was prepared by changing the preparation conditions of the emulsion EM-3A described above as follows.

① Gelatin in the aqueous solution G-2 added immediately before (addition 2) was changed to gelatin-1.

② The pAg of the initial bulk emulsion solutions in (addition 2), (addition 3), and (addition 4) was changed to 7.75.

The resultant emulsion consisted of tabular silver halide grains having an equivalent-sphere diameter of 1.47 μm, an average equivalent-circle diameter of major surfaces of 2.14 μm, an average grain thickness of 0.46 μm, an average aspect ratio of 4.7, an equivalent-circle diameter variation coefficient of 16.0%, and an average AgI content of 3.94 mol %. Parallel major surfaces of the tabular grains were (111) faces. The AgI content on the surfaces of the silver halide grains measured by XPS was 1.7 mol %.

This emulsion EM-5A was optimally, chemically sensitized when the addition amount of the sensitizing dyes was $3.30\times10^{-4}$ mol per mol of a silver halide.

(Preparation of emulsion EM-6A)

An emulsion EM-6A was prepared by changing the preparation conditions of the emulsion EM-3A described above as follows.

① Gelatin in the aqueous solution G-2 added immediately before (addition 2) was changed to gelatin-1.

② The pAg of the initial bulk emulsion solutions in (addition 2), (addition 3), and (addition 4) was changed to 7.95.

The resultant emulsion consisted of tabular silver halide grains having an equivalent-sphere diameter of 1.47 μm, an average equivalent-circle diameter of major surfaces of 2.60 μm, an average grain thickness of 0.31 μm, an average aspect ratio of 8.4, an equivalent-circle diameter variation coefficient of 17.8%, and an average AgI content of 3.94 mol %. Parallel major surfaces of the tabular grains were (111) faces. The AgI content on the surfaces of the silver halide grains measured by XPS was 1.9 mol %.

This emulsion EM-6A was optimally, chemically sensitized when the addition amount of the sensitizing dyes was $4.24\times10^{-4}$ mol per mol of a silver halide.

(Preparation of emulsion EM-7A)

An emulsion EM-7A was prepared by changing the preparation conditions of the emulsion EM-3A described above as follows.

① The amount of the aqueous solution G-2 added immediately before (addition 2) was changed to 180 mL.

② The pAg of the initial bulk emulsion solutions in (addition 2), (addition 3), and (addition 4) was changed to 8.35.

The resultant emulsion consisted of tabular silver halide grains having an equivalent-sphere diameter of 1.47 μm, an average equivalent-circle diameter of major surfaces of 3.74 μm, an average grain thickness of 0.15 μm, an average aspect ratio of 24.9, an equivalent-circle diameter variation coefficient of 23.2%, and an average AgI content of 3.94 mol %. Parallel major surfaces of the tabular grains were (111) faces. The AgI content on the surfaces of the silver halide grains measured by XPS was 2.7 mol %. In this emulsion, 50% or more of the total projected area were accounted for by tabular silver halide grains having an equivalent-circle diameter of major surfaces of 3.5 μm or more and a grain thickness of 0.15 μm or less.

This emulsion EM-7A was optimally, chemically sensitized when the addition amount of the sensitizing dyes was $7.62\times10^{-4}$ mol per mol of a silver halide.

(Preparation of emulsion EM-8A)

An emulsion EM-8A was prepared by changing the preparation conditions of the emulsion EM-3A described above as follows.

① The amount of the aqueous solution G-2 added immediately before (addition 2) was changed to 100 mL.

② The pAg of the initial bulk emulsion solutions in (addition 2), (addition 3), and (addition 4) was changed to 8.45.

③ The time during which the pAg of the bulk emulsion solution in the last half of (addition 4) was held at 6.7 was halved, and, to compensate for this reduced addition time, the time during which the pAg of the bulk emulsion solution in the initial stages of (addition 4) was held at 8.45 was increased.

The resultant emulsion consisted of tabular silver halide grains having an equivalent-sphere diameter of 1.47 μm, an average equivalent-circle diameter of major surfaces of 4.65 μm, an average grain thickness of 0.097 μm, an average aspect ratio of 47.9, an equivalent-circle diameter variation coefficient of 29.8%, and an average AgI content of 3.94 mol %. Parallel major surfaces of the tabular grains were (111) faces. The AgI content on the surfaces of the silver halide grains measured by XPS was 3.3 mol %. In this emulsion, 50% or more of the total projected area were accounted for by tabular silver halide grains having an equivalent-circle diameter of major surfaces of 3.5 μm or more and a grain thickness of 0.10 μm or less.

This emulsion EM-8A was optimally, chemically sensitized when the addition amount of the sensitizing dyes was $1.12\times10^{-3}$ mol per mol of a silver halide.

(Preparation of emulsions EM-1B to EM-8B)

Emulsions EM-1B to EM-8B were prepared by changing the preparation conditions of the emulsions EM-1A to EM-8A described above as follows.

① A step of adding 0.002 g of thiourea dioxide was added immediately before (addition 2) and immediately after the addition of the aqueous solution G-2.

(Preparation of emulsions EM-1C to EM-8C)

Emulsions EM-1C to EM-8C were prepared by changing the preparation conditions of the emulsions EM-1A to EM-8A described above as follows.

① A step of sequentially adding 2.1 g of disodium 4,5-dihydroxy-1,3-benzenesulfonate monohydrate (a compound equivalent to formula II-1 described in this specification) and 0.002 g of thiourea dioxide at an interval of 1 min was added immediately before (addition 2) and immediately after the addition of the aqueous solution G-2.

The emulsions EM-1A to EM-8A, EM-1B to EM-8B, and EM-1C to EM-8C were observed at a liquid nitrogen temperature by using a 400-kV transmission electron microscope. Consequently, 20 or more dislocation lines were present in each grain, and these dislocation lines localized in the vicinities of corners of a tabular grain.

Also, the emulsions EM-1C to EM-8C were given a positive hole capturing zone inside a silver halide grain by intentionally performing reduction sensitization by adding disodium 4,5-dihydroxy-1,3-benzenesulfonate monohydrate and thiourea dioxide immediately before (addition 2) in the emulsion preparation process. Although intentional reduction sensitization was also performed for the emulsions EM-1B to EM-8B by adding thiourea dioxide immediately before (addition 2), the optimum conditions of giving a positive hole capturing zone described in the text of the present invention were not met.

Furthermore, the emulsions EM-1A to EM-8A, EM-1B to EM-8B, and EM-1C to EM-8C described above were spectrally sensitized by adding the sensitizing dyes in the chemical sensitization step during the process of emulsion preparation. This made these emulsions green-sensitive silver halide emulsions whose spectral sensitivity was a maximum at a wavelength of 550 nm.

A cellulose triacetate film support having an undercoat layer was coated with the emulsions EM-1A to EM-8A, EM-1B to EM-8B, and EM-1C to EM-8C under the same coating conditions as in Example 1.

The resultant samples were subjected to film hardening for 14 hr at 40° C. and a relative humidity of 70%. After that, the samples were exposed for 1/100 sec through the SC-50 gelatin filter (a long-wavelength light transmitting filter having a cutoff wavelength of 500 nm) manufactured by Fuji Photo Film Co., Ltd. and through a continuous wedge, and developed following the same procedure as in Example 1 (except that the processing time of color development was changed to 2 min 45 sec). The photographic properties of each processed sample was evaluated by measuring the density by a green filter.

The attributes of the coated emulsions and the results of evaluation of the photographic properties are shown in Tables 9 and 10 below. The sensitivity is indicated by the relative value of the reciprocal of an exposure amount required to reach a density of fog density plus 0.2. (The sensitivity of the emulsion EM-1A is 100).

TABLE 9

| Sample No. | Equivalent-sphere diameter (μm) | Equivalent-circle diameter (μm) of major surface | Grain thickness (μm) | Surface area* per silver halide grain | Intentional reduction sensitization (using thiourea dioxide) |
|---|---|---|---|---|---|
| EM-1A (Comparative example) | 1.04 | 2.03 | 0.18 | 100 | Not performed |
| -2A (Comparative example) | 1.27 | 2.55 | 0.21 | 155 | Not performed |
| -3A (Present invention) | 1.47 | 3.02 | 0.23 | 216 | Not performed |
| -4A (Present invention) | 1.62 | 3.45 | 0.24 | 276 | Not performed |
| -5A (Comparative example) | 1.47 | 2.14 | 0.46 | 135 | Not performed |
| -6A (Comparative | 1.47 | 2.60 | 0.31 | 173 | Not performed |

TABLE 9-continued

| | | | | | |
|---|---|---|---|---|---|
| example) | | | | | |
| -7A (Present invention) | 1.47 | 3.74 | 0.15 | 311 | Not performed |

| Sample No. | Addition of disodium 4,5-dihyroxybenzene-1,3-disulfonate monohydrate | Sensitizing dye addition amount (mol/mol of silver halide) | Silver iodide content (mol %) on silver halide surface | Sensitivity |
|---|---|---|---|---|
| EM-1A (Comparative example) | Not added | $6.90 \times 10^{-4}$ | 2.8 | 100 |
| -2A (Comparative example) | Not added | $5.86 \times 10^{-4}$ | 2.5 | 148 |
| -3A (Present invention) | Not added | $5.30 \times 10^{-4}$ | 2.3 | 171 |
| -4A (Present invention) | Not added | $5.05 \times 10^{-4}$ | 2.0 | 201 |
| -5A (Comparative example) | Not added | $3.30 \times 10^{-4}$ | 1.7 | 133 |
| -6A (Comparative example) | Not added | $4.24 \times 10^{-4}$ | 1.9 | 163 |
| -7A (Present invention) | Not added | $7.62 \times 10^{-4}$ | 2.7 | 218 |

| Sample No. | Equivalent-sphere diameter (μm) | Equivalent-circle diameter (μm) of major surface | Grain thickness (μm) | Surface area* per silver halide grain | Intentional reduction sensitization (using thiourea dioxide) |
|---|---|---|---|---|---|
| EM-8A (Present invention) | 1.47 | 4.65 | 0.097 | 463 | Not performed |
| -1B (Comparative example) | 1.04 | 2.03 | 0.18 | 100 | Performed |
| -2B (Comparative example) | 1.27 | 2.55 | 0.21 | 155 | Performed |
| -3B (Present invention) | 1.47 | 3.02 | 0.23 | 216 | Performed |
| -4B (Present invention) | 1.62 | 3.45 | 0.24 | 276 | Performed |

| Sample No. | Addition of disodium 4,5-dihyroxybenzene-1,3-disulfonate monohydrate | Sensitizing dye addition amount (mol/mol of silver halide) | Silver iodide content (mol %) on silver halide surface | Sensitivity |
|---|---|---|---|---|
| EM-8A (Present invention) | Not added | $1.12 \times 10^{-3}$ | 3.3 | 250 |
| -1B (Comparative example) | Not added | $6.90 \times 10^{-4}$ | 2.8 | 117 |
| -2B (Comparative example) | Not added | $5.86 \times 10^{-4}$ | 2.5 | 173 |
| -3B (Present invention) | Not added | $5.30 \times 10^{-4}$ | 2.3 | 199 |
| -4B (Present invention) | Not added | $5.05 \times 10^{-4}$ | 2.0 | 235 |

| | Equivalent- | Equivalent-circle | | Surface | Intentional reduction |
|---|---|---|---|---|---|

TABLE 9-continued

| Sample No. | sphere diameter (μm) | diameter (μm) of major surface | Grain thickness (μm) | area* per silver halide grain | sensitization (using thiourea dioxide) |
|---|---|---|---|---|---|
| EM-5B (Comparative example) | 1.47 | 2.14 | 0.46 | 135 | Performed |
| -6B (Comparative example) | 1.47 | 2.60 | 0.31 | 173 | Performed |
| -7B (Present invention) | 1.47 | 3.74 | 0.15 | 311 | Performed |
| -8B (Present invention) | 1.47 | 4.65 | 0.097 | 463 | Performed |
| EM-1C (Comparative example) | 1.04 | 2.03 | 0.18 | 100 | Not performed |
| -2C (Comparative example) | 1.27 | 2.55 | 0.21 | 155 | Not performed |
| -3C (Present invention) | 1.47 | 3.02 | 0.23 | 216 | Not performed |

| Sample No. | Addition of disodium 4,5-dihyroxybenzene-1,3-disulfonate monohydrate | Sensitizing dye addition amount (mol/mol of silver halide) | Silver iodide content (mol %) on silver halide surface | Sensitivity |
|---|---|---|---|---|
| EM-5B (Comparative example) | Not added | $3.30 \times 10^{-4}$ | 1.7 | 155 |
| -6B (Comparative example) | Not added | $4.24 \times 10^{-4}$ | 1.9 | 192 |
| -7B (Present invention) | Not added | $7.62 \times 10^{-4}$ | 2.7 | 253 |
| -8B (Present invention) | Not added | $1.12 \times 10^{-4}$ | 3.3 | 295 |
| EM-1C (Comparative example) | Added | $6.90 \times 10^{-4}$ | 2.8 | 125 |
| -2C (Comparative example) | Added | $5.86 \times 10^{-4}$ | 2.5 | 190 |
| -3C (Present invention) | Added | $5.30 \times 10^{-4}$ | 2.3 | 255 |

| Sample No. | Equivalent-sphere diameter (μm) | Equivalent-circle diameter (μm) of major surface | Grain thickness (μm) | Surface area* per silver halide grain | Intentional reduction sensitization (using thiourea dioxide) |
|---|---|---|---|---|---|
| EM-4C (Present invention) | 1.62 | 3.45 | 0.24 | 276 | Not performed |
| -5C (Comparative example) | 1.47 | 2.14 | 0.46 | 135 | Not performed |
| -6C (Comparative example) | 1.47 | 2.60 | 0.31 | 173 | Not performed |
| -7B (Present invention) | 1.47 | 3.74 | 0.15 | 311 | Not performed |
| -8C (Present invention) | 1.47 | 4.65 | 0.097 | 463 | Not performed |

| | Addition of disodium 4,5-dihyroxybenzene- | Sensitizing dye addition amount | Silver iodide content (mol %) |
|---|---|---|---|

TABLE 9-continued

| Sample No. | 1,3-disulfonate monohydrate | (mol/mol of silver halide) | on silver halide surface | Sensitivity |
|---|---|---|---|---|
| EM-4C (Present invention) | Added | $5.05 \times 10^{-4}$ | 2.0 | 307 |
| -5C (Comparative example) | Added | $3.30 \times 10^{-4}$ | 1.7 | 167 |
| -6C (Comparative example) | Added | $4.24 \times 10^{-4}$ | 1.9 | 212 |
| -7B (Present invention) | Added | $7.62 \times 10^{-4}$ | 2.7 | 337 |
| -8C (Present invention) | Added | $1.12 \times 10^{-3}$ | 3.3 | 485 |

*A relative value by assuming that the surface area per silver halide grain of the emulsion EM-1A is 100.

The following is evident from the results shown in the above tables. One is that when the equivalent-circle diameter of tabular silver halide grains is increased, inefficiency occurs in a region where this equivalent-circle diameter is 3.5 μm or more, so it is difficult to obtain a sensitivity rise corresponding to the increase in light absorption expected by increases in the grain surface area and sensitizing dye amount. Silver halide emulsions having a positive hole capturing zone of the present invention had a much smaller inefficiency and a higher absolute value of sensitivity than those of comparative silver halide emulsions having no such positive hole capturing zone.

EXAMPLE 7

This example shows that a positive hole capturing zone of the present invention is given by a method of performing intentional reduction sensitization only in a region near the surface of a silver halide grain.

(Preparation of emulsion EM-3D)

An emulsion EM-3D was prepared by changing the preparation method of the emulsion EM-3A in the above example as follows.

A step of adding $3.5\times10^{-5}$ g of dimethylamineborane per mol of a silver halide and performing ripening for 30 min was added immediately before the addition of the sensitizing dyes in the chemical sensitization step.

(Preparation of emulsion EM-3E)

An emulsion EM-3E was prepared by changing the preparation method of the emulsion EM-3A in the above example as follows.

A step of adding 0.002 g of sodium benzenethiosulfonate and $3.5\times10^{-5}$ g of dimethylamineborane per mol of a silver halide and performing ripening for 30 min was added immediately before the addition of the sensitizing dyes in the chemical sensitization step.

A support was coated with the above emulsions EM-3D and EM-3E and the emulsion EM-3A in Example 6 following the same procedure as in Example 1, and the photographic properties were evaluated. Of the three emulsions, EM-3A was an emulsion not subjected to intentional reduction sensitization. EM-3D was an emulsion subjected to intentional reduction sensitization by ripening after the addition of dimethylamineborane but not meeting the conditions of giving a preferable positive hole capturing zone described previously in the text of the present invention. EM-3E was an emulsion given a preferable positive hole capturing zone by adding sodium benzenethiosulfonate as an oxidizer for silver, in addition to dimethylamineborane, and performing ripening.

The results of the photographic properties are shown in Table 10. The emulsion EM-3D subjected to intentional reduction sensitization but not meeting the conditions of giving a preferable positive hole capturing zone described earlier in the text of the present invention had sensitivity almost equal to that of the emulsion EM-3A, indicating almost no effect of intentional reduction sensitization. In contrast, the emulsion EM-3E meeting the conditions of giving a preferable positive hole capturing zone had much higher sensitivity than that of the emulsion EM-3A; the sensitivity was close to that of the emulsion EM-3C in Example 6. That is, a positive hole capturing zone of the present invention was substantially given, so the effect of the present invention was achieved.

TABLE 10

| Sample No. | Equivalent-sphere diameter (μm) | Equivalent-circle diameter (μm) of major surface | Grain thickness (μm) | Surface area * per silver halide grain | Intentional reduction sensitization (using dimethylamineborane) |
|---|---|---|---|---|---|
| EM-3A (Present invention) | 1.47 | 3.02 | 0.23 | 216 | Not performed |
| -3D (Present | 1.47 | 3.02 | 0.23 | 216 | Performed |

TABLE 10-continued

| | | | | | |
|---|---|---|---|---|---|
| invention) -3E (Present invention) | 1.47 | 3.02 | 0.23 | 216 | Performed |

| Sample No. | Addition of oxidizer (sodium benzenethiosulfonate) for silver | Sensitizing dye addition amount (mol/mol of silver halide) | Silver iodide content (mol %) on silver halide surface | Sensitivity |
|---|---|---|---|---|
| EM-3A (Present invention) | Not added | $5.30 \times 10^{-4}$ | 2.3 | 171 |
| -3D (Present invention) | Not added | $5.30 \times 10^{-4}$ | 2.3 | 188 |
| -3E (Present invention) | Added | $5.30 \times 10^{-4}$ | 2.3 | 246 |

*A relative value by assuming that the surface area per silver halide grain of the emulsion EM-1A is 100.

EXAMPLE 8

This example shows what influence the silver iodide content on the surface of a silver halide grain has upon the sensitivity and storage stability of an emulsion of the present invention.

Emulsions EM-3C-1 to EM-3C-5 differing in silver iodide content on the grain surface were prepared by adding a step of performing ripening for 30 min by adding a silver bromide fine grain emulsion having an average grain size of 0.055 μm or a silver iodide fine grain emulsion having an average grain size of 0.047 μm, immediately before the addition of the sensitizing dyes in the chemical sensitization step of the manufacturing method of the emulsion EM-3C in Example 6. The addition amount of the silver bromide fine grain emulsion or silver iodide fine grain emulsion per mol of a silver halide emulsion and the silver iodide content on the grain surface measured by XPS of each of the emulsions EM-3C-1 to EM-3C-5 are as follows.

Emulsion EM-3C-1:

0.0030 mol of fine silver bromide grains,

Surface silver iodide content=0.8 mol %

Emulsion EM-3C-2:

0.0015 mol of fine silver bromide grains,

Surface silver iodide content=1.3 mol %

Emulsion EM-3C-3:

No addition (emulsion EM-3C itself),

Surface silver iodide content=2.3 mol %

Emulsion EM-3C-4:

0.0015 mol of fine silver iodide grains,

Surface silver iodide content=4.5 mol %

Emulsion EM-3C-5:

0.0030 mol of fine silver iodide grains,

Surface silver iodide content=5.8 mol %

A support was coated with the above emulsions EM-3C-1 to EM-3C-5 following the same procedure as in Example 1, and the photographic properties and storage stability of each sample were evaluated. The storage stability was evaluated by aging each emulsion coated sample at 50° C. and 60% RH for 8 days and examining the magnitude of the rise of fog. The smaller the rise of fog, the higher the storage stability. Of the above emulsions, EM-3C-1 did not meet the requirement in claim 5 of the present invention, i.e., the silver iodide content on the grain surface was smaller than 0.3×3.94 mol % of the average silver iodide content of the whole grain. Conversely, EM-3C-5 did not meet the requirement in claim 4 of the present invention because the silver iodide content on the grain surface exceeded 5 mol %. The other emulsions EM-3C-2 to EM-3C-4 met both requirements in claims 4 and 5 of the present invention.

Table 11 shows the results of the photographic properties. Of the above emulsions, the sensitivity of EM-3C-1 was low because the silver iodide content on the grain surface was too low. In contrast, the sensitivity and storage stability of EM-3C-5 were low because the silver iodide content on the grain surface was too high. EM-3C-2 to EM-3C-4 meeting both requirements in claims 4 and 5 of the present invention maintained high sensitivity and high storage stability.

Emulsions were prepared by changing the silver iodide content on the grain surface of the emulsion EM-8C in Example 6 by the same method as above, or by changing the silver iodide content on the grain surface by changing the total addition amount of the silver iodide fine grain emulsion having an average grain size of 0.009 μm added in (addition 5) in the manufacturing method of EM-3C in Example 6, and were evaluated as above. Consequently, results similar to those described above were obtained.

TABLE 11

| Sample No. | Correspondence to claim 4 of present invention | Correspondence to claim 5 of present invention | Equivalent-sphere diameter (μm) | Equivalent-circle diameter (μm) of major surface | Grain thickness (μm) | Intentional reduction sensitization (using thiourea dioxide) |
|---|---|---|---|---|---|---|

TABLE 11-continued

| | | | | | | |
|---|---|---|---|---|---|---|
| EM-3C-1 | Corresponds | Does not correspond | 1.47 | 3.02 | 0.23 | Performed |
| -3C-2 | Corresponds | Corresponds | 1.47 | 3.02 | 0.23 | Performed |
| -3C-3 | Corresponds | Corresponds | 1.47 | 3.02 | 0.23 | Performed |
| -3C-4 | Corresponds | Corresponds | 1.47 | 3.02 | 0.23 | Performed |
| -3C-5 | Does not correspond | Does not correspond | 1.47 | 3.02 | 0.23 | Performed |

| Sample No. | Addition of disodium 4,5-dihyroxybenzene-1,3-disulfonate monohydrate | Average silver iodide content (mol %) of silver halide grains | Silver iodide content (mol %) on silver halide surface | Sensitivity | Rise of fog density after aging at 50° C. and 60% RH for 8 days |
|---|---|---|---|---|---|
| EM-3C-1 | Added | 3.94 | 0.8 | 225 | 0.08 |
| -3C-2 | Added | 3.94 | 1.3 | 250 | 0.10 |
| -3C-3 | Added | 3.94 | 2.3 | 255 | 0.13 |
| -3C-4 | Added | 3.94 | 4.5 | 253 | 0.15 |
| -3C-5 | Added | 3.94 | 5.8 | 230 | 0.35 |

*All emulsion samples in this table are emulsions corresponding to the present invention.

EXAMPLE 9

This example shows the effect of allowing a silver halide emulsion of the present invention to contain calcium ions or magnesium ions.

Emulsion samples were prepared by changing the contents of calcium ions and magnesium ions, as shown in Table 12, of the emulsions EM-3A, EM-5A, EM-6A, EM-7A, EM-8A, EM-3C, EM-5C, EM-6C, EM-7C, and EM-8C in Example 6, and the sensitivity and graininess of each sample were evaluated. Note that calcium ions were added in the form of calcium nitrate and magnesium ions were added in the form of magnesium nitrate. These ions were added after the addition of the sensitizing dyes in the chemical sensitization step was completed and immediately before the addition of the chemical sensitizers. Since the progress of the chemical sensitization was delayed by the addition of the calcium ions or magnesium ions, the time of the chemical sensitization step was prolonged to compensate for this delay.

Note that the equivalent-sphere diameter of silver halide grains in all of these emulsions was 1.47 $\mu$m, so these emulsions were supposed to have substantially equal graininess when only the grain volume is considered as a factor.

The sensitivity was evaluated following the same procedure as in Example 1. Table 12 shows the relative value of the sensitivity of each emulsion by assuming that the sensitivity of the emulsion EM-1A in Example 6 is 100. The graininess is indicated by the relative value of graininess at a density of 0.1 by assuming that the RMS value of the emulsion EM-3A is 100.

The results of the above evaluations are shown in Table 12. As in Table 12, the RMS value decreased and the graininess improved when calcium ions or magnesium ions were added in an amount recommended by the present invention to silver halide emulsions of the present invention. Emulsions of the present invention realized high sensitivity by increasing the equivalent-circle diameter of major surfaces and also increasing the surface area. However, the graininess of emulsions slightly degraded. This drawback was eliminated by the addition of calcium ions or magnesium ions to an emulsion. The graininess of an emulsion that was not an emulsion of the present invention also improved by the addition of calcium ions or magnesium ions, but the effect of the addition was small.

TABLE 12

| Sample No. | No. of emulsion manufacturing method as a basis *1 | content (ppm/emulsion of calcium (Ca) ions or magnesium (Mg) ions | Equivalent-sphere diameter ($\mu$m) | Equivalent-circle diameter ($\mu$m) of major surface | Grain thickness ($\mu$m) |
|---|---|---|---|---|---|
| 401 | EM-3A (Present invention) | Both Ca and Mg < 5 | 1.47 | 3.02 | 0.23 |
| 402 | -5A (Comparative example) | Both Ca and Mg < 5 | 1.47 | 2.14 | 0.46 |
| 403 | -6A (Comparative example) | Both Ca and Mg < 5 | 1.47 | 2.60 | 0.31 |
| 404 | -7A (Present invention) | Both Ca and Mg < 5 | 1.47 | 3.74 | 0.15 |
| 405 | -8A (Present invention) | Both Ca and Mg < 5 | 1.47 | 4.65 | 0.097 |
| 406 | -3C | Both Ca and Mg < 5 | 1.47 | 3.02 | 0.23 |

TABLE 12-continued

| | (Present invention) | | | | |
|---|---|---|---|---|---|
| Sample No. | Surface area per silver halide grain *2 | Intentional reduction sensitization (using thiourea dioxide) | Addition of disodium 4,5-dihydroxybenzene-1,3-disulfonte monohydrate | Sensitivity | RMS granularity |
| 401 | 216 | Not performed | Not added | 171 | 100 |
| 402 | 135 | Not performed | Not added | 133 | 96 |
| 403 | 173 | Not performed | Not added | 163 | 98 |
| 404 | 311 | Not performed | Not added | 218 | 105 |
| 405 | 463 | Not performed | Not added | 250 | 110 |
| 406 | 216 | Performed | Added | 255 | 110 |

| Sample No. | No. of emulsion manufacturing method as a basis *1 | content (ppm/emulsion of calcium (Ca) ions or magnesium (Mg) ions | Equivalent-sphere diameter (μm) | Equivalent-circle diameter (μm) of major surface | Grain thickness (μm) |
|---|---|---|---|---|---|
| 407 | -5C (Comparative example) | Both Ca and Mg < 5 | 1.47 | 2.14 | 0.46 |
| 408 | -6C (Comparative example) | Both Ca and Mg < 5 | 1.47 | 2.60 | 0.31 |
| 409 | -7C (Present invention) | Both Ca and Mg < 5 | 1.47 | 3.74 | 0.15 |
| 410 | -8C (Present invention) | Both Ca and Mg < 5 | 1.47 | 4.65 | 0.097 |

| Sample No. | Surface area per silver halide grain *2 | Intentional reduction sensitization (using thiourea dioxide) | Addition of disodium 4,5-dihydroxybenzene-1,3-disulfonte monohydrate | Sensitivity | RMS granularity |
|---|---|---|---|---|---|
| 407 | 135 | Performed | Added | 167 | 102 |
| 408 | 173 | Performed | Added | 212 | 104 |
| 409 | 311 | Performed | Added | 337 | 116 |
| 410 | 463 | Performed | Added | 485 | 121 |

*1 Refer to Example 6

*2 A relative value by assuming that the surface area per silver halide grain of the emulsion EM-1A in Example 6 is 100

| Sample No. | No. of emulsion manufacturing method as a basis *1 | content (ppm/emulsion of calcium (Ca) ions or magnesium (Mg) ions | Equivalent-sphere diameter (μm) | Equivalent-circle diameter (μm) of major surface | Grain thickness (μm) |
|---|---|---|---|---|---|
| 411 | EM-3A (Present invention) | Ca 1500 | 1.47 | 3.02 | 0.23 |
| 412 | -5A (Comparative example) | Ca 1500 | 1.47 | 2.14 | 0.46 |
| 413 | -6A (Comparative example) | Ca 1500 | 1.47 | 2.60 | 0.31 |
| 414 | -7A (Present invention) | Ca 1500 | 1.47 | 3.74 | 0.15 |
| 415 | -8A (Present invention) | Ca 1500 | 1.47 | 4.65 | 0.097 |
| 416 | -3C (Present invention) | Ca 250 | 1.47 | 3.02 | 0.23 |
| 417 | -3C (Present invention) | Ca 600 | 1.47 | 3.02 | 0.23 |
| 418 | -3C (Present invention) | Ca 1500 | 1.47 | 3.02 | 0.23 |

TABLE 12-continued

| Sample No. | Surface area per silver halide grain *2 | Intentional reduction sensitization (using thiourea dioxide) | Addition of disodium 4,5-dihydroxybenzene-1,3-disulfonte monohydrate | Sensitivity | RMS granularity |
|---|---|---|---|---|---|
| 411 | 216 | Not performed | Not added | 170 | 99 |
| 412 | 135 | Not performed | Not added | 133 | 96 |
| 413 | 173 | Not performed | Not added | 162 | 97 |
| 414 | 311 | Not performed | Not added | 217 | 103 |
| 415 | 463 | Not performed | Not added | 257 | 107 |
| 416 | 216 | Performed | Added | 254 | 110 |
| 417 | 216 | Performed | Added | 255 | 103 |
| 418 | 216 | Performed | Added | 254 | 99 |

| Sample No. | No. of emulsion manufacturing method as a basis *1 | content (ppm/emulsion of calcium (Ca) ions or magnesium (Mg) ions | Equivalent-sphere diameter (μm) | Equivalent-circle diameter (μm) of major surface | Grain thickness (μm) |
|---|---|---|---|---|---|
| 419 | -3C (Present invention) | Mg 100 | 1.47 | 3.02 | 0.23 |
| 420 | -3C (Present invention) | Mg 1500 | 1.47 | 3.02 | 0.23 |
| 421 | -5C (Comparative example) | Ca 1500 | 1.47 | 2.14 | 0.46 |
| 422 | -6C (Comparative example) | Ca 1500 | 1.47 | 2.60 | 0.31 |
| 423 | -5C (Present invention) | Ca 1500 | 1.47 | 3.74 | 0.15 |
| 424 | -5C (Present invention) | Ca 1500 | 1.47 | 4.65 | 0.097 |

| Sample No. | Surface area per silver halide grain *2 | Intentional reduction sensitization (using thiourea dioxide) | Addition of disodium 4,5-dihydroxybenzene-1,3-disulfonte monohydrate | Sensitivity | RMS granularity |
|---|---|---|---|---|---|
| 419 | 216 | Performed | Added | 254 | 104 |
| 420 | 216 | Performed | Added | 253 | 101 |
| 421 | 135 | Performed | Added | 165 | 100 |
| 422 | 173 | Performed | Added | 211 | 102 |
| 423 | 311 | Performed | Added | 336 | 105 |
| 424 | 463 | Performed | Added | 482 | 109 |

*1 Refer to Example 1

*2 A relative value by assuming that the surface area per silver halide grain of the emulsion EM-1A in Example 1 is 100

EXAMPLE 10

This example shows the effect, presented in claim 14, of using both water-soluble mercaptotetrazole and water-soluble mercaptotriazole in a silver halide emulsion of the present invention.

Emulsions were prepared following the same procedures as for the emulsion EM-7C in Example 6 except that the mercapto compounds MER-1 and MER-2 added at the end of the chemical sensitization were changed to mercapto compounds as shown in Table 13 below. The sensitivity and storage stability of each emulsion sample were evaluated.

The sensitivity and storage stability were evaluated following the same procedures as in Example 8.

TABLE 13

| Sample No. | No. of emulsion manufacturing method as a basis *1 | Correspondence to claim 14 of present invention | Added mercapto compound | Addition amount (mol/mol of silver halide) of mercapto compound in left column | Sensitivity | Rise of fog density after aging at 50° C. and 60% RH for 8 days |
|---|---|---|---|---|---|---|
| 501 | EM-7C (Present invention) | Corresponds | MER-1 *2<br>MER-2 | $2.88 \times 10^{-4}$<br>$0.72 \times 10^{-4}$ | 337 | 0.17 |
| 502 | EM-7C (Present invention) | Does not correspond | MER-1 | $3.60 \times 10^{-4}$ | 335 | 0.24 |
| 503 | EM-7C (Present invention) | Does not correspond | MER-1 | $5.00 \times 10^{-4}$ | 316 | 0.18 |
| 504 | EM-7C (Present invention) | Does not correspond | MER-2 | $3.60 \times 10^{-4}$ | 230 | 0.13 |
| 505 | EM-7C (Present invention) | Does not correspond | MER-2 | $1.44 \times 10^{-4}$ | 325 | 0.21 |
| 506 | EM-7C (Present invention) | Does not correspond | MER-1<br>STO-A | $2.88 \times 10^{-4}$<br>$0.72 \times 10^{-4}$ | 304 | 0.19 |

*1 Refer to Example 6

*2 MER-1 and MER-2 in this table are water-soluble mercapto compounds corresponding to formulas (I-1) and (I-2), respectively, in claim 14 of the present invention.

Comparative compound STO-A (a compound described in JP-A-4-16838)

Comparative compound STO-A

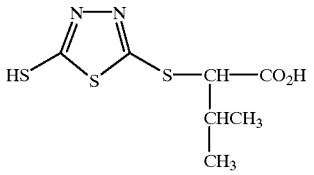

As shown in Table 13, when a mercaptotetrazole compound of formula I-1 and a mercaptotriazole compound of formula I-2 recommended in claim 14 of the present invention were used jointly, the increase in fog during storage was smaller and the sensitivity was equal to or higher than when mercapto compounds were used by known methods (when a mercaptotetrazole compound was used singly or when a mercaptotetrazole compound and a mercaptothiadiazole compound described in JP-A-4-16838 were used jointly).

EXAMPLE 11

The silver halide emulsions prepared in Examples 6 to 10 were introduced to the 11th layer (high-speed green-sensitivity emulsion layer) of the color negative multilayered sensitized material in Example 4, and the sensitivity and storage stability were evaluated. Consequently, relative relationships between the individual emulsion samples were substantially identical with those in Examples 6 to 10. This indicates that the effects of the present invention are achieved even in the system of a color negative multilayered sensitized material.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion, wherein a variation coefficient of equivalent-circle diameters of all grains is not more than 40%, and not less than 50% of a total projected area are accounted for by tabular grains meeting conditions (i) to (v) below:

(i) said tabular grains are silver iodobromide or silver bromochloroiodide tabular grains having (111) faces as major surfaces (ii) an equivalent-circle diameter is not less than 3.5 $\mu$m and a thickness is not more than 0.25 $\mu$m (iii) a silver iodide content is 2 to 6 mol %

(iv) a silver chloride content is not more than 3 mol %

(v) a silver iodide distribution has a multilayered structure of quintuple or higher-order.

2. An emulsion according to claim 1, wherein the silver iodide distribution has a multilayered structure of sextuple or higher-order.

3. An emulsion according to claim 1, wherein when irradiated with an electromagnetic beam of 325 nm at 6 K, said emulsion generates induced fluorescence of 575 nm which is at least ⅓ the intensity of maximum fluorescence emission induced in the wavelength range of 490 to 560 nm.

4. An emulsion according to claim 1, wherein the average silver iodide content on the surfaces of all grains is not more than 5 mol %.

5. An emulsion according to claim 1, wherein letting It be the average silver iodide content of a whole grain and Is be the average silver iodide content on the surface of said grain, $$0.3 \cdot It \leq Is$$

holds.

6. An emulsion according to claim 1, wherein at least a portion of said silver halide grain has a positive hole capturing zone.

7. An emulsion according to claim 1, wherein the tabular grains meeting the conditions (i) to (v) recited in claim 1 have dislocation lines localize in the vicinities of corners of said grains.

8. An emulsion according to claim 1, wherein the variation coefficient of equivalent-circle diameters of all grains is not more than 25%.

9. An emulsion according to claim 1, wherein the condition (ii) recited in claim 1 is that the equivalent-circle diameter is not less than 3.5 μm and the thickness is not more than 0.15 μm.

10. An emulsion according to claim 1, wherein the condition (ii) recited in claim 1 is that the equivalent-circle diameter is not less than 4.0 μm and the thickness is not more than 0.15 μm.

11. An emulsion according to claim 1, wherein the condition (ii) recited in claim 1 is that the equivalent-circle diameter is not less than 4.0 μm and the thickness is not more than 0.10 μm.

12. An emulsion according to claim 1, wherein said emulsion is spectrally sensitized by a spectral sensitizing dye.

13. An emulsion according to claim 1, wherein said emulsion contains 400 to 2,500 ppm of calcium ions and/or 50 to 2,500 ppm of magnesium ions.

14. An emulsion according to claim 1, wherein said emulsion is selenium-sensitized and contains at least one type of a water-soluble mercaptotetrazole compound represented by formula (I-1) below and at least one type of a water-soluble mercaptotriazole compound represented by formula (I-2) below:

Formula (I-1)

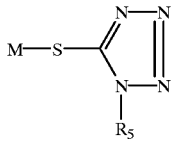

wherein $R_5$ represents an organic residue substituted by at least one member selected from the group consisting of —$SO_3M$, —COOM, —OH, and —$NHR_2$, M represents a hydrogen atom, an alkali metal atom, a quaternary ammonium group, or a quaternary phosphonium group, $R_2$ represents a hydrogen atom, $C_1$–$C_6$ alkyl, —$COR_3$, —$COOR_3$, or —$SO_2R_3$, and $R_3$ represents a hydrogen atom, alkyl, or aryl;

Formula (I-2)

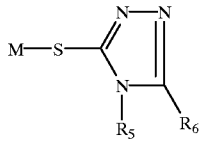

wherein $R_6$ represents a hydrogen atom, substituted or nonsubstituted alkyl, or substituted or nonsubstituted aryl, $R_5$ represents an organic residue substituted by at least one member selected from the group consisting of —$SO_3M$, —COOM, —OH, and —$NHR_2$, M represents a hydrogen atom, an alkali metal atom, a quaternary ammonium group, or a quaternary phosphonium group, $R_2$ represents a hydrogen atom, $C_1$–$C_6$ alkyl, —$COR_3$, —$COOR_3$, or —$SO_2R_3$, and $R_3$ represents a hydrogen atom, alkyl, or aryl.

15. A silver halide photosensitive material comprising a sensitive layer containing an emulsion according to claim 1 on a support.

* * * * *